US006584677B2

(12) United States Patent
Garcia et al.

(10) Patent No.: US 6,584,677 B2
(45) Date of Patent: Jul. 1, 2003

(54) HIGH-SPEED, HIGH-CAPACITY TWIST PIN CONNECTOR FABRICATING MACHINE AND METHOD

(75) Inventors: Steven E. Garcia, Colorado Springs, CO (US); Randall J. Boudreaux, Colorado Springs, CO (US); James A. Harden, Jr., Colorado Springs, CO (US); David A. Hofmann, Colorado Springs, CO (US)

(73) Assignee: Medallion Technology, LLC, Houston, TX (US)

( * ) Notice: Subject to any disclaimer, the term of this patent is extended or adjusted under 35 U.S.C. 154(b) by 96 days.

(21) Appl. No.: 09/782,987

(22) Filed: Feb. 13, 2001

(65) Prior Publication Data

US 2002/0108242 A1 Aug. 15, 2002

(51) Int. Cl.[7] ..... H01F 7/06

(52) U.S. Cl. ..... 29/605; 29/606; 29/868; 29/872; 29/857

(58) Field of Search ..... 29/605, 606, 868, 29/872, 857

(56) References Cited

U.S. PATENT DOCUMENTS

| | | | | |
|---|---|---|---|---|
| 2,064,545 | A | | 12/1936 | Kleinmann et al. |
| 2,234,641 | A | | 3/1941 | Baumgartner |
| 2,752,580 | A | | 6/1956 | Shewmaker |
| 2,828,455 | A | | 3/1958 | Kraay et al. |
| 3,017,605 | A | | 1/1962 | Platz et al. |
| RE25,798 | E | | 6/1965 | Platz et al. |
| 3,205,469 | A | | 9/1965 | Frank et al. |
| 3,255,430 | A | * | 6/1966 | Phillips ..... 29/517 |
| 3,258,736 | A | | 6/1966 | Crawford et al. |
| 3,277,560 | A | | 10/1966 | Frank et al. |
| 3,319,217 | A | | 5/1967 | Phillips |
| 3,333,225 | A | | 7/1967 | McNutt |
| 3,400,358 | A | | 9/1968 | Byrnes et al. |
| 3,402,466 | A | * | 9/1968 | Phillips ..... 15/104.19 |
| 3,612,369 | A | | 10/1971 | Grebe et al. |
| 3,817,067 | A | | 6/1974 | Voorehees et al. |
| 3,888,401 | A | | 6/1975 | Minall et al. |
| 3,890,865 | A | | 6/1975 | Tarbox et al. |
| 4,043,494 | A | | 8/1977 | Bickford et al. |
| 4,076,356 | A | | 2/1978 | Tamburro |
| 4,119,206 | A | | 10/1978 | Woodman, Jr. et al. |
| 4,358,180 | A | | 11/1982 | Lincoln |

(List continued on next page.)

FOREIGN PATENT DOCUMENTS

| | | |
|---|---|---|
| JP | 55-133355 | 10/1980 |
| JP | 55-133549 | 10/1980 |
| JP | 56-8837 | 1/1981 |
| JP | 63-208237 | 8/1988 |
| JP | 63-293845 | 11/1988 |
| JP | 3-209173 | 9/1991 |
| JP | 3-209174 | 9/1991 |
| WO | WO 9419518 | 9/1994 |

*Primary Examiner*—Timothy V. Eley
*Assistant Examiner*—Alvin J. Grant
(74) *Attorney, Agent, or Firm*—John R. Ley

(57) ABSTRACT

Twist pins having bulges are fabricated from helically coiled stranded wire. Wire is advanced from a source such as a spool to create slack wire configuration, and wire is then advanced from the slack wire configuration to a position where each bulge is formed. Each bulge is formed by gripping the wire in two spaced apart locations and rotating the wire in an anti-helical direction in a single continuous relative revolution to untwist the strands and form the bulge. The wire is thereafter advanced to the position of the next bulge or the position where the wire will be severed to release the fabricated twist pin. The severed fabricated twist pin is conveyed through a flow of gas in a delivery tube into a receptacle of a cassette where the twist pin is stored until used. The cassette is automatically moved to position an occupied receptacle to receive each newly fabricated twist pin.

36 Claims, 23 Drawing Sheets

U.S. PATENT DOCUMENTS 4,422,583 A * 12/1983 Maxner et al. ..... 226/115
4,505,529 A 3/1985 Barkus
4,584,912 A 4/1986 Gudmestad et al.
4,690,349 A 9/1987 Yamaguchi et al.
4,742,973 A * 5/1988 Stomski et al. ..... 242/156
4,773,877 A 9/1988 Krüger et al.
4,843,315 A 6/1989 Bayer et al.
4,889,496 A 12/1989 Neidich
4,911,645 A 3/1990 August et al.
4,951,369 A 8/1990 Verrall
5,014,419 A 5/1991 Cray et al.
5,033,785 A 7/1991 Woolley, Jr.
5,050,295 A 9/1991 Sullivan et al.
5,051,108 A 9/1991 Lincoln
5,054,192 A 10/1991 Cray et al.
5,106,310 A 4/1992 Krajewski et al.
5,112,232 A 5/1992 Cray et al.
5,129,830 A 7/1992 Krajewski et al.
RE34,084 E 9/1992 Noschese
5,184,400 A 2/1993 Cray et al.
5,255,836 A 10/1993 Herber et al.
5,263,307 A 11/1993 Hasui
5,277,018 A 1/1994 Pujol-Isern
5,331,867 A 7/1994 Carpenter et al.
5,388,998 A 2/1995 Grange et al.
5,667,410 A 9/1997 Johnston
5,676,013 A 10/1997 Kahlau
5,865,051 A * 2/1999 Otzen et al. ..... 226/137
5,867,896 A 2/1999 Watanabe
5,904,059 A 5/1999 Perna
6,009,738 A 1/2000 Beecher et al.
6,043,666 A 3/2000 Kazama

* cited by examiner

HIGH-SPEED, HIGH-CAPACITY TWIST PIN CONNECTOR FABRICATING MACHINE AND METHOD

CROSS-REFERENCE TO RELATED INVENTIONS

This invention is related to inventions for Wire Feed Mechanism and Method Used for Fabricating Electrical Connectors, Rotational Grip Twist Machine and Method for Fabricating Bulges of Twisted Wire Electrical Connectors, and Pneumatic Inductor and Method of Electrical Connector Delivery and Organization, described in the concurrently-filed U.S. patent applications Ser. Nos. 09/782,991; 09/782,888; and 09/780,981, respectively, all of which are assigned to the assignee hereof, and all of which have at least one common inventor with the present application. The disclosures of these concurrently filed applications are incorporated herein by this reference.

FIELD OF THE INVENTION

This invention generally relates to the fabrication of electrical interconnectors used to electrically connect printed circuit boards and other electrical components in a vertical or z-axis direction to form three-dimensional electronic modules. More particularly, the present invention relates to a new and improved machine and method for fabricating z-axis interconnectors of the type formed from helically coiled strands of wire, in which at least one longitudinal segment of the coiled strands is untwisted in an anti-helical direction to expand the strands of wire into a resilient bulge. Bulges of the interconnector are then inserted into vias of vertically stacked printed circuit boards to establish an electrical connection through the z-axis interconnector between the printed circuit boards of the three dimensional module.

BACKGROUND OF THE INVENTION

The evolution of computer and electronic systems has demanded ever-increasing levels of performance. In most regards, the increased performance has been achieved by electronic components of ever-decreasing physical size. The diminished size itself has been responsible for some level of increased performance because of the reduced lengths of the paths through which the signals must travel between separate components of the systems. Reduced length signal paths allow the electronic components to switch at higher frequencies and reduce the latency of the signal conduction through relatively longer paths. One technique of reducing the size of the electronic components is to condense or diminish the space between the electronic components. Diminished size also allows more components to be included in a system, which is another technique of achieving increased performance because of the increased number of components.

One particularly effective approach to condensing the size between electronic components is to attach multiple semiconductor integrated circuits or "chips" on printed circuit boards, and then stack multiple printed circuit boards to form a three-dimensional configuration or module. Electrical interconnectors are then extended vertically, in the z-axis dimension, between the printed circuit boards which are oriented in the horizontal x-axis and y-axis dimensions. The z-axis interconnectors, in conjunction with conductor traces of each printed circuit board, connect the chips of the module with short signal paths for efficient functionality. The relatively high concentration of chips, which are connected by the three-dimensional, relatively short length signal paths, are capable of achieving very high levels of functionality.

The vertical electrical connections between the stacked printed circuit boards are established by using z-axis interconnectors. Z-axis interconnectors contact and extend through plated through holes or "vias" formed in each of the printed circuit boards. The chips of each printed circuit board are connected to the vias by conductor traces formed on or within each printed circuit board. The vias are formed in each individual printed circuit board of the three-dimensional modules at the same locations, so that when the printed circuit boards are stacked in the three-dimensional module, the vias of all of the printed circuit boards are aligned vertically in the z-axis. The z-axis interconnectors are then inserted vertically through the aligned vias to establish an electrical contact and connection between the vertically oriented vias of each module.

Because of differences between the individual chips on each printed circuit board and the necessity to electrically interconnect to the chips of each module in a three-dimensional sense, it is not always required that the z-axis interconnectors electrically connect to the vias of each printed circuit board. Instead, those vias on those circuit boards for which no electrical connection is desired are not connected to the traces of that printed circuit board. In other words, the via is formed but not connected to any of the components on that printed circuit board. When the z-axis interconnector is inserted through such a via, a mechanical connection is established, but no electrical connection to the other components of the printed circuit board is made. Alternatively, each of the z-axis interconnectors may have the capability of selectively contacting or not contacting each via through which the interconnector extends. Not contacting a via results in no electrical connection at that via. Of course, no mechanical connection exists at that via either, in this example.

A number of different types of z-axis interconnectors have been proposed. One particularly advantageous type of z-axis interconnector is known as a "twist pin." Twist pin z-axis interconnectors are described in U.S. Pat. Nos. 5,014,419, 5,064,192, and 5,112,232, all of which are assigned to the assignee hereof.

An example of a prior art twist pin 50 is shown in FIG. 1. The twist pin 50 is formed from a length of wire 52 which has been formed conventionally by helically coiling a number of outer strands 54 around a center core strand 56 in a planetary manner, as shown in FIG. 2. At selected positions along the length of the wire 52, a bulge 58 is formed by untwisting the outer strands 54 in a reverse or anti-helical direction. As a result of untwisting the strands 54 in the anti-helical direction, the space consumed by the outer strands 54 increases, causing the outer strands 54 to bend or expand outward from the center strand 56 and create a larger diameter for the bulge 58 than the diameter of the regular stranded wire 52. The laterally outward extent of the bulge 58 is illustrated in FIG. 3, compared to FIG. 2.

The strands 54 and 56 of the wire 52 are preferably formed from beryllium copper. The beryllium copper provides necessary mechanical characteristics to maintain the shape of the wire in the stranded configuration, to allow the outer strands 54 to bend outward at each bulge 58 when untwisted, and to cause the bulges 58 to apply resilient radial contact force on the vias of the printed circuit boards. To facilitate and enhance these mechanical properties, the twist pin will typically be heat treated after it has been fabricated. Heat treating anneals or hardens the beryllium copper slightly and tempers the strands 54 at the bulges 58, causing enhanced resiliency or spring-like characteristics. It is also typical to plate the fabricated twist pin with an outer coating of gold. The gold plating establishes a good electrical connection with the vias. To cause the gold-plated exterior coating to adhere to the twist pin 50, usually the beryllium copper is first plated with a layer of nickel, and the gold is plated on top of the nickel layer. The nickel layer adheres very well to the beryllium copper, and the gold adheres very well to the nickel.

The bulges 58 are positioned at selected predetermined distances along the length of the wire 52 to contact the vias 60 in printed circuit boards 62 of a three-dimensional module 64, as shown in FIG. 4. Contact of the bulge 58 with the vias 60 is established by pulling the twist pin 50 through an aligned vertical column of vias 60 in the module 64. The outer strands 54 of the wire 52 have sufficient resiliency when deflected into the outward protruding bulge 58, to resiliently press against an inner surface of a sidewall 66 of each via 60, and thereby establish the electrical connection between the twist pin 50 and the via 60, as shown in FIG. 5. In those circumstances where an electrical connection is not desired between the twist pin 50 and the components of a printed circuit board, the via 60 is formed but no conductive traces connect the via to the other components of the printed circuit board. One such via 60' is shown in FIG. 4. The sidewall 66 of the via 60' extends through the printed circuit board, but the via 60' is electrically isolated from the other components on that printed circuit board because no traces extend beyond the sidewall 66. Inserting a bulge 58 of the twist pin 50 into a via 60' that is not connected to the other components of a printed circuit board eliminates an electrical connection from that twist pin to that printed circuit board, but establishes a mechanical connection between the twist pin and the printed circuit board which helps support and hold the printed circuit board in the three-dimensional module.

To insert the twist pins 50 into the vertically aligned vias 60 of the module 64 with the bulges 58 contacting the inner surfaces 66 of the vias 60, a leader 68 of the regularly-coiled strands 54 and 56 extends at one end of the twist pin 50. The strands 54 and 56 at a terminal end 70 of the leader 68 have been welded or fused together to form a rounded end configuration 70 to facilitate insertion of the twist pin 50 through the column of vertically aligned vias. The leader 68 is of sufficient length to extend through all of the vertically aligned vias 60 of the assembled stacked printed circuit boards 62, before the first bulge 58 makes contact with the outermost via 60 of the outermost printed circuit board 62. The leader 68 is gripped and the twist pin 50 is pulled through the vertically aligned vias 60 until the bulges 58 are aligned and in contact with the vias 60 of the stacked printed circuit boards. To position the bulges in contact with the vertically aligned vias, the leading bulges 58 will be pulled into and out of some of the vertically aligned vias until the twist pin 50 arrives at its final desired location. The resiliency of the strands 54 allow the bulges 58 to move in and out of the vias without losing their ability to make sound electrical contact with the sidewall of the final desired via into which the bulges 58 are positioned. Once appropriately positioned, the leader 68 is cut off so that the finished length of the twist pin 50 is approximately at the same level or slightly beyond the outer surface of the outer printed circuit board of the module 64. A tail 72 at the other end of the twist pin 50 extends a shorter distance beyond the last bulge 58. The strands 54 and 56 at an end 74 of the tail 72 are also fused together. The length of the tail 72 positions the end 74 at a similar position to the location where the leader 68 was cut on the opposite side of the module. However, if desired, the length of the tail 72 or the remaining length of the leader 68 after it was cut may be made longer or shorter. Allowing the tail 72 and the remaining portion of the leader 68 to extend slightly beyond the outer printed circuit boards 62 of the module 64 facilitates gripping the twist pin 50 when removing it from the module 64 to repair or replace any defective components. In those circumstances where it is preferred that the ends of the twist pin do not extend beyond the outside edges of the three-dimensional module, an overlay may be attached to the outermost printed circuit boards to make the ends of the twist pin flush with the overlay.

The ability to achieve good electrical connections between the vias 60 of the printed circuit boards depends on the ability to precisely position the location of the bulges 58 along the length of wire 52. Otherwise, the bulges 58 would be misaligned relative to the position of the vias, and possibly not create an adequate electrical connection. Therefore, it is important in the formation of the twist pins 50 that the bulges 58 be separated by predetermined intervals 76 (FIG. 1) along the length of the wire 52. The position of the bulges 58 and the length of the intervals 76 depend on the desired spacing between the printed circuit boards 62 of the module 64. The amount of bending of each of the outer conductors 54 at each bulge 58 must also be controlled so that each of the bulges 58 exercises enough force to make good electrical contact with the vias. Moreover, the amount of outward deflection or bulging of each of the bulges 58 must be approximately uniform so that none of the bulges 58 experiences permanent deformation when the bulge is pulled through the vias. Distortion-induced disparities in the dimensions of the bulges adversely affect their ability to make sound electrical connections with the vias 60. Further still, each twist pin 50 should retain a coaxial configuration along its length without slight angular bends at each bulge and without any bulge having asymmetrical characteristics. The coaxial configuration facilitates inserting the twist pin through the vertically aligned vias, maintaining the resiliency of the bulges, and establishing good electrical contact with the vias.

The requirements for close tolerances and precision in the twist pins are made more significant upon recognizing the very small size of the twist pins. The typical sizes of the most common sizes of helically-coiled wire are about 0.0016, 0.0033 and 0.0050 in. in diameter. The diameters of the strands 54 and 56 used in forming these three sizes of wires are 0.005, 0.0010, and 0.0015 in., respectively. The typical length of a twist pin having four to six bulges which extends through four to six printed circuit boards will be about 1 to 1.5 inches. The outer diameter of each bulge 58 will be approximately two to three times the diameter of the regularly stranded wire in the intervals 76. The tolerance for locating the bulges 58 between intervals 76 is in the neighborhood of 0.002 in. The weight of a typical four-bulge twist pin is about 0.0077 grams, making it so light that handling the twist pin is very difficult. Handling each twist pin is also complicated because its small dimensions do not easily resist the forces that are necessary to manually manipulate the twist pin without bending or deforming it. It is not unusual that a complex 4 in.×4 in. module 64 may require the use of as many as 22,000 twist pins. Thus, the relatively large number of twist pins necessary to assemble each three-dimensional module require an ability to fabricate a relatively large number of the twist pins in an efficient and rapid manner.

A general technique for fabricating twist pins is described in the three previously-identified U.S. patents. That described technique involves advancing the length of the stranded wire, clamping the stranded wire above and below the location where the bulge is to be formed, fusing the outer strands of the wire to the core strand of the wire preferably by laser welding at the locations above and below the bulge, and rotating the wire between the two clamps in an anti-helical direction to form the bulge.

In a prior art implementation of this twist pin fabrication technique, a wire feeder advanced an end of the helically stranded wire which was wound on a spool. The wire feeder employed a lead screw mechanism driven by an electric motor to advance the wire and unwind it from the spool. A solenoid-controlled clamp was connected to the lead screw mechanism to grip the wire as the lead screw mechanism advanced as much of the stranded wire from the spool as was necessary for use at each stage of fabrication of the twist pin. To advance more wire, the clamp opened and the lead screw mechanism retracted in a reverse movement. The clamp then closed again on the wire and the electric motor again advanced the lead screw mechanism.

While this prior art wire feeder mechanism was functional, the reciprocating movement of the feeder mechanism reduced efficiency and slowed the speed of operation. Half of the reciprocating movement, the return movement to the beginning position, was wasted motion. Moreover, the relatively high inertia and mass of the lead screw, clamp and motor armature required extra force and hence time to execute the reversing movements necessary for reciprocation. Furthermore, the rotational mass of the wire wound on the spool limited the acceleration rate at which the lead screw could unwind the wire off of the spool. The rotational mass was frequently sufficient enough to cause the wire to slip in the clamp carried by the lead screw. Slippage at this location resulted in the formation of the bulges at incorrect positions and incorrect lengths of the leader 68 and the internal lengths 76. The desire to avoid slippage also limited the operating speed of the fabricating equipment.

The prior art bulge forming mechanism included two clamping devices which closed on the wire above and below at the location where each bulge was to be formed. The clamping devices held a wire while a laser beam fused the outer strands 54 to the center core strand 56 at those locations. Thereafter, the lower clamping device was rotated in an anti-helical direction while the upper clamping device held the wire stationary, thereby forming the bulge 58.

The lower clamping device was carried by a sprocket, and the wire extended through a hole in the center of the sprocket. A first pneumatic cylinder was connected to the clamping device to cause the clamping device to grip the wire. A chain extended around the sprocket and meshed with the teeth of the sprocket. One end of the chain was connected to a spring, and the other end of the chain was connected to a second pneumatic cylinder. When the second pneumatic cylinder was actuated, its rod and piston pulled the chain to rotate the sprocket by the amount of the piston throw. Upon reaching the end of its throw, the rod and cylinder of the second pneumatic cylinder was returned in the opposite direction to its original position by the force of the spring which pulled the chain in the opposite direction. Of course, moving the chain to its original position also rotated the sprocket in the opposite direction to its original position.

After gripping the wire by activating the first pneumatic cylinder, the second pneumatic cylinder was activated to rotate the sprocket in the anti-helical direction. However, the throw of the second pneumatic cylinder, and the amount of rotation of the sprocket, was insufficient to completely form a bulge with a single rotational movement. Instead, two separate rotational movements were required to completely form the bulge. After the rotation, the lower clamping device released its grip on the wire while the sprocket rotated in the reverse direction. Upon rotating back to the initial position again, the lower clamping device again gripped the wire and another rotational movement of the sprocket and gripping device was executed to finish forming the bulge.

By providing only a limited amount of rotational movement so as to require two rotations to form the bulge, a significant amount of time was consumed in forming each bulge. The latency of reversing the movement of the components and executing multiple bulge forming movements slowed the fabrication rate of the twist pins. The rotational mass of the sprocket and the clamping mechanism with its attached solenoid activation clamping device reduced the rate at which these elements could be accelerated, and also constituted a limitation on the speed at which twist pins could be fabricated. Apart from the rotational mass issues, acceleration had to be limited to avoid inducing wire slippage. The need to reverse the direction of movement of numerous reciprocating components limited the rate at which the twist pins bulges could be fabricated.

After formation of the bulges in the prior art twist pin fabricating machine, the wire with the formed bulges was cut to length to form the twist pin. The leader of the twist pin extended into a venturi through which gas flowed. The effect of the gas flowing through the venturi was to induce a slight tension force on the wire, and hold it while a laser beam severed the wire at the desired length. The laser beam fused the ends 70 and 74 of the strands 54 and 56 as it severed the fabricated twist pin from the length of wire. The tension force induced on the wire by the gas flowing through the venturi propelled the twist pins into a random pile called a "haystack." After a sufficient number of twist pins had accumulated, they were placed into a separate sorting and singulating machine which ultimately delivered the twist pins one at a time in a specific orientation into a carrier. The pins were later heat treated and transferred from the carrier and inserted into the three-dimensional modules.

The process of sorting the twist pins, orienting them, delivering them into the carrier, and making sure that the twist pins were received properly within the carrier required considerable human intervention and machine handling after the twist pins were fabricated. Occasionally the twist pins would be lodged in tubes which guided the twist pins into the carrier by an air flow. Delivering the twist pins into the receptacles in the carrier was also difficult, and human intervention was required to assure that the twist pins were properly received in the receptacles. Twist pin sorting also occasionally resulted in jamming and bending the twist pins. In general, the post-fabrication processing steps required to organize the twist pins for their subsequent use contributed to overall inefficiency.

These and other considerations pertinent to the fabrication of twist pins have given rise to the new and improved aspects of the present invention.

SUMMARY OF THE INVENTION

One improved aspect of the present invention involves a twist pin fabricating machine and a method of fabricating twist pins which produces twist pins more rapidly and more efficiently than previous techniques. Another improved aspect of the present invention involves fabricating twist pins having more uniform and precisely controlled characteristics, such as more precisely positioned bulges, more uniformly and symmetrically shaped bulges, and bulges, leaders, tails and intervals of more precisely controlled dimensions. Another improved aspect of the present invention involves fabricating twist pins without using reciprocal motions. The lost motion of return strokes and the latency associated with reciprocation decreases the speed of fabricating the twist pins. The necessity to accelerate relatively massive components is avoided by using continuous movements or intermittent movements which do not involve changes of direction and which tend to conserve energy and momentum without requiring acceleration of massive components. Another improved aspect is that the nature of the movements involved does not tend to induce slippage of the wire during the fabrication of the twist pin. Other improved aspects of the invention involve efficiently conveying the fabricated twist pins and thereafter storing the twist pins in a manner which allow them to be used, without requiring manual or mechanical sorting and without requiring mechanical contact and possible damage to the fabricated twist pins. Other aspects of the present invention allow the constituent components of the twist pin to be more precisely fabricated into the desired shapes, dimensions and tolerances, while still allowing twist pins of different sizes to be fabricated.

In one principal regard, the present invention relates to a machine for fabricating twist pins from helically coiled to stranded wire. Each twist pin has a plurality of bulges formed at predetermined positions along a segment of wire from which twist pin is fabricated. The machine comprises a wire feed mechanism which receives the stranded wire from a source and includes a roller which frictionally contacts the wire, and a feed motor which rotates the roller while in frictional contact with the wire to advance the wire. The wire feed mechanism advances the wire into a bulge forming mechanism. The wire feed mechanism advances the wire to the predetermined position where the bulge forming mechanism forms a bulge in the wire. The bulge forming mechanism includes first and second controllable clamp members located at spaced apart locations to contact the wire above and below the predetermined position where the bulge is to be formed. The first and second clamp members grip the wire and rotate relative to one another in a anti-helical direction to untwist the wire and form the bulge.

A drive motor rotates the first and second clamp members in complete revolutions relative to one another. At the beginning of a bulge-forming rotational interval, a first and second actuators control the first and second clamp members to grip the wire. During the bulge-forming relative rotational interval the clamp members rotate the wire anti-helically to untwist the helically coiled strands until the strands deflect radially outward to form the bulge. Thereafter at the end of the bulge-forming interval, the first and second actuators control the first and second clamp members to release the grip on the wire. Preferably one of the clamp members is position stationarily and the other clamp member is driven by the motor to rotate relative to it.

In another principal regard, the present invention relates to a method of fabricating twist pins from helically coiled stranded wire. This method comprises the steps of advancing the wire to a predetermined position at which a bulge is to be formed, rotating the wire anti-helically through a continuous rotational interval relative to positions above and below the predetermined position to untwist the helically coiled strands until the strands deflect radially outward to form the bulge, severing a segment of the wire which contains the bulge from a remaining length of the wire to form the twist pin, and conveying the severed twist pin within a flow of gas into a receptacle immediately after severing segment containing the twist pin.

In yet another principal regard, the present invention relates to a method of fabricating twist pins from helically coiled stranded wire. The steps of this method involve comprise gripping the wire at one position with a first controllable clamp member above the location where a bulge is to be formed, gripping the wire at another position with a second controllable clamp member below the location where the bulge is to be formed, rotating the first and second clamp members anti-helically with respect to one another through a continuous bulge-forming rotational interval to untwist the helically coiled strands between the positions into the bulge, controlling the first and second controllable clamp members to release the wire after the relative rotation through the bulge-forming rotational interval, continuing the relative rotation of the first and second clamp members through a wire-advancement rotational interval following the bulge-forming rotational interval, and advancing the wire during the wire-advancement rotational interval.

Preferably, the first and second clamp members are rotated continuously relative to one another during the bulge-forming rotational interval without interruption. The bulge-forming rotational interval is greater than half of a single relative revolution, and is preferably three-fourths of a complete relative revolution. The wire-advancing rotational interval consumes the remaining portion of the relative revolution. A predetermined amount of the wire is advanced during the wire-advancement rotational interval to establish the predetermined position where the next bulge is to be formed. The relative rotation may be slowed or ceased during the wire-advancement interval to accommodate the advancement of precise intervals of wire between bulges and to establish the end of the severed wire segment containing the twist pin.

Another preferable aspect of the present invention involves delivering an amount of slack wire from a source of the wire. The wire is preferably supplied from the source by rotating the roller in frictional contact with the wire. The slack wire forms a predetermined configuration and the wire is advanced from the slack wire configuration when forming the bulges. Establishing the slack wire configuration between the source of the wire, such as a school upon which the stranded wire is wound, isolates the wire advanced to form the bulges from the mass and rotational inertia effects of unwinding the wire from the spool, thereby achieving greater precision without wire slippage in positioning the wire during the formation of the twist pin, as well as achieving greater speed in advancing the wire and consuming less time to advance the wire.

Other preferable features of the invention involve conveying each of a plurality of fabricated twist pins into a separate receptacle of a cassette. The cassette is moved relative to a delivery nozzle through which the fabricated twist pins pass to position an unoccupied receptacle below the delivery nozzle. Preferably, the twist pin is confined in the receptacle of the cassette until it is withdrawn for use. Still other preferable features of the invention involve severing the wire segment and releasing the fabricated twist pin downstream of the location where the bulge is formed, creating a flow of gas sufficient to convey the twist pin after the wire segment is severed and released, conveying the twist pin by the flow of gas into the receptacle of the cassette, and moving the cassette to position an unoccupied receptacle to receive the next fabricated twist pin.

Removing the wire from the source by unwinding the spool independently of advancing the wire, and forming the bulges in a single action in a single rotational interval of a complete relative revolution, and conveying the fabricated twist pins directly into receptacles of a cassette which is moved to position another receptacle to receive each twist pin as it is fabricated, permits twist pins to be fabricated rapidly and efficiently. Moreover the fabricated twist pins have more uniform and precisely positioned and symmetrically shaped bulges. The inefficiency, lost motion and latency associated with reciprocating actions are avoided. The preferred components used to fabricate the twist pins need not be massive and do not require added time and force to accelerate and decelerate. Instead, the preferred components conserve energy and momentum. The risks of wire slippage during advancement and relative rotation are minimized. The fabricated twist pins are efficiently conveyed into the receptacles without requiring mechanical contact or human intervention. The twist pins are stored in receptacles until use, which also eliminates or avoids the risk of damage from manual or mechanical sorting and contact. The machine and the fabrication method are readily adaptable to fabricate twist pins of different sizes.

A more complete appreciation of the present invention and its scope may be obtained from the accompanying drawings, which are briefly summarized below, from the following detailed descriptions of presently preferred embodiments of the invention, and from the appended claims.

DETAILED DESCRIPTION

Twist Pin Fabrication Machine and Method—Overview

Figure 6:
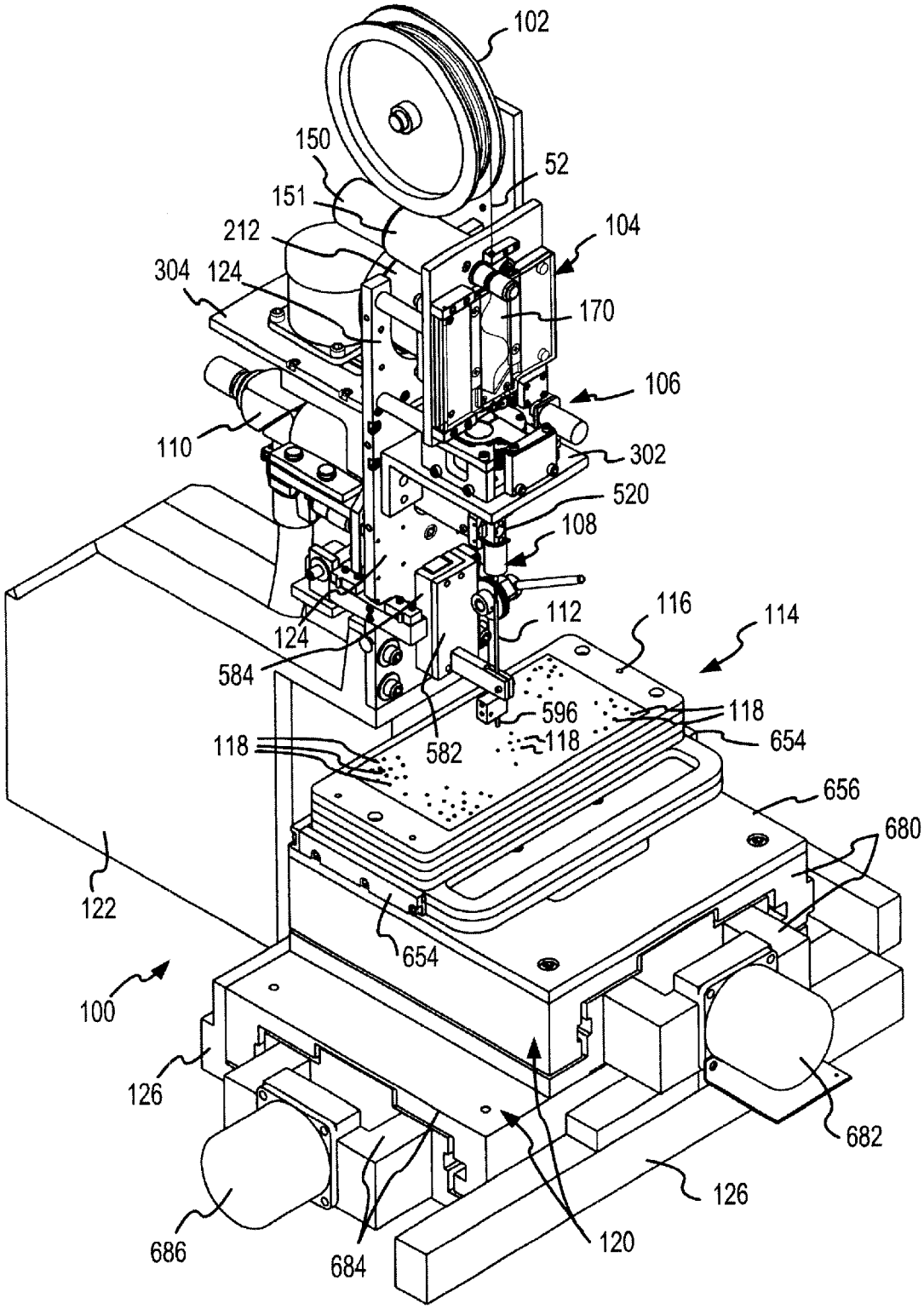
FIG. 6 is a perspective view of a machine for fabricating twist pins of the type shown in FIG. 1, in accordance with the present invention.

An improved machine 100 which fabricates twist pins 50 (FIG. 1), and which also exemplifies the execution of an improved methodology for fabricating twist pins, is introduced by reference to FIG. 6. The twist pins are fabricated from the gold-plated, beryllium-copper wire 52 which is wound on a spool 102. A wire feed mechanism 104 of the machine 100 unwinds the wire 52 from the spool 102 and accurately feeds the wire to a bulge forming mechanism 106 which is located below the wire feed mechanism 104. The bulge forming mechanism forms the bulges 58 (FIG. 1) at precise locations along the length of the wire 52. The positions where the bulges 58 are formed are established by the advancement of the wire 52 by the wire feed mechanism 104. The bulge forming mechanism 106 forms the bulges by gripping the wire 52 and untwisting the wire in the reverse or anti-helical direction.

After all of the bulges of the twist pin 50 (FIG. 1) have been formed by the bulge forming mechanism 106, the wire feed mechanism 104 advances the twist pin configuration formed in the wire 52 into a pneumatic inductor mechanism 108. With the twist pin positioned in the inductor mechanism 108, the end 74 of the tail 72 or the end 70 of the leader 68 (FIG. 1) of the twist pin configuration is located below the bulge forming mechanism 106. A laser beam device 110 is activated and its emitted laser beam melts the wire 52 at the ends 70 and 74 (FIG. 1), thus completing the formation of the twist pin 50 by severing the fabricated twist pin from the remaining wire 52.

Figure 4:
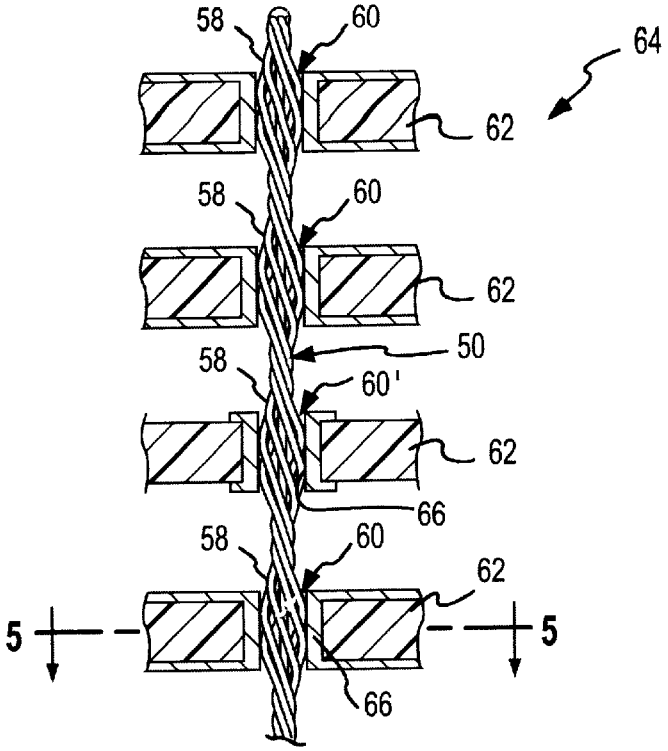
FIG.4 PRIOR ART
FIG. 4 is a partial, vertical cross-sectional view of a prior art three-dimensional module, formed by multiple printed circuit boards and illustrating a single twist pin of the type shown in FIG. 1 extending through vertically aligned vias of the printed circuit boards of the module.
Figure 5:
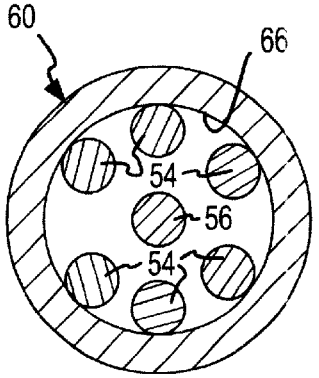
FIG.5 PRIOR ART
FIG. 5 is an enlarged cross-sectional view of the twist pin within a via shown in FIG. 4, taken substantially in the plane of line 5—5 shown in FIG. 4.

The severed twist pin is released into the pneumatic inductor mechanism 108. The inductor mechanism 108 applies a slightly negative relative gas or air pressure or suction to the twist pin, and creates a gas flow which conveys the severed twist pin downward through a tube 112 of a twist pin receiving mechanism 114. The twist pin receiving mechanism 114 includes a cassette 116 into which receptacles 118 are formed in a vertically oriented manner. The tube 112 of the inductor mechanism 108 delivers one twist pin into each of the receptacles 118. Once a twist pin occupies one of the receptacles 118, an x-y movement table 120 moves the cassette 116 to position an unoccupied receptacle 118 beneath the tube 112. The x-y movement table 120 continues moving the cassette 116 in this manner until all of the receptacles 118 have been filled with fabricated twist pins. Once the cassette 116 has been filled with twist pins, the filled cassette is removed and replaced with an empty cassette, whereupon the process continues. Later after heat treatment, the fabricated twist pins are removed from the cassette 116 and inserted into the vias 60 to form the three-dimensional module 64 (FIG. 4).

The operation of the wire feed mechanism 104, the bulge forming mechanism 106, the inductor mechanism 108, the laser beam device 110 and the twist pin receiving mechanism 114 are all controlled by a machine microcontroller or microcomputer (referred to as a "controller," not shown) which has been programmed to cause these devices to execute the described functions. The spool 102, the wire feed mechanism 104, the bulge forming mechanism 106, the inductor mechanism 108 and the laser beam device 110 are interconnected and attached to a first frame element 122. A support plate 124 extends vertically upward from the first frame element 122, and the wire feed mechanism 104, the bulge forming mechanism 106 and the inductor mechanism 108 are all connected to or supported from the support plate 124. The twist pin receiving mechanism 114 is connected to a second frame element 126. Both frame elements 122 and 126 are connected rigidly to a single structural support frame (not shown) for the entire machine 100. All of the components shown and described in connection with FIG. 6 are enclosed within a housing (not shown).

Wire Feed Mechanism and Method

More details concerning the wire feed mechanism 104 are described below and in the above-referenced and concurrently-filed U.S. patent application, Ser. No. 09/782,991. As shown in FIGS. 7–10, the wire feed mechanism 104 includes a pre-feed electric motor 150 and a connected, speed-reducing gear head 151. A capstan 152 is connected to and rotated by the gear head 151. The gear head 151 is rotated by the electric motor and reduces the rotational speed of the motor 150. An idler roller 154 is located adjacent to and in contact with the outer surface of the capstan 152. The wire 52 extends between the capstan 152 and the roller 154. Both of the outer surfaces of the capstan 152 and the roller 154 are formed with resilient material which slightly deforms around the wire 52 to apply sufficient frictional force on the wire 52 to firmly grip the wire between the capstan 152 and the roller 154 and to advance the wire without slippage when the capstan 152 is rotated. Rotating the capstan 152 to advance the wire 52 also unwinds wire 52 from the spool 102 (FIG. 6).

A guide block 156 defines a hole 158 which guides the wire 52 from the spool to a position between the capstan 152 and the roller 154. The gear head 151, a shaft 160 (FIG. 8) upon which the idler roller 154 rotates, and the guide block 156 are all connected to a back plate 162. All of the other components of the wire feed mechanism 104 are also connected to the back plate 162, except the electric motor 150 which is connected to the gear head 151. The back plate 162 is connected by spacers 164 to the support plate 124 (FIG. 6).

Figure 8:
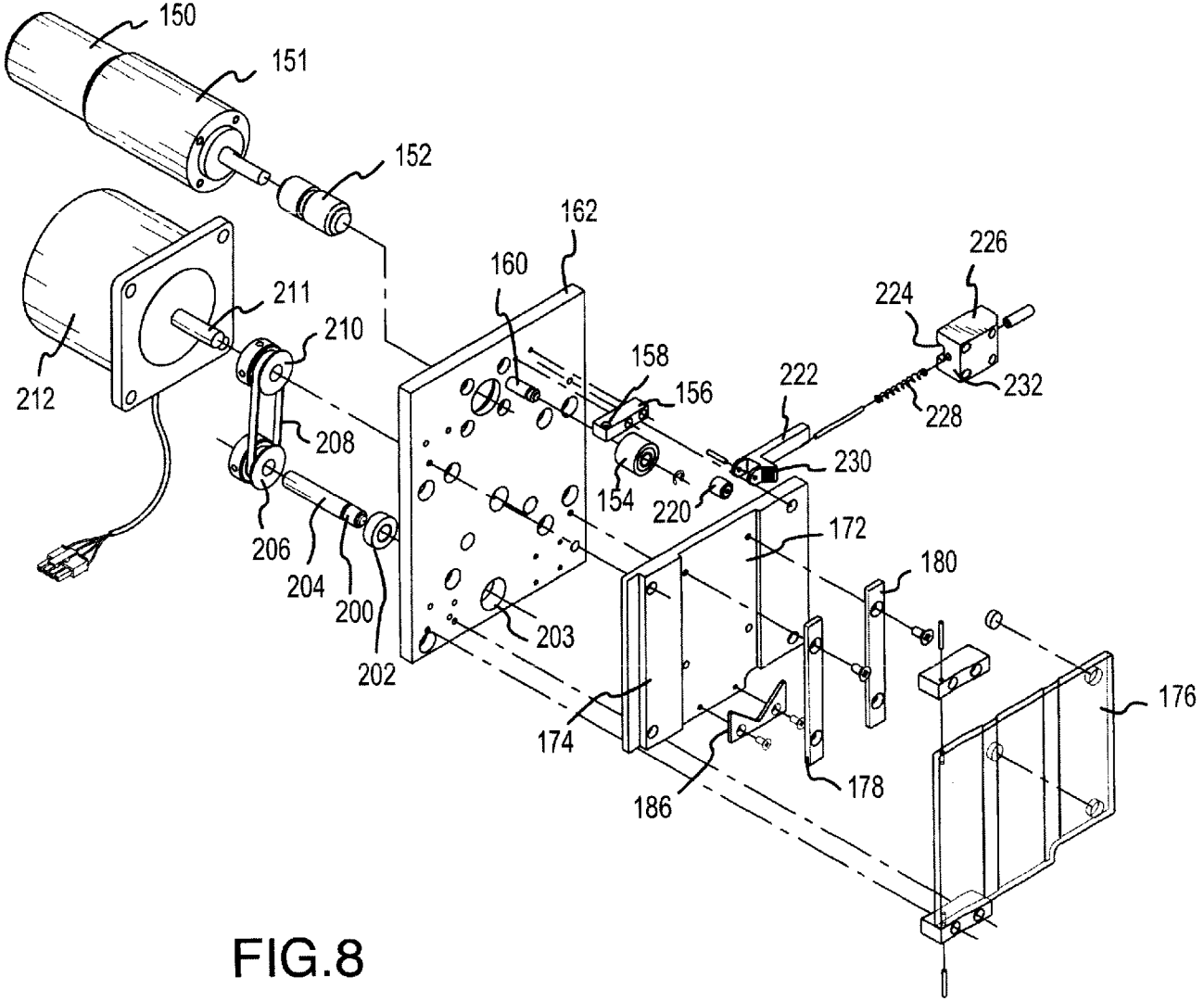
FIG. 8 is an enlarged, exploded perspective view of the wire feed mechanism shown in FIGS. 6 and 7.
Figure 9:
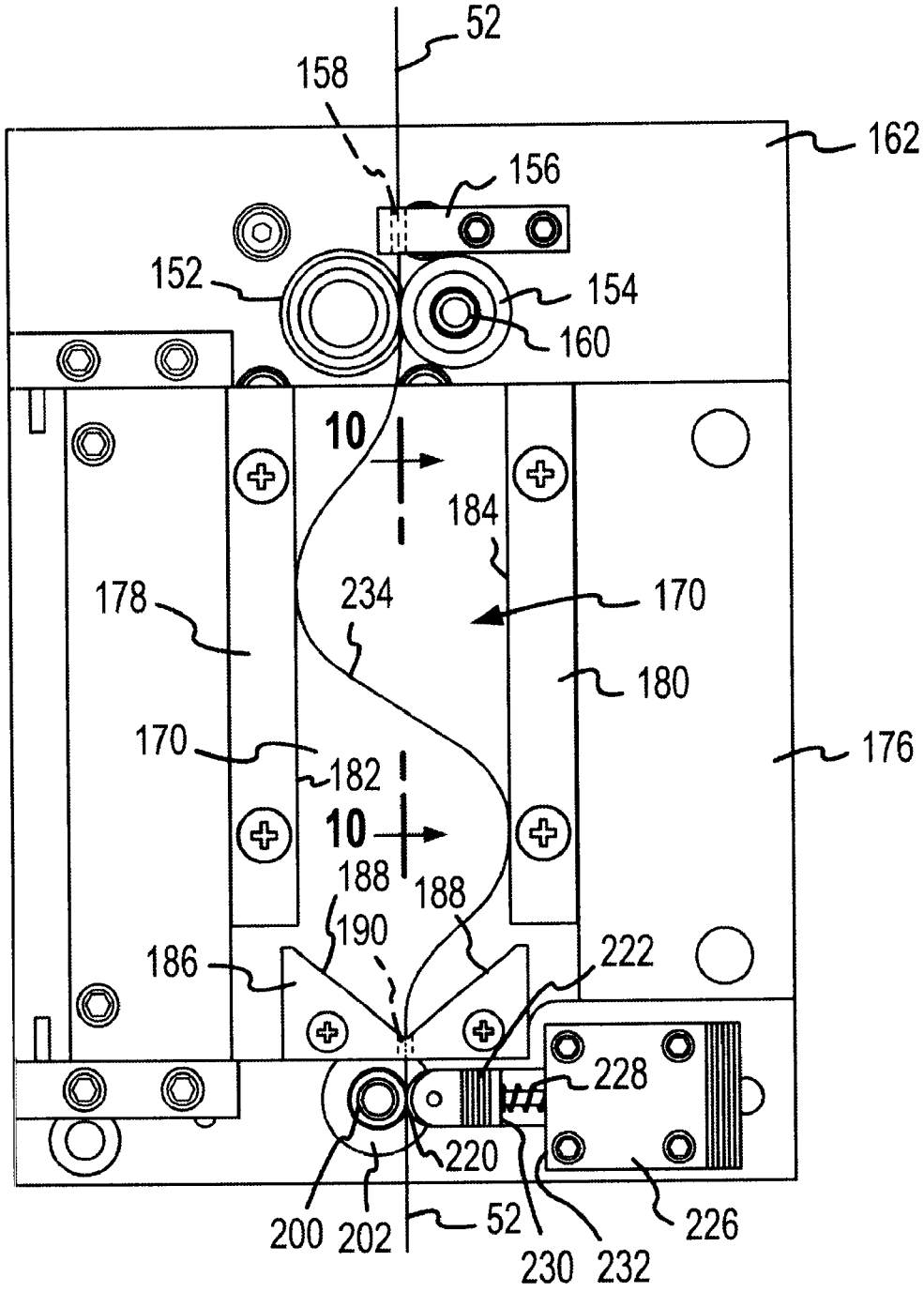
FIG. 9 is an enlarged front elevational view of the wire feed mechanism shown in FIGS. 7 and 8.
Figure 10:
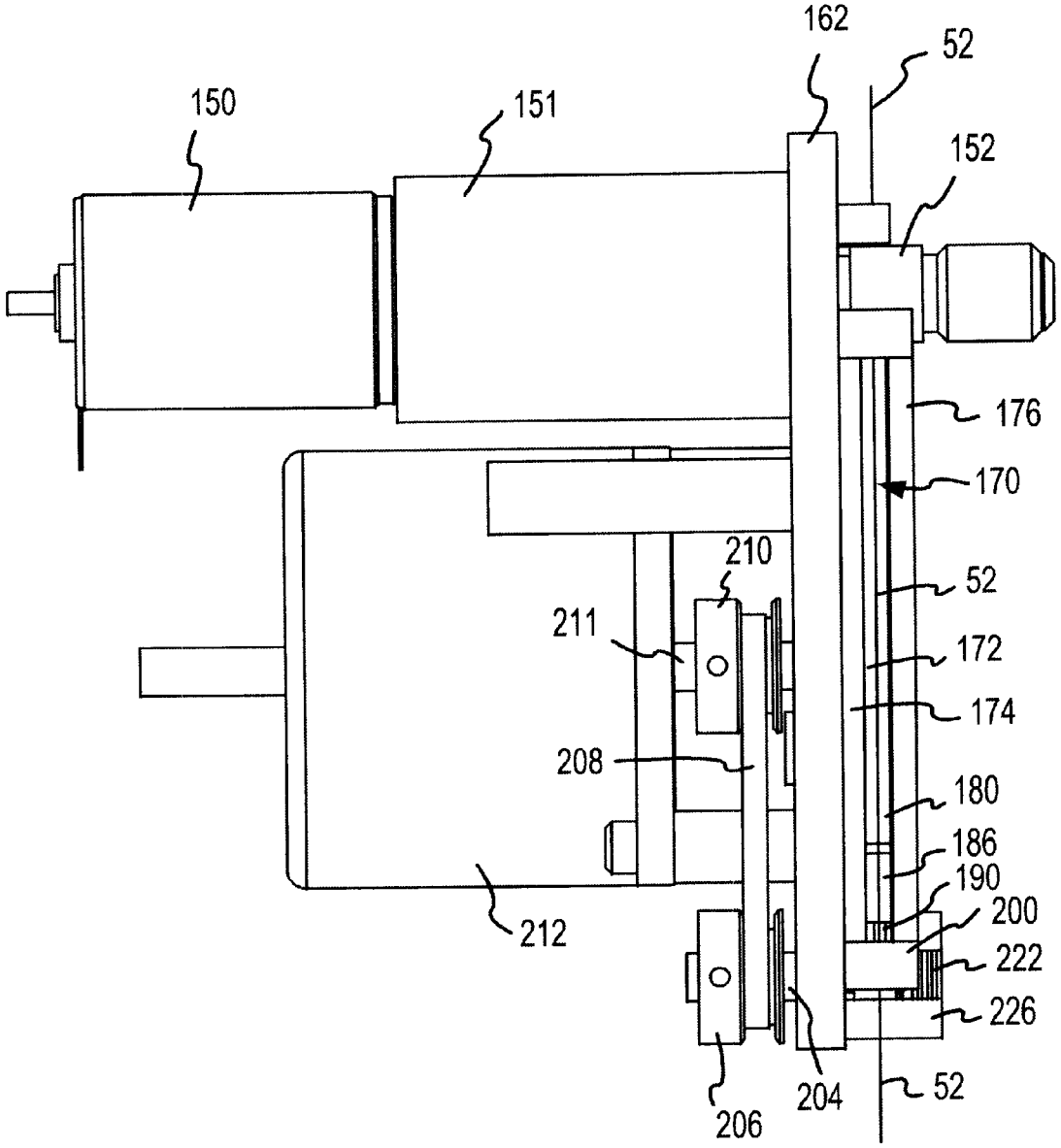
FIG. 10 is a side elevational view of the wire feed mechanism shown in FIG. 9, with a cavity thereof shown sectionally in a view taken substantially in the plane of line 10—10 of FIG. 9.

The rotating capstan 152 advances the wire 52 into a cavity 170. The cavity 170 is defined in part by a vertically-extending, wide rectangular recess 172 (FIG. 8) formed in a rear facing plate 174. The rear facing plate 174 is made of an electrically insulating material and is attached to the back plate 162. A front transparent door 176 covers the recess 172 and forms a front boundary of the cavity 170. The door 176 is hinged to the rear facing plate 174, on the left-hand side of the facing plate 174 as shown in FIGS. 8 and 9. The door 176 is also made of electrically insulating material. Vertically extending contact bars 178 and 180 are positioned on the opposite lateral sides (FIG. 9) of the recess 172. The contact bars 178 and 180 are made from electrically conductive material. The electrically conductive contact bars 178 and 180 are connected to the electrically insulating facing plate 174 in a manner which electrically isolates each of the contact bars 178 and 180 from each other and from the back plate 162. Inside edges 182 and 184 of the contact bars 178 and 180, respectively, define the lateral outside edges of the cavity 170. A cavity exit guide 186 is located at the bottom of the cavity 170. The cavity exit guide 186 includes two downward and inward sloping surfaces 188 which join at an exit hole 190 (FIG. 9). The exit hole 190 extends vertically downward through the cavity guide 186 at a position which is directly vertically below the contact point of the pre-feed capstan 152 and the roller 154 and directly above the point where the wire 52 enters the bulge forming mechanism 106.

The wire 52 is withdrawn from the cavity 170 by rotating a wire feed spindle 200. The wire feed spindle 200 is rotationally supported by a bearing 202 which fits within a hole 203 (FIG. 8) formed in the back plate 162. A shaft 204 of the spindle 200 extends on the rear side of the back plate 162. A pulley 206 is connected to the shaft 204 on the rear side of the back plate 162. The pulley 206 and the spindle 200 are rotated by a toothed timing belt 208 which extends between the pulley 206 and a pulley 210. The pulley 210 is connected to the output shaft 211 of a precision feed motor 212. When the feed motor 212 is energized, the pulley 210 rotates the timing belt 208 which in turn rotates the pulley 206 and the spindle 200.

A pinch roller 220 is biased against the spindle 200 by the force applied from a plunger 222. The plunger 222 is movably positioned within a slot 224 formed in a plunger guide block 226. The plunger 222 and the pinch roller 220 are biased outward from the plunger guide block 226 toward the spindle 200 by a spring 228. The spring 228 extends between a shoulder 230 formed on the plunger 222 and a surface 232 of the guide block 226. The exterior surfaces of the spindle 200 and the pinch roller 220 are slightly resilient to establish good frictional contact with the wire 52. The force of the spring 228 causes sufficient frictional contact of the wire 52 between the spindle 200 and the pinch roller 220 to precisely advance the wire 52 by an amount determined by the rotation of the precision feed motor 212.

Figure 1:
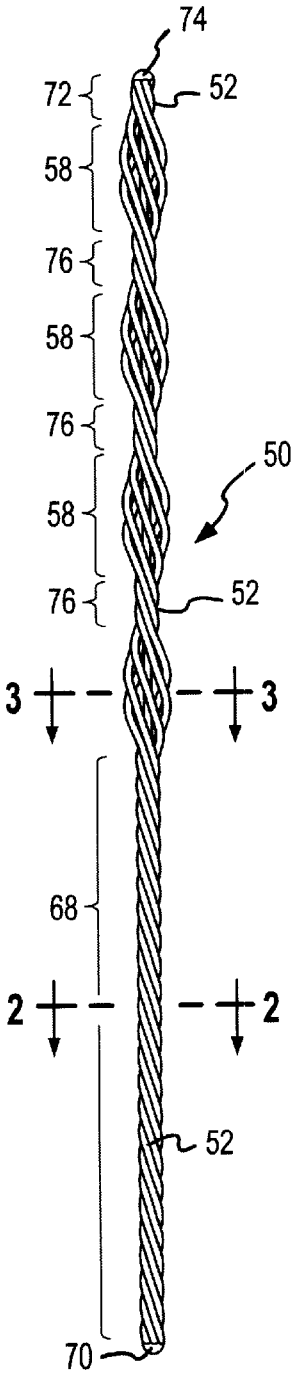
FIG.1 PRIOR ART
FIG. 1 is a side elevational view of a prior art twist pin.
Figure 2:
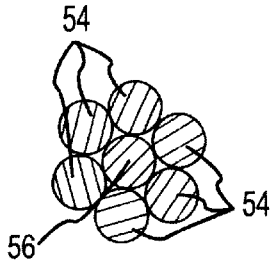
FIG.2 PRIOR ART
FIG. 2 is an enlarged, cross-sectional view of the twist pin shown in FIG. 1, taken substantially in the plane of line 2—2 shown in FIG. 1.
Figure 3:
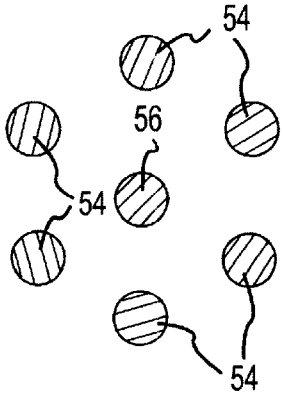
FIG.3 PRIOR ART
FIG. 3 is an enlarged, cross-sectional view of the twist pin shown in FIG. 1, taken substantially in the plane of line 3—3 shown in FIG. 1.

One of the important improvements available from the wire feed mechanism 104 is the ability to unwind wire 52 from the spool 102 (FIG. 6) in such a manner that the rotational inertia of the spool and the mass of the wire withdrawn from the spool do not induce slipping of the wire. Wire slippage can result in adverse positioning of the bulges 58, or incorrect lengths of the leader 68, the tail 72 or the intervals 76 between the bulges (FIG. 1). This improvement has been achieved in significant part by unwinding the wire 52 from the spool 102 independently of the advancement of the wire into the bulge forming mechanism 106, where the lengths and positions of the components of the twist pin 50 are established.

Withdrawing the wire from the spool independently of advancing the wire is achieved by operating the pre-feed motor 150 and pre-feed capstan 152 independently of operating the precision feed motor 212 and the spindle 200, and by accumulating an amount of slack wire in the cavity 170. The pre-feed motor 150 and the capstan 152 advance wire into the cavity 170 until a slack, S-shaped configuration 234 of the wire 52 is accumulated in the cavity 170. The S-shaped configuration 234 consumes enough slack wire within the cavity to form at least one twist pin. Moreover the slack wire of the S-shaped configuration 234 is not under tension or resistance from the spool 102 (FIG. 6), thereby allowing the wire 52 to be advanced precisely from the cavity 170 into the bulge forming mechanism 106 by the precision feed motor 212 and the spindle 200.

The slack amount of wire consumed by the S-shaped configuration 234 in the cavity 170 exhibits very little inertia and mass, thereby allowing the precision feed motor 212 and spindle 200 to advance a desired amount of wire quickly, without having to overcome the adverse influences of attempting to accelerate a significant mass of wire, accelerate the rotation of the spool 102, or to overcome significant inertia of the wire on the spool and the spool while unwinding the wire. The effects of high mass under high acceleration conditions, and the effects of inertia, can induce slippage in the wire as it is advanced under high speed manufacturing conditions, thereby resulting in forming the bulges 58 at incorrect positions and in undesired lengths of the leader 68, the tail 72 and the interval 76 of the twist pin 50. As the wire in the cavity 170 is fed out by the precision feed motor 212 and spindle 200, the pre-feed motor 150 and the capstan 152 feed more wire into the cavity to maintain the S-shaped configuration 234.

The pre-feed motor 150 is energized and operates to advance wire from the spool into the cavity until bends of the S-shaped configuration 234 contact the edges 182 and 184 of the contact bars 178 and 180. When the bends of the S-shaped configuration 234 contact both contact bars 178 and 180, the power to the pre-feed motor 150 is terminated. Thereafter, as the precision feed motor 212 and spindle 200 withdraw wire from the cavity 170, causing the S-shaped configuration 234 to become narrower and withdraw the bends of the S-shaped configuration from contact with the edges 182 and 184 of the contact bars 178 and 180, power is again supplied to the pre-feed motor 150 to advance more wire into the cavity 170 until the S-shaped configuration is re-established. The pre-feed motor 150 advances the wire into the cavity 170 at a faster rate than the wire is withdrawn by the precision feed motor 212, causing the wire within the cavity 170 to maintain the S-shaped configuration 234.

Figure 7:
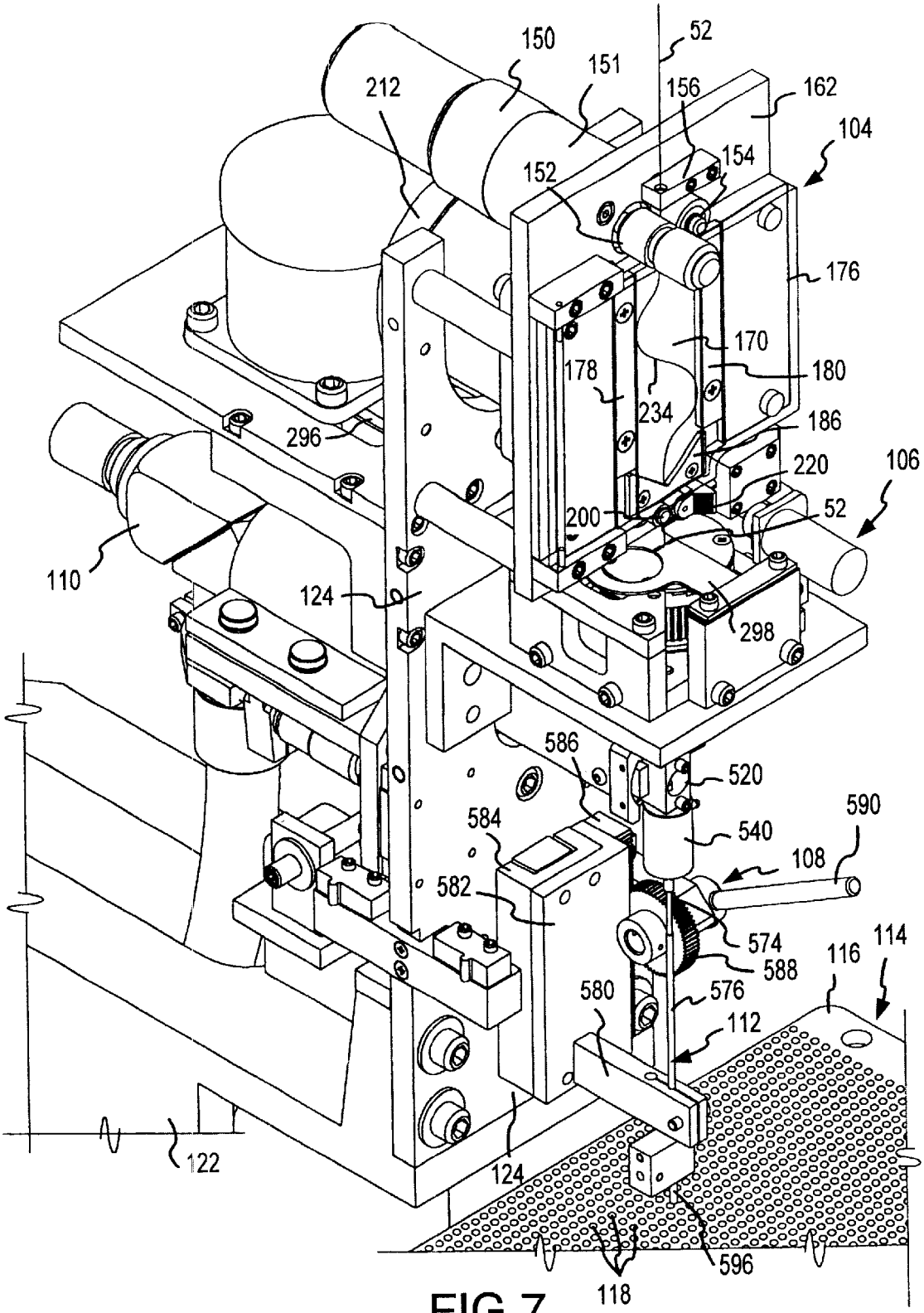
FIG. 7 is an enlarged perspective view of a wire feed mechanism, a bulge forming mechanism, an inductor mechanism and a portion of a twist pin receiving mechanism of the twist pin fabricating machine shown in FIG. 6.
Figure 11:
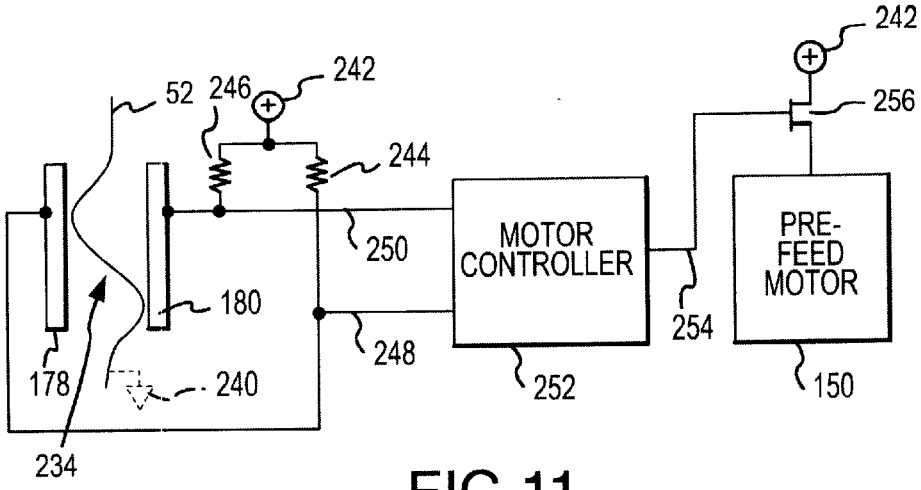
FIG. 11 is a schematic and block diagram of a control system for a pre-feed motor of the wire feed mechanism shown in FIGS. 7–10.

The manner in which the pre-feed motor 150 is energized to cause slack wire in the cavity 170 to assume the S-shaped configuration 234 is understood by reference to FIG. 11 taken in connection with FIG. 9. The wire 52 fed into the cavity 170 is electrically connected to reference potential 240 as a result of the electrical contact of the wire with the grounded bulge forming mechanism 106 (FIG. 7). Each of the contact bars 178 and 180 are electrically isolated from the reference potential 240 and are normally connected to a logic-high level voltage 242 through resistors 244 and 246, respectively. Each of the contact bars 178 and 180 are also connected by conductors 248 and 250, respectively, to a motor controller 252. When the wire 52 does not contact either of the contact bars 178 or 180, the signals on the conductors 248 and 250 are at a logic-high level, due to their connection through the resistors 244 and 246 to the logic-high level potential 242. The motor controller 252 interprets the two logic-high signals at 248 and 250 as a condition to apply a power control signal at 254. The presence of the power control signal 254 biases a transistor 256 or other control switch device to conduct current to the pre-feed motor 150. The pre-feed motor rotates and wire 52 is unwound from the spool 102 (FIG. 6) and advanced into the cavity 170 (FIG. 9).

When a sufficient amount of wire has been advanced into the cavity 170 to cause the wire to contact one of the contact bars, for example contact bar 178, the reference-potential of the wire 52 causes the signal at 248 to assume a logic-low level. Under these conditions, the motor controller 252 senses a logic-high level signal at 250 and a logic-low level signal at 248. The motor controller 252 continues to deliver the power control signal 254 under these conditions, causing the pre-feed motor 150 to continue to operate. However, when the S-shaped configuration 234 continues to widen so that the wire 52 also bends into electrical contact with the other one of the contact bars, 180 in this example, the control signal 250 assumes a logic-low level. Under these conditions, the motor controller 252 stops supplying the power control signal 254, and the pre-feed motor 150 ceases operation.

When the precision feed motor 212 has advanced enough wire from the cavity 170 to cause one or both of the bends of the S-shaped configuration 234 to withdraw from contact with one of the contact bars 178 or 180, one or both of the control signals 248 or 250 again assumes a logic-high level. When one or both of the control signals 248 or 250 assumes a logic-high level, the motor controller 252 resumes the delivery of the power control signal 254. The pre-feed motor 150 again responds to the assertion of the power control signal 254 to unwind more wire from the spool into the cavity 170, until the bends of the S-shaped configuration 234 again make electrical contact with the contact bars 178 and 180. The pre-feed motor 150 will feed wire into the cavity 170 at a greater rate than the precision feed motor 212 will advance wire from the cavity 170. This difference in relative wire advancement rates of the motors 150 and 212, and the control arrangement just described, assures that sufficient slack wire will be fed into the cavity in the form of the S-shaped configuration 234 at all times, even though the bends of the S-shaped configuration 234 may not contact the contact bars 178 and 180 continuously.

Figure 12:
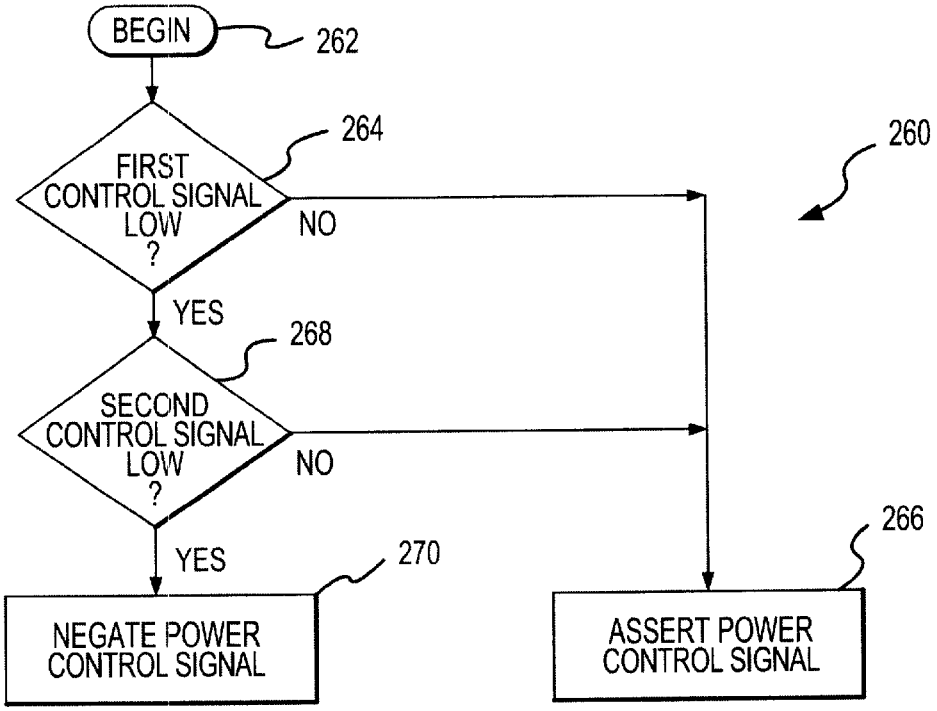
FIG. 12 is a flowchart of the steps executed by the control system shown in FIG. 11.

The overall functionality achieved by the wire position sensing arrangement of the contact bars 178 and 180 and the motor controller 252 is shown in FIG. 12 in the form of a flowchart of the steps involved in a control procedure 260 accomplished by the motor controller 252. The steps of the control procedure 260 begin at 262. At 264, a determination is made whether the first control signal 248 is at a logic-low level. A logic-low level control signal 248 represents the condition where a bend of the S-shaped configuration 234 of wire 52 has contacted the contact bar 178. Until such time as a bend of the S-shaped configuration 234 contacts the contact bar 178, the control signal 248 maintains a logic-high level and the motor controller 252 continues to assert the power control signal 254 at step 266. However, once a bend of the S-shaped configuration 234 contacts the control bar 178 and the control signal 248 assumes a logic-low level as determined at step 264, another determination is made at step 268 as to whether the second control signal 250 has assumed a logic-low level. Until such time as the second control signal 250 has assumed a logic-low level because of a bend of the S-shaped configuration 234 contacting the contact bar 180, the motor controller 252 asserts the power delivery signal 254. Thus, even though the determination at step 264 indicates that the first control signal 248 is at a logic-low level indicating contact with the contact bar 178, the power control signal 254 will be asserted at step 266 until such time as the second control signal 250 has assumed a similar logic-low level. However, two affirmative determinations at steps 264 and 268 cause the power control signal 254 to be negated, as indicated at step 270. The negation of the power control signal 254 at step 270 causes the termination of delivery of power to the pre-feed motor 150, which causes the pre-feed motor 150 to stop rotating.

The lateral width of the cavity 170 in the horizontal dimension and the height of the cavity 170 in the vertical dimension, as shown in FIG. 9, are established in relation to the natural column deflection or bend characteristics of the wire 52. The lateral width and height of the cavity 170 should be sufficient to allow the accumulation of enough slack wire in the S-shaped configuration 234 to avoid creating tension in the wire passing through the cavity 170 as that wire is advanced by the precision feed motor 212. Preferably, the lateral width and height of the cavity 170 is also sufficient to accumulate enough slack wire to form at least one twist pin from the wire in the cavity. However, the lateral width should not be so great, and the vertical height should not be so small as to induce sharp bends in the wire 52 that would cause the wire to assume a permanent set or deformation. A permanent set or deformation would cause a bend in the wire that would adversely influence its linear advancement through the bulge forming mechanism 106, thereby resulting in a nonlinear or non-coaxial twist pin or the formation of bulges 58 which are not symmetrical about the axis of the twist pin.

On the other hand, the lateral width and vertical height of the cavity should not be so great as to permit more than two bends (one S-shaped configuration 234) to occur, because otherwise some complex shape other than the S-shaped configuration 234 would be formed in the cavity. Some other complex shape, such as a FIG. 8 shape, a circle shape, or some random geometric shape, might result in the wire not touching one of the contact bars 178 or 180, or could cause a permanent deformation or set in the wire due to short radius bends or in tightening of those bends by the withdrawal of the wire from the cavity by the precision feed motor 212. In general, the lateral width and the vertical height of the cavity 170 is adjusted to accommodate different diameters and column deflection strength characteristics of wire 52. Such adjustment may be achieved by positioning the location of the contact bars 178 and 180 at a greater or lesser lateral separation, or by changing the lateral width of the contact bars 178 and 180.

Figure 13:
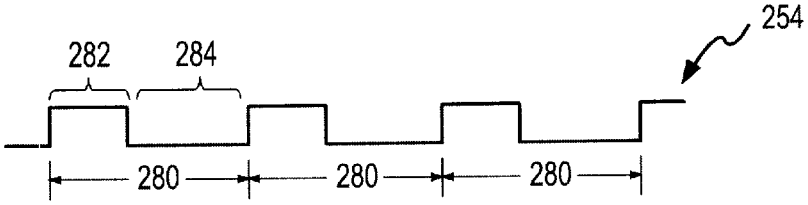
FIG. 13 is a waveform diagram of a power control signal created by the control system shown in FIG. 11.

The relatively high rotational rate of the pre-feed motor 150, and the rotation of the gear reduction head 151, will continue rotating the pre-feed capstan 152 after the termination of the power control signal 254, due to the rotational inertia or "wind-down" effect of these elements. To counter the effects of wind-down, and to obtain more precise control from a conventional relatively-inexpensive, direct-current, high-rotational speed motor 150 driving a conventional planetary gear reduction head 151, the power control signal 254 is delivered from the motor controller 252 (FIG. 11) in the form of a duty cycle signal as shown in FIG. 13. Separate cycles of the duty cycle control signal 254 are designated at 280. During each cycle 280, there is an on-time portion 282 of the signal 254 during which power is delivered to the pre-feed motor 150 and there is an off-time portion 284 of the signal 254 during which power is not delivered to the pre-feed motor 150.

The frequency of occurrence of the duty cycles 280 is sufficiently rapid to cause a generally continuous operation of the pre-feed motor 150, but not so frequent as to allow the rotational inertia effects of wind-down to advance more wire into the cavity than is desired. The frequency of the occurrence of the cycles 280, and the amount of on-time 282 relative to the off-time 284 during each cycle 280, is adjusted in accordance with the rotational inertia effects of wind-down from the motor 150 and the gear head 151. Of course, when the power control signal 254 is negated, no duty cycles 280 occur at all. The power control signal 254 controls the transistor switch 256 (FIG. 11) which delivers DC current to the pre-feed motor 150 during the on-times 282 of each cycle 280.

The precision feed motor 212 is preferably a conventional stepper motor. As such, the times of its rotation and the extent of its rotation are precisely controlled by pulse signals which cause the stepper motor 212 to rotate in a predetermined increment of a full rotation for each pulse delivered. For example, one pulse might cause the stepper motor 212 to rotate one rotational increment or one degree. A predetermined number of rotational increments are required to cause the motor 212 to rotate one complete revolution. Moreover, the stepper motor 212 responds by advancing through the rotational increment very rapidly in response to the delivery of each pulse. Consequently, there is very little time latency between the delivery of each pulse to the stepper motor 212 and the increment of rotation achieved by that pulse.

The ratio of the pulleys 206 and 210, and the diameter of the spindle 200 (FIG. 10), are all taken into account to determine the fractional amount of one revolution of the spindle 200 caused by one pulse applied to the stepper motor 212. The fractional amount of one revolution of the spindle 200 is directly related to the amount of linear advancement of the wire 52 by the spindle 200. By recognizing these relationships, the amount of wire 52 advanced by the spindle 200 is precisely controlled by delivering a predetermined number of pulses to the stepper motor 212 which will result in the advancement of the wire 52 by a linear amount which correlates to the predetermined number of pulses delivered to the stepper motor 212.

For example, if the relationship is such that one pulse to the stepper motor will result in the advancement of the wire by 0.001 inch, the advancement of the wire by ¼ of an inch (0.250 inch) is achieved by applying 250 pulses to the stepper motor. The position of the wire is also achieved in a similar manner. As another example in which one pulse to the stepper motor will result in the advancement of the wire by 0.001 inch, if it is desired to space the bulges 58 apart from one another along the twist pin 50 by an interval 76 (FIG. 1) of 1/10 of an inch (0.100 inch) and the length consumed by each bulge 58 is 2/10 of an inch (0.200 inch), the wire 52 is advanced by 3/10 of an inch to form the sequential bulges by applying 300 pulses to the stepper motor 212.

Because of the relatively rapid response and acceleration characteristics of the stepper motor 212, the stepper motor 212 is capable of advancing the wire 52 very rapidly. Thus, the stepper motor 212 offers the advantages of precise amounts of advancement of the wire 52, precise positioning of the wire 52 during the formation of the bulges 58, and positioning and advancement of the wire on a very rapid basis.

In forming the twist pin 50, the number of pulses delivered to the stepper motor 212 is calculated to correlate to the desired position, the desired amount of advancement and hence the length of the wire 52 into the bulge forming mechanism 106 to create the desired length of the leader 68, to create the desired amount of interval 76 between the bulges 58, and to create the desired length of the tail 72 at the location where the wire 52 is severed after the formation of the twist pin 50. As is discussed below in conjunction with the bulge forming mechanism 106, the delivery of the calculated number of pulses is also timed to coincide with operational states of the bulge forming mechanism 106, thus assuring that the wire is advanced to the calculated extent at the appropriate time to coincide with the proper operational state of the bulge forming mechanism 106.

Bulge Forming Mechanism and Method

Details concerning the bulge-forming mechanism 106 are described below and in the above-referenced and concurrently-filed U.S. patent application, Ser. No. 09/782,888. As shown in FIGS. 6, 7 and 14–16, the bulge forming mechanism 106 comprises a stationary gripping assembly 290, a rotating gripping assembly 292 and a drive motor 294 connected by a timing belt 296 to the rotating gripping assembly 292. The drive motor 294 applies rotational force through the belt 296 to rotate the rotating gripping assembly 292. The wire 52 is advanced from the feed wire mechanism 104 through a stationary clamp member 298 of the stationary gripping assembly 290 and through a rotating clamp member 300 of the rotating clamp assembly 292. The stationary clamp member 298 and the rotating clamp member 300 open approximately simultaneously to allow the wire 52 to be advanced. Both clamp members 298 and 300 thereafter close approximately simultaneously to grip the wire 52.

The stationary clamp member 298 closes around the wire 52 with sufficient force to restrain the wire 52 against rotation. The rotating clamp member 300 also closes around the wire 52 with sufficient force to hold the wire 52 stationary with respect to the rotating clamp member 300. However, because the rotating clamp member 300 is rotating due to the rotational energy applied by the drive motor 294 to the rotating gripping assembly 292, the stationary grip of the wire 52 by the rotating clamp member 300 rotates the wire 52 between the clamping members 298 and 300 in the opposite or anti-helical direction compared to the direction that the strands 54 have been initially wound around the core strand 56 (FIG. 1). As a result of the reverse or anti-helical rotation imparted by the rotating gripping assembly 292, one bulge 58 is formed between the rotating clamp member 300 and the stationary clamp member 298.

After formation of the bulge 58, both clamp members 298 and 300 are again opened, and the wire feed mechanism 104 advances the wire 52 to position the wire at a predetermined position along the length of the wire 52 where the next bulge 58 (FIG. 1) will be formed. The rotating clamp member 300 opens sufficiently wide so that the expanded width of the bulge 58 will pass through the opened rotating clamp member 300.

Figure 14:
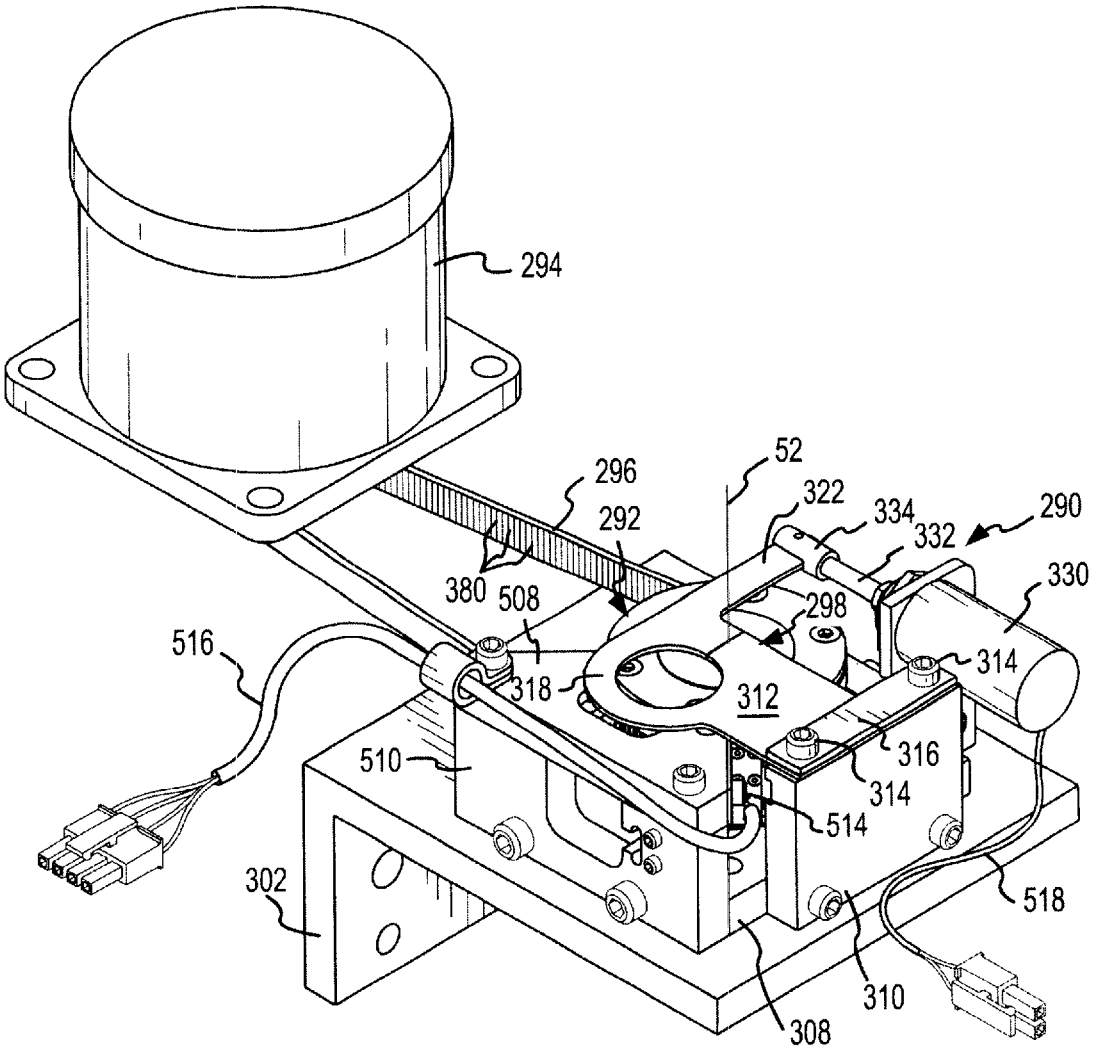
FIG. 14 is an enlarged, perspective view of the bulge forming mechanism shown separated from the other components shown in FIGS. 6 and 7, with certain components not shown for purposes of clarity.
Figure 16:
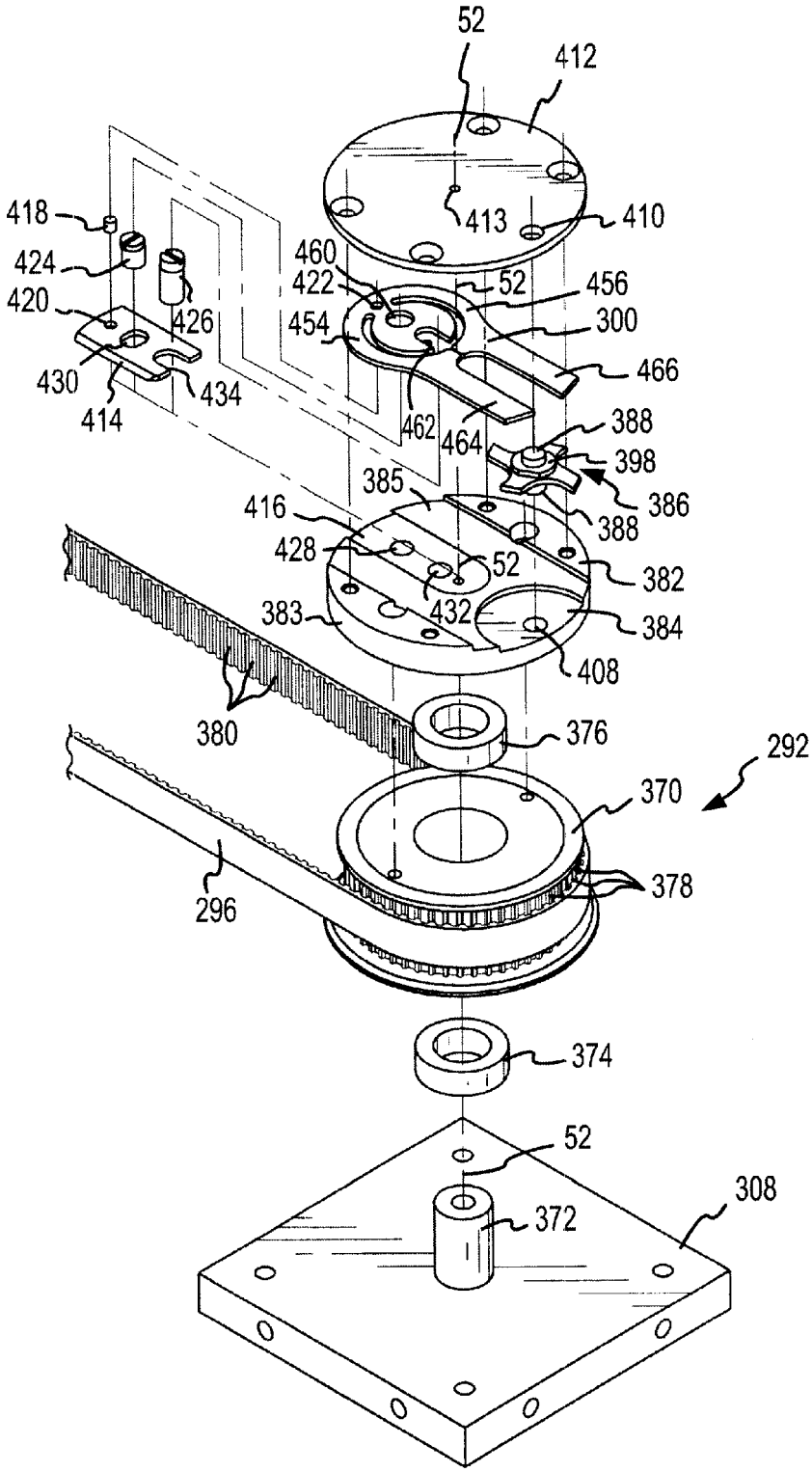
FIG. 16 is an exploded, perspective view of the rotating gripping assembly of the bulge forming mechanism shown in FIG. 15.

As shown in FIG. 14, the rotating gripping assembly 292 is connected to a mounting bracket 302, and a mounting bracket 302 is connected to the support plate 124 of the machine 100 (FIG. 7). The drive motor 294 is connected to a mounting plate 304 which is attached to the support plate 124 by a bracket 306 (FIG. 7). The belt 296 extends through an opening (not shown) in the support plate 124. The rotating gripping assembly 292 is mounted on a base plate 308, and the base plate 308 is connected to the mounting bracket 302. As shown in FIG. 16, all of the components of the rotating gripping assembly 292 are connected directly or indirectly to the base plate 308.

Figure 17:
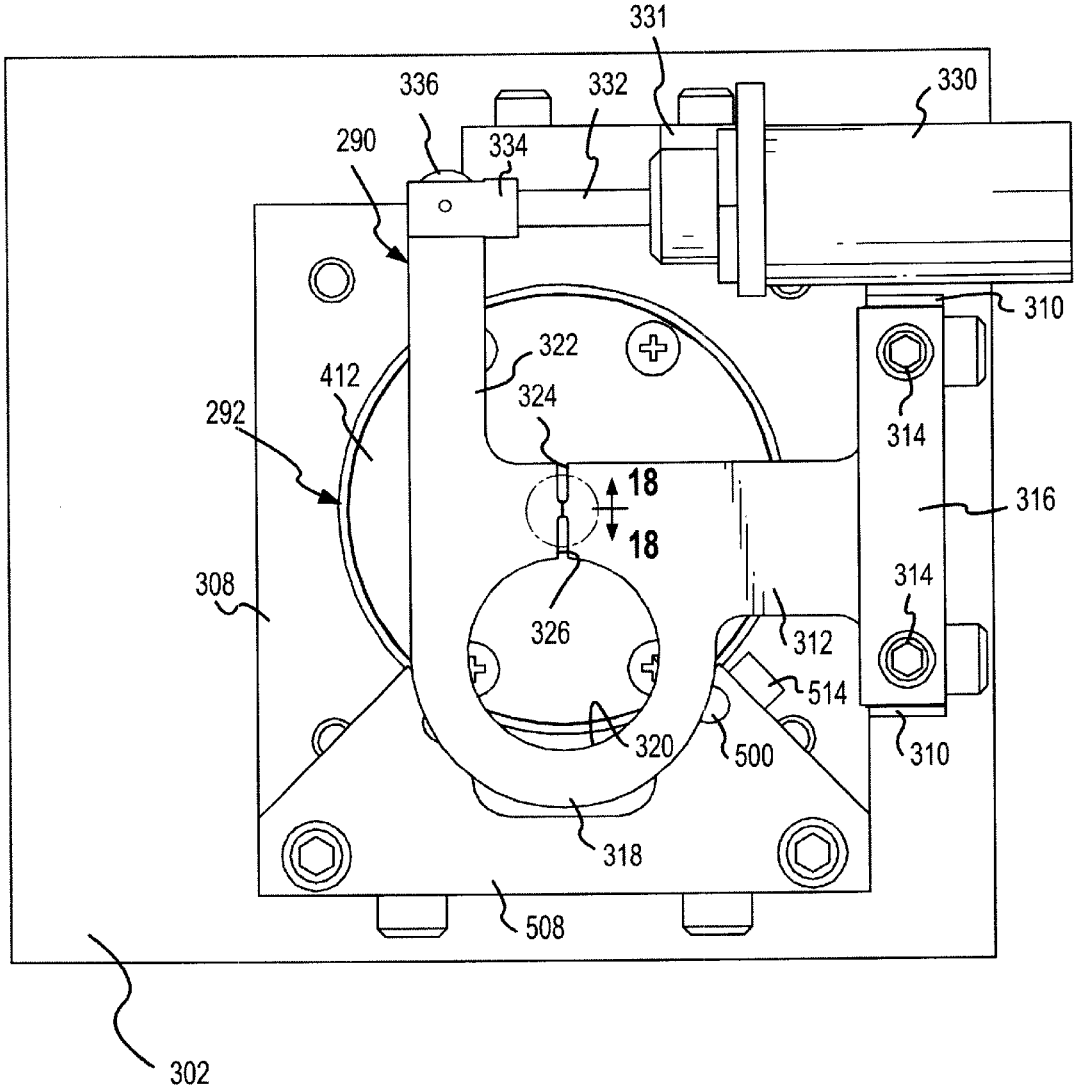
FIG. 17 is an enlarged top plan view of the stationary gripping assembly shown in FIGS. 14 and 15.

The stationary gripping assembly 290 is also connected to the base plate 308 by a mounting block 310, as shown on FIGS. 14 and 17. The stationary clamp member 298 is connected to the mounting block 310. Preferably the stationary clamp member 298 is formed from a relatively thin sheet of spring tempered steel. A base portion 312 of the stationary clamp member 298 is connected by screws 314 and a reinforcing strip 316 to the mounting block 310. As shown in FIG. 17, the base portion 312 is relatively wide and therefore offers considerable torsional resistance to bending or flexing at the location where the stationary clamp member 298 is connected to the mounting block 310. An arcuate portion 318 of the stationary clamp member 298 extends in a semi-circular curve from the base portion 312. The arcuate portion 318 is defined by a cylindrical hole 320 formed through the clamp member 298. An arm portion 322 extends from the arcuate portion 318.

The base portion 312 and the arm portion 322 are separated from one another at a separation which is defined by parting edges 324 and 326 of the base portion 312 and the arm portion 322, respectively. Because of the separation defined by the parting edges 324 and 326, the arm portion 322 is able to pivot slightly inward (clockwise as shown in FIG. 17) to further close the parting edges 324 and 326. The slight inward pivoting movement of the arm portion 322 with respect to the base portion 312 occurs as a result of slightly deflecting the arcuate portion 318. However, the torsional resistance of the arcuate portion 318 tends to resist such slight pivoting movement, and the torsional resistance of the arcuate portion 318 forces the arm portion 322 to return to its original position in which the parting edges 324 and 326 are slightly separated as shown in FIG. 17.

Figure 20:
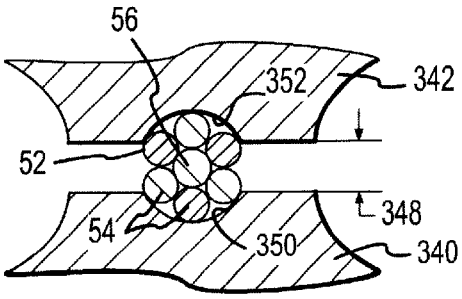
FIG. 20 is an illustration similar to FIG. 18, but illustrating gripping the wire by the jaw members shown in FIG. 18.

A solenoid 330 is connected by a bracket 331 to the base plate 308. A plunger 332 extends from the solenoid 330, and a forward end 334 of the plunger 332 is pivotally connected to an outer end 336 of the arm portion 322. When electrical current this applied to the solenoid 330, the plunger 332 is pulled into the solenoid 330 and applies force on the outer end 336 of the arm portion 322. In response to the force from the solenoid, the arm portion 322 pivots slightly (clockwise as shown in FIG. 17) against the torsional resistance of the arcuate portion 318, and causes the parting edges 324 and 326 to come closer together. The movement of the parting edges 324 and 326 toward one another closes the stationary clamp member 298, to grip the wire 52 (FIG. 20). When electrical current flow to the solenoid 330 is terminated, the torsional resistance of the arcuate portion 318 permits the arm portion 322 to return back to its original position, thereby withdrawing the plunger 332 from within the solenoid 330. When the solenoid 330 does not cause the plunger to pivot the arm portion 322, the gripping surfaces 350 and 352 are separated sufficiently to allow the wire to advance between them (FIG. 21).

Figure 18:
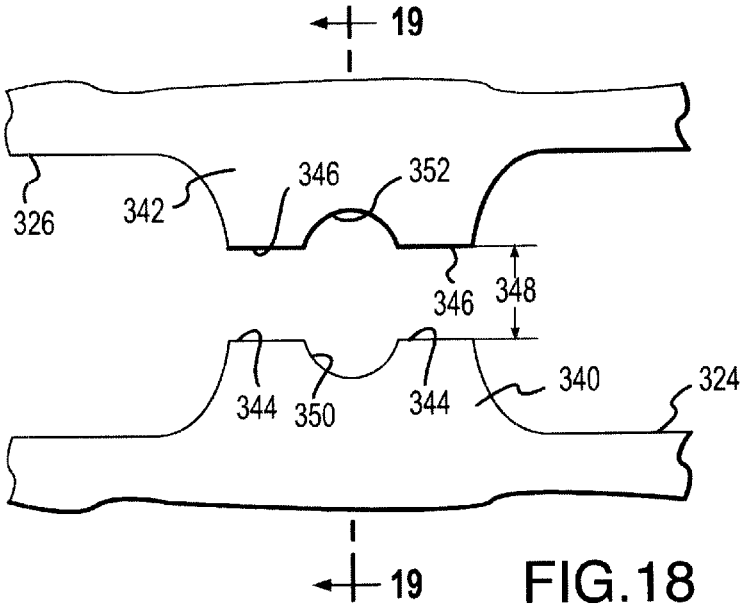
FIG. 18 is an enlargement of that portion of FIG. 17 generally bounded by lines 18—18, illustrating jaw members of a stationary clamp member of the stationary gripping assembly shown in FIG. 17.
Figure 19:
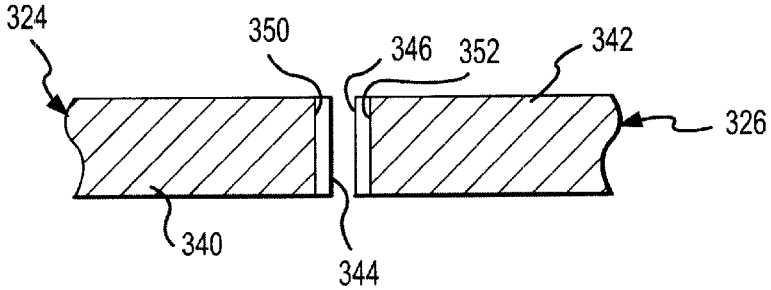
FIG. 19 is a section view taken substantially in the plane of line 19–19 shown in FIG. 18.

Jaw members 340 and 342 are formed on the parting edges 324 and 326, respectively, as shown in FIG. 18. Shoulders 344 and 346 of the jaw members 340 and 342 face each other, but the shoulders 344 and 346 avoid contacting one another by a separation tolerance 348. Semicircular gripping surfaces 350 and 352 are formed in a facing relationship in the shoulders 344 and 346, respectively. The semicircular shape of the gripping surfaces 350 and 352 is established to apply a radial inward force on all of the planetary strands 54, to firmly pinch those planetary strands 54 against the center core strand 56 of the wire 52, as shown in FIG. 20. The force from the solenoid 330 overcomes the torsional resistance characteristics of the arcuate portion 318 of the stationary clamping member 298 to force the jaw members 340 and 342 toward one another (FIG. 20). When the planetary strands 54 are pinched against the core strand 56 as shown in FIG. 20, the separation tolerance 348 is less than before the solenoid 330 was energized (as is understood by comparing the dimension 348 in FIGS. 18 and 20). In some circumstances, the shoulders 344 and 346 may touch one another to reduce the tolerance 348 to zero. As a result of the decreased separation tolerance 348 and the curvature of the gripping surfaces 350 and 352, the amount of gripping force on the wire 52 derived from the solenoid 330 is sufficient to prevent the wire from slipping in rotation around the gripping surfaces 350 and 352 when the bulge 58 is formed from the rotation of the rotating gripping assembly 292.

Figure 21:
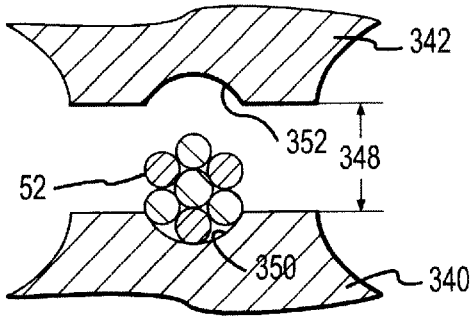
FIG. 21 is an illustration similar to FIG. 20, but illustrating releasing the wire by the jaw members shown in FIG. 18.

When the solenoid 330 is not activated, the jaw members 340 and 342 move away from one another and thereby open the stationary clamp member 298, and the amount of the separation tolerance 348 returns to normal as shown in FIGS. 18 and 21. The normal amount of tolerance 348 as shown in FIG. 21 offers sufficient clearance to allow the wire 52 to advance without excessive dragging. However, because the jaw member 340 is part of the stationary base portion 312 of the stationary clamp member 298, the gripping surface 350 does not move as does the gripping surface 352 on the jaw member 342. The gripping surface 350 is also positioned in direct coaxial alignment with the location where the wire is fed from the wire feed mechanism. Consequently, as the wire 52 is advanced while the stationary clamp member 298 is open (FIG. 21) the wire 52 lightly contacts the jaw member 340 at its gripping surface 350. This contact establishes electrical potential reference 240 (FIG. 11) on the wire which is used by the wire feed mechanism to control the formation of the S-shaped configuration in the manner described above.

The size of the gripping surfaces 350 and 352 must be adjusted to accommodate different sizes of wire 52. The wire size adjustment is accomplished by replacing the stationary clamp member 298 with a similar clamp member 298 having different sized gripping surfaces 350 and 352. The semicircular gripping surface 350 of the stationary clamp member 298 should be aligned very precisely in a coaxial position with respect to the center line of the wire 52 advanced from the wire feed mechanism 104 and the rotational center of the rotating gripping assembly 292. Otherwise, the bulges 58 formed by the rotating gripping assembly 292 will be laterally displaced from the axis of the wire 52, the bulges may be non-symmetrical, and the fabricated twist pin may be slightly bent. Laterally displaced and non-symmetrical bulges and slight bends in the twist pin can cause problems when transporting the fabricated twist pins through the inductor mechanism 108 and into the twist pin receiving mechanism 114 (FIG. 6). The position of the gripping surfaces 350 and 352 relative to the rotational center of the bulge forming mechanism 106 is adjusted by loosening the screws 314 (FIG. 15) and adjusting the position of the stationary clamp member 298 on the mounting block 310 until the gripping surfaces 350 and 352 are precisely located, at which time the screws 314 may be tightened.

The stationary clamp member 298 is preferably formed from a sheet of conventional spring tempered steel. The size and configuration of the jaw members 340 and 342, the shoulders 344 and 346, and the gripping surfaces 350 and 352 are established by conventional electrical discharge machining (EDM).

Figure 15:
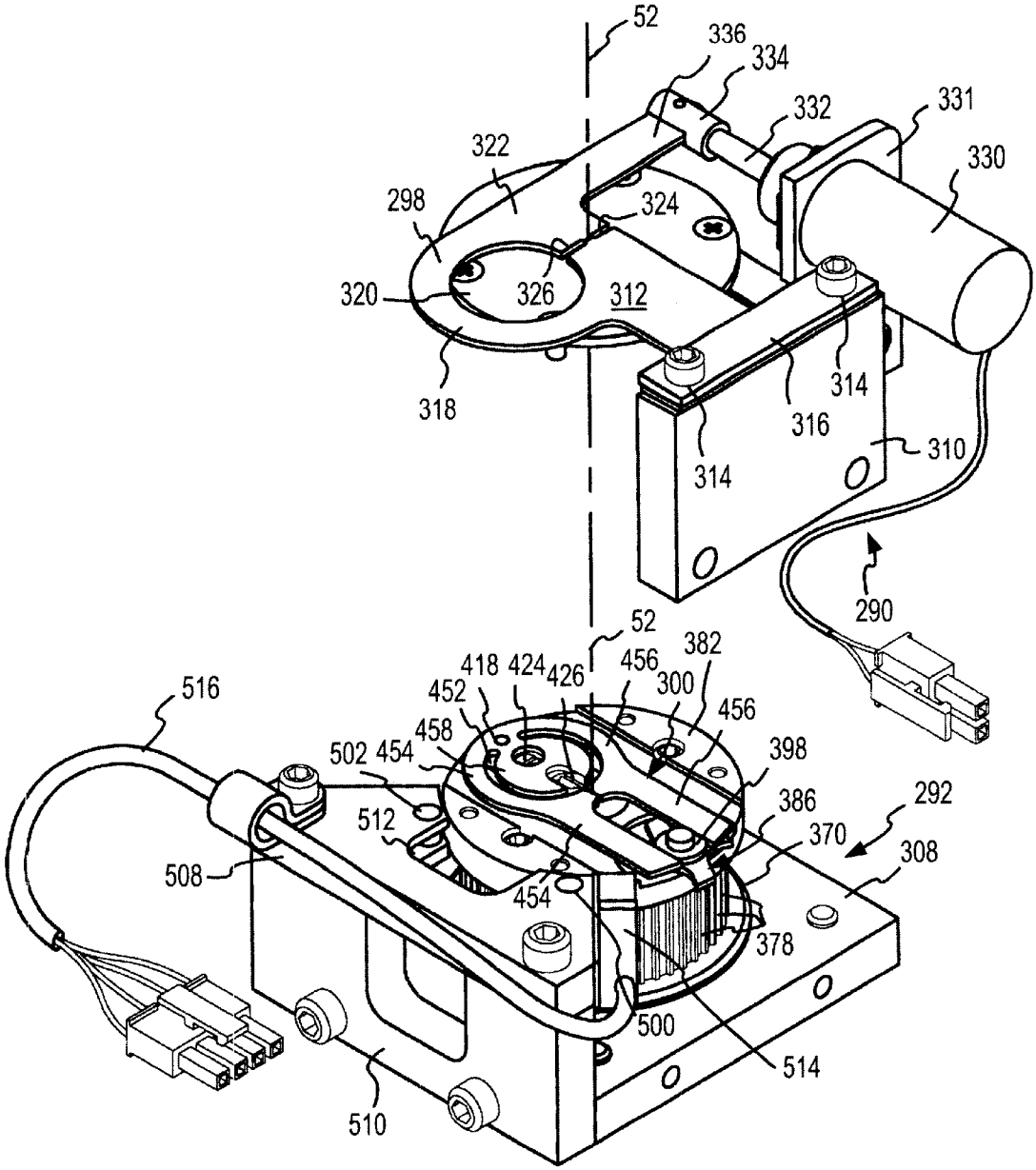
FIG. 15 is an enlarged, exploded perspective view of a stationary gripping assembly and a rotating gripping assembly of the bulge forming mechanism shown in FIG. 14.

As shown in FIGS. 15 and 16, a pulley wheel 370 forms the foundational rotational component of the rotating gripping assembly 292. The pulley wheel 370 is connected by bearings 374 and 376 to a post 372 which extends from the base plate 308. The outer circumference of the pulley wheel 370 is configured with teeth 378 which mesh with corresponding teeth 380 of the timing belt 296. Of course, a similar toothed pulley wheel (not shown) is connected to the drive motor 294 (FIG. 14) and the teeth of that other tooth pulley also mesh with the teeth 380 of the belt 296 to rotate the pulley wheel 370. The drive motor 294 is a conventional stepper motor. The number and frequency of pulses delivered to the stepper drive motor 294 control its rotational position and rotational rate in a conventional manner. The use of the toothed timing belt 296 to rotate the pulley wheel 370 permits precise control over the rotational rate and position of the pulley wheel 370 and the other elements of the rotating gripping assembly 292 carried by the pulley wheel 370.

Figure 22:
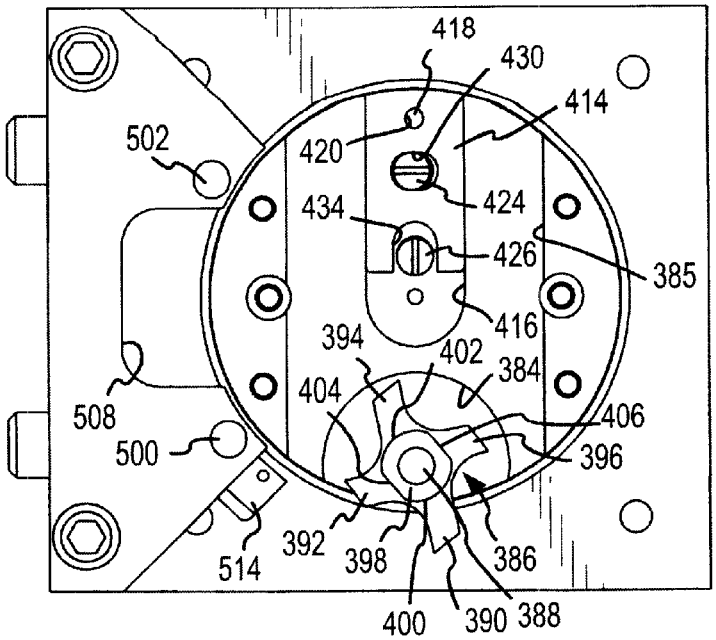
FIG. 22 is a top plan view of the rotating gripping assembly shown in FIG. 15 and other portions of the bulge forming mechanism, with a rotating clamp member of the rotating gripping assembly removed for purposes of illustration.

A carrier disk 382 is attached to the upper surface of the pulley wheel 370 by screws (not shown). An outside peripheral or circumferential edge 383 of the carrier disk 382 extends slightly beyond the periphery of the teeth 378 to form a ridge for confining the belt 296 to the pulley wheel 370. A relatively wide rectangular groove 385 extends completely diametrically across the carrier disk 382, as is also shown in FIG. 22. The rotating clamp member 300 and its associated components are located within the groove 385. A semicircular recess 384 is formed in the groove 385 adjacent to the peripheral edge of the carrier disk 382. A cam wheel 386 is positioned within the recess 384. The cam wheel 386 includes a center shaft 388 from which four outwardly protruding actuating arms 390, 392, 394 and 396 extend. As shown in FIG. 22, the actuating arms 390, 392, 394 and 396 extend at 90 degree rotational intervals from one another around the center shaft 388.

A cam member 398 is attached to the actuating arms 390–396 surrounding the center shaft 388. The cam member 398 has a first curved surface 400 which is generally radially aligned with the first actuating arm 390. On the diametrically opposite side of the cam member 398, a second curved surface 402 is generally radially aligned with the second actuating arm 394. The curved surfaces 400 and 402 each have an arcuate shape that extends at the same radial distance from the axial center of the center shaft 388. First and second flat surfaces 404 and 406, respectively are also formed on the cam member 398. The flat surfaces 404 and 406 extend tangentially with respect to a diametric reference extending through the axial center of the center shaft 388. The first flat surface 404 is generally radially aligned with the second actuating arm 392, and a second flat surface 406 is generally radially aligned with the fourth actuating arm 396.

Figure 23:
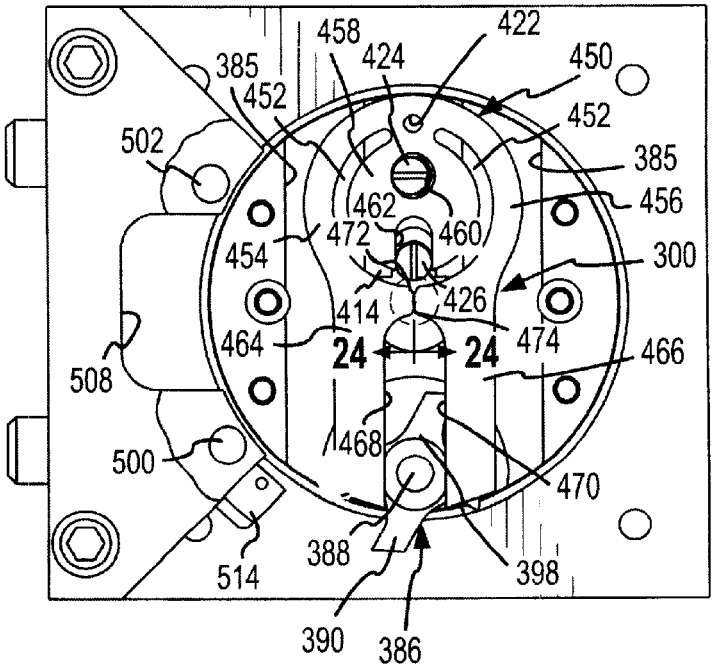
FIG. 23 is a top plan view similar to that shown in FIG. 22, but including the rotating clamp member of the rotating gripping assembly, with portions broken away for purposes of illustration.

The bottom end of the center shaft 388 fits within a cylindrical hole 408 formed in the carrier disk 382, as shown in FIG. 16. With the bottom end of the center shaft 388 in the hole 408, the cam wheel 386 is able to rotate relative to the carrier disk 382. The circumference of the recess 384 is slightly beyond the outer extremities of the actuating arms 390–396 to allow the actuating arms 390–396 to rotate freely within the recess 384 without contacting any portion of the carrier disk 382. However, because the hole 408 and the center shaft 388 are positioned closely adjacent to the outer circumferential edge of the carrier disk 382, the actuating arms 390–396 are able to rotate into a position in which one of the actuating arms 390–396 extends radially outward beyond the outer peripheral edge 383 of the carrier disk 382, as shown in FIGS. 15, 22 and 23.

The upper end of the center shaft 388 extends into a similarly shaped circumferential hole 410 formed in a cover plate 412, as shown in FIG. 16. The cover plate 412 is attached to the carrier disk 382 by screws (not shown). In addition to covering the cam wheel 386 and supporting the upper end of its center shaft 388, the cover 412 also covers the rotating clamp member 300 and elements which connect it to the carrier disk 382. A hole 413 is formed in the center of the cover plate 412. The wire 52 is delivered to the rotating gripping assembly 292 through the hole 413.

The rotating clamp member 300 is connected to the carrier disk 382 by a slide member 414 which fits within a radially extending slot 416 of the rectangular groove 385, as shown in FIGS. 16 and 22. The slot 416 extends radially outward on one side of the carrier disk 382 at a generally diametrically opposite location from the location where the recess 384 extends radially outward on the opposite side of the carrier disk 382. A pin 418 fits within a hole 420 of the slide member 414. The pin 418 also fits within a hole 422 (FIG. 16) of the rotating clamp member 300 to hold the rotating clamp member 300 on the carrier disk 382.

The position of the slide member 414 on the carrier disk 382, and hence the position of the rotating clamp member 300 on the carrier disk 382, is adjusted by eccentric pins 424 and 426. A cylindrical shaft bottom portion of the eccentric pin 424 fits within a cylindrical hole 428 formed in the carrier disk 382 in the slot 416. A top end portion of the pin 424 fits within a hole 430 formed in the slide member 414. The top end portion of the pin 424 is eccentrically-positioned with respect to the cylindrical shaft bottom portion of the pin 424. Consequently, rotating the pin 424 with a screwdriver inserted in at a slot formed in the top end portion of the pin 424 adjusts the radial position of the slide member 414 within the slot 416.

In a similar manner, a lower cylindrical shaft portion of the eccentric pin 426 fits within a cylindrical hole 432 in the carrier disk 382. A top portion of the eccentric pin 426 is an eccentrically-positioned with respect to the lower shaft portion. The upper portion of the eccentric pin 426 passes through a slot 434 formed in an inner end of the slide member 414. Rotation of the eccentric pin 426 with a screwdriver placed in the slot in its upper portion causes the slide member 414 to pivot about the eccentric pin 424, thereby adjusting the circumferential or tangential position of the pin 418 extending from the slide member 414.

The rotating clamp member 300 is formed from a flat piece of resilient spring tempered steel. The clamp member 300 includes a generally circular end portion 450 into which a circular slot 452 has been formed to create two arcuate portions 454 and 456, as shown in FIGS. 16 and 23. The arcuate portions 454 and 456 extend from a position near the hole 422 into which the pin 418 from the slide member 414 extends. The circular slot 452 also defines an inner circular portion 458 into which a hole 460 and a slot 462 are formed. The hole 460 and the slot 462 are positioned above the eccentric pins 424 and 426, respectively. The holes 460 and the slot 462 permit a screwdriver to be inserted into the slots of the eccentric pins 424 and 426, to rotate the pins and adjust the position of the rotating clamp member 300 on the carrier disk 382 as previously described.

Lever arm portions 464 and 466 extend from the arcuate portions 454 and 456, respectively, in a generally parallel, bifurcated manner. Inner edges 468 and 470 of the lever arm portions 464 and 466, respectively, are positioned on opposite sides of the cam member 398 of the cam wheel 386. The lever arm portions 464 and 466 are separated from one another near the center of the rotating clamp member 300 at parting edges 472 and 474. The parting edges 472 and 474 face one another, and the wire 52 extends between the parting edges 472 and 474.

Figure 24:
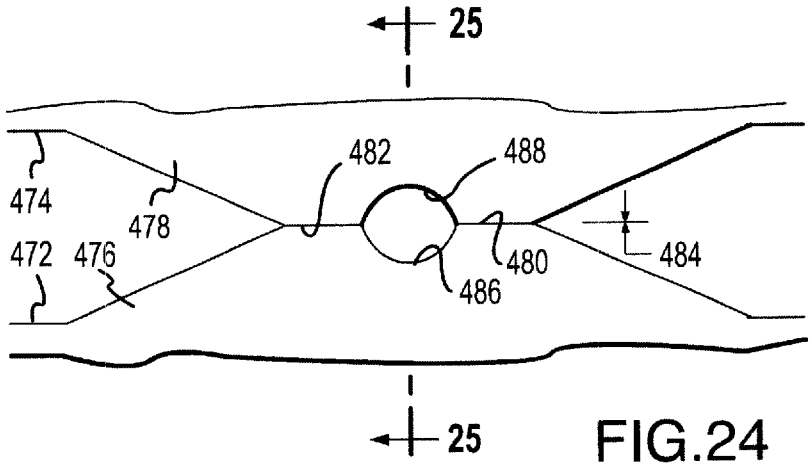
FIG. 24 is an enlargement of a portion of FIG. 23 bounded by lines 24—24, illustrating jaw members of a rotating clamp member of the rotating gripping assembly shown in FIG. 23.
Figure 25:
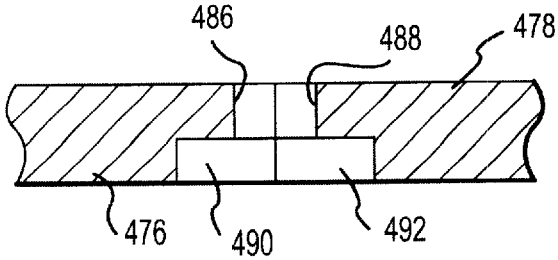
FIG. 25 is a section view taken substantially in the plane of line 25—25 shown in FIG. 24.

Jaw members 476 and 478 are formed on the parting edges 472 and 474 as shown in FIG. 24. Shoulders 480 and 482 of the jaw members 476 and 478 face each other and normally contact each other thereby causing a separation tolerance 484 between the shoulders 480 and 482 to be very slight or non-existent. Crescent shaped gripping surfaces 486 and 488 are formed in a facing relationship in the shoulders 480 and 482, respectively. The jaw members 476 and 478 are undercut in the areas 490 and 492 below the crescent shaped gripping surfaces 486 and 488, respectively, to reduce the vertical area of the gripping surfaces 486 and 488, as shown in FIG. 25. The reduced vertical area of the gripping surfaces 486 and 488 concentrates the force applied by the gripping surfaces 486 and 488 on the wire.

Figure 26:
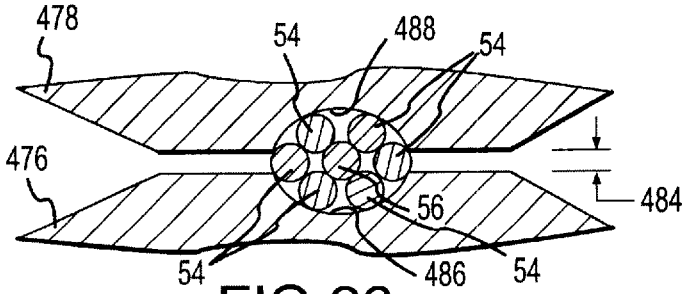
FIG. 26 is an illustration similar to FIG. 25, but illustrating gripping the wire by the jaw members shown in FIG. 24.

The crescent shape of the gripping surfaces 486 and 488 pushes the strands 54 and 56 of the wire 52 into an oval configuration as shown in FIG. 26, when the wire is gripped. The oval configuration of the strands 54 and 56 creates a radial dimension (horizontally, as shown in FIG. 26) to the configuration of the strands 54 and 56 when they are pinched together by the gripping surfaces 486 and 488. The radial dimension of the oval configuration permits the gripping surfaces 486 and 488 to apply more torque to the wire while untwisting the strands 56 to form the bulge 58 (FIG. 1). The oval configuration of the strands 54 and 56 is more effective in resisting rotational slippage when the bulge is created than a circular configuration of the gripping surfaces.

In general, the crescent shaped curvature of the gripping surfaces 486 and 488 should create a football shape surrounding the wire when it is gripped (FIG. 26). The maximum width between the gripping surfaces 486 and 488 when no wire is present between them (FIG. 24) should be approximately one-half of the distance from the more pointed, displaced ends. Of course, the size of the gripping surfaces 486 and 488 must be adjusted to accommodate different sizes of wire 52. The wire size adjustment is accomplished by replacing the rotating clamp member 300 with a similar clamp member 300 having different sized gripping surfaces 486 and 488. The rotating clamp member 300 is preferably formed from a sheet of conventional spring tempered steel. The configuration of the jaw members 476 and 478, the shoulders 480 and 482, and the gripping surfaces 486 and 488 is formed by conventional electrical discharge machining (EDM).

The gripping surfaces 486 and 488 should be aligned in a coaxial position with respect to the center line of the wire 52 in the rotating gripping assembly 292 and from the wire feed mechanism 104. Otherwise, the bulges 58 formed will be laterally displaced from the axis of the wire 52 and may also be non-symmetrical, or a slight bend in the wire will be induced so that the twist pin will be bent out of coaxial alignment. Laterally displaced and non-symmetrical bulges, and twist pins which are slightly bent out of coaxial alignment, may cause delivery problems when transporting the fabricated twist pins through the inductor mechanism 108 and into the twist pin receiving mechanism 114, as well as insertion problems when the twist pin is inserted through the printed circuit boards of the module.

The torsional force characteristics of the arcuate portions 454 and 456 of the rotating clamp member 300 force the jaw members 476 and 478 toward one another. When the strands 54 and 56 of the wire 52 are pinched as shown in FIG. 26, the separation tolerance 484 is greater than would occur under circumstances where no wire is pinched between the gripping surfaces 486 and 488, as is understood by comparing FIGS. 24 and 26. As a result of the increased separation tolerance 484 and the crescent shaped curvature of the gripping surfaces 486 and 488 and their reduced vertical surface area (FIG. 25), the amount of torque applied by the arcuate portions 454 and 456 to the jaw members 476 and 478 is sufficient to grip the wire so that the rotating gripping assembly 292 can untwist the strands in the anti-helical direction to form the bulge 58 (FIG. 1).

The rotating clamp member 300 develops the pinching force from the resiliency of the spring tempered steel from which the clamp member 300 is formed. The resiliency of the material of the arcuate portions 452 and 454 causes force which biases the lever arm portions 464 and 466 toward one another, thereby pinching the strands 54 and 56 of wire between the gripping surfaces 486 and 488. Under such conditions, the flat surfaces 404 and 406 of the cam member 398 are located adjacent to and extend generally parallel to the inner edges 468 and 470 of the lever arm portions 464 and 466, as shown in FIG. 23. A slight tolerance between the flat surfaces 404 and 406 and the adjoining inner edges 468 and 470 is typical when the wire is pinched between the gripping surfaces 486 and 488, as shown in FIG. 26. When there is no wire pinched between the gripping surfaces 486 and 488, the inner edges 468 and 470 will typically contact the flat surfaces 404 and 406.

Figure 27:
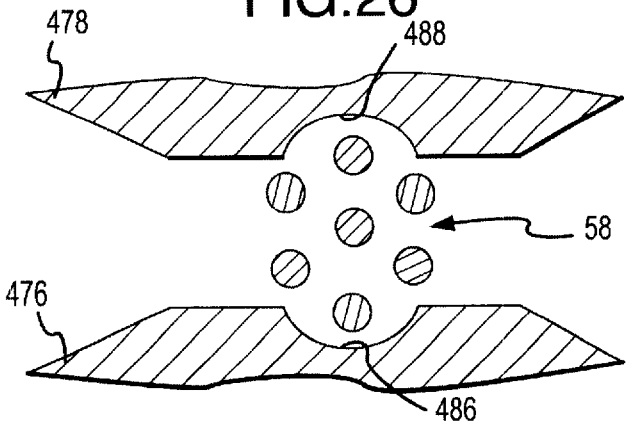
FIG. 27 is an illustration similar to FIG. 26, but illustrating releasing the wire by the jaw members shown in FIG. 24.
Figure 29:
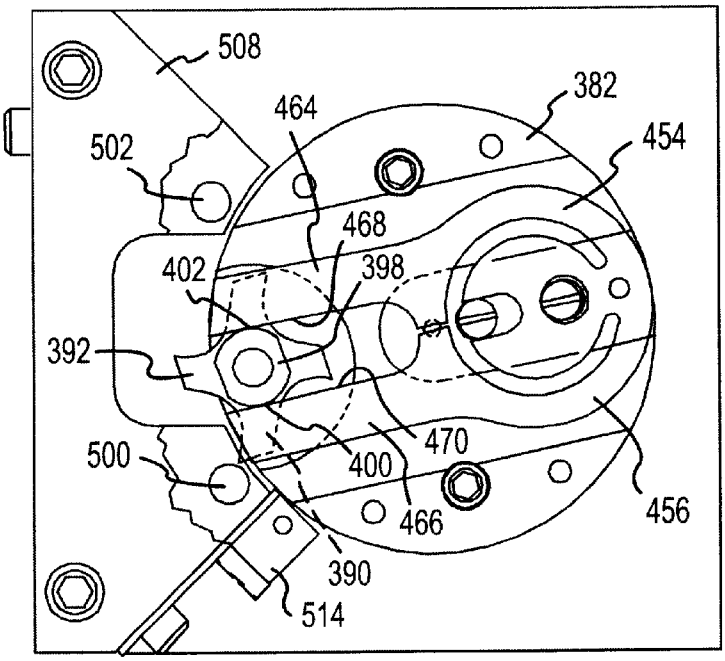

To separate the gripping surfaces 486 and 488, the cam wheel 386 must be rotated to position the curved surfaces 400 and 402 of the cam member 398 into contact with the inner edges 468 and 470 of the lever arm portions 464 and 466. This condition is illustrated in FIG. 29. The curved surfaces 400 and 402 force the lever arm portions 464 and 466 apart to separate the gripping surfaces 486 and 488 and release the wire 52 located between those gripping surfaces. Moreover, the separation of the gripping surfaces 486 and 488 is sufficient to permit a bulge 58 to pass between the separated gripping surfaces 486 and 488 as the wire is advanced after the formation of the bulge, as shown in FIG. 27.

Figure 28:
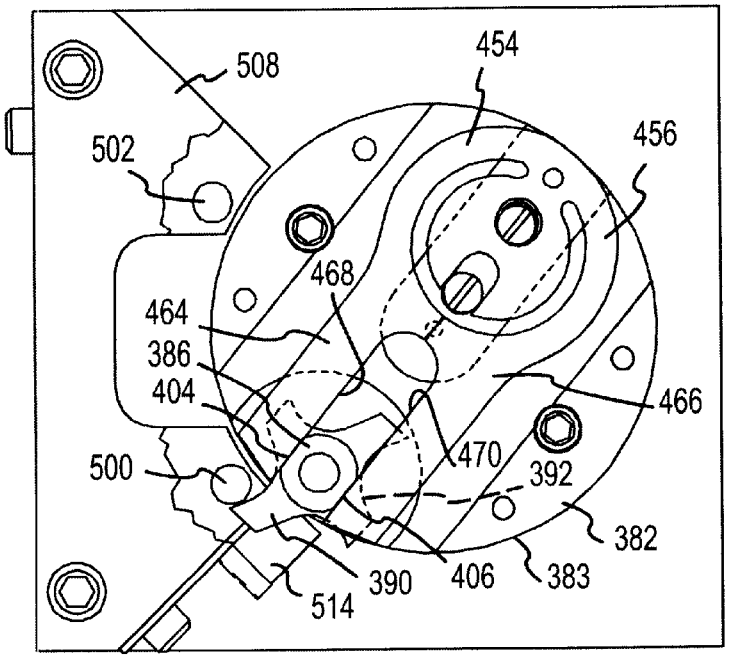
FIGS. 28–30 are illustrations of portions of the rotating gripping assembly shown in FIGS. 15, 16 and 23, illustrating sequential operation while forming a bulge of the twist pin shown in FIG. 1.
Figure 30:
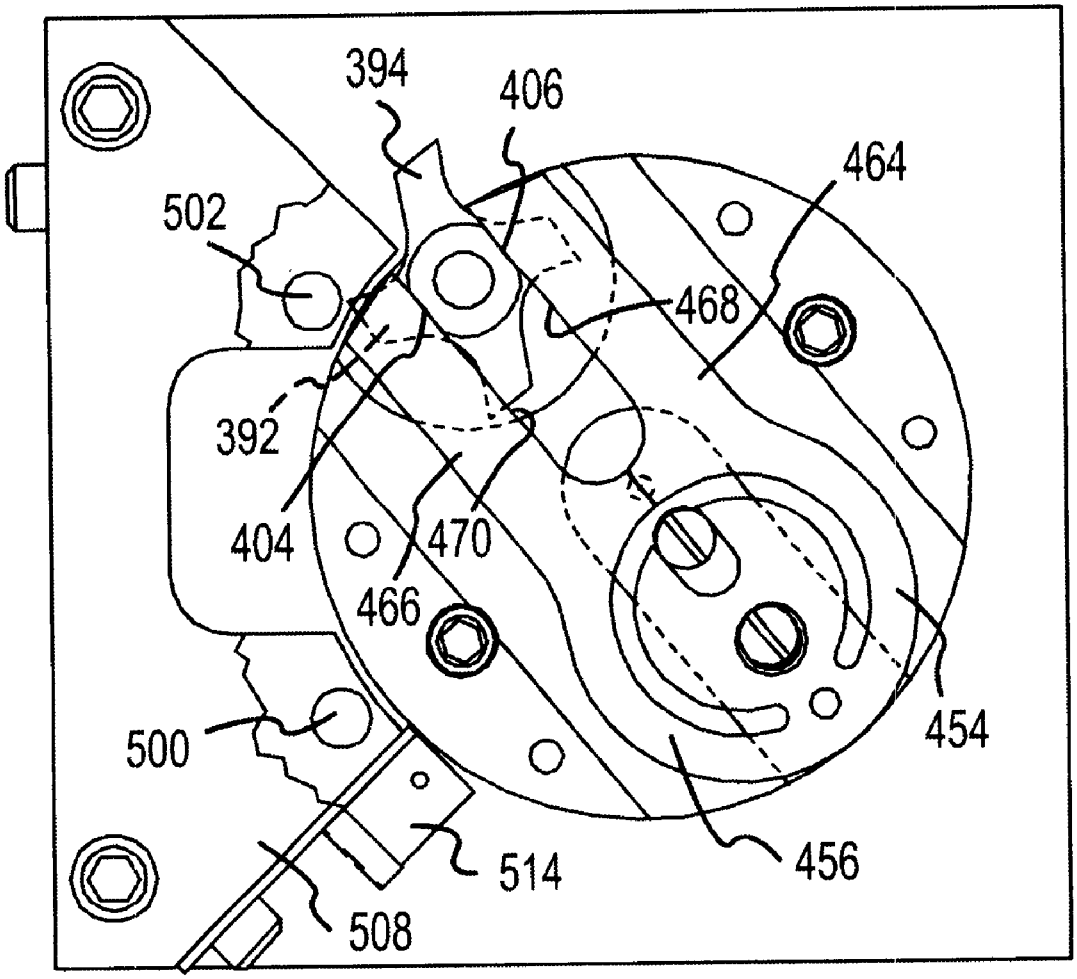

The cam wheel 386 is rotated as a result of the actuating arms 390, 392, 394 and 396 contacting trip pins 500 and 502, as illustrated in FIGS. 28–30. The trip pins 500 and 502 are positioned in holes 504 and 506, respectively, of a yoke member 508, as shown in FIGS. 15, 22, 23 and 28–30. The yoke member 508 is connected to a riser member 510, and the riser member 510 is connected to the base plate 308 (FIG. 15). The trip pins 500 and 502 are positioned radially adjacent to the outer circumferential edge 383 of the carrier disk 382. The rotating carrier disk 382 moves the cam wheel 386 in a circular path to contact the outwardly extending one of actuating arms 390–396 with the trip pins 500 and 502. When a radially outward extending actuating arm 390–396 comes into contact with a trip pin 500 or 502, the continued rotation of the carrier disk 382 causes the cam wheel 386 to rotate about its center shaft 388 by one-fourth of a complete revolution. The radially outward extending actuating arm rotates rearwardly with respect to the direction of rotation of the carrier disk 382 into a position extending somewhat tangentially to the outside peripheral edge 383 of the carrier disk 382, while the next actuating arm rotates into a position extending radially outward so that it will contact the next trip pin encountered. In this manner, each time an actuating arm contacts one of the trip pins 500 and 502, the cam wheel 386 is rotated another one-fourth of a complete revolution.

A slot 512 (FIG. 15) extends through the yoke member 508 to permit the actuating arms 390–396 to rotate and to pass through the yoke member 508 without contacting any part of the yoke member 508 other than the trip pins 500 and 502. The trip pins 500 and 502 are located at a 90 degree relative rotational displacement from one another, as a shown in FIGS. 22, 23 and 28–30. The rotation of the cam wheel 386 is caused by the sequence of the actuating arm 390 contacting the trip pin 500 followed by the actuating arm 392 contacting the trip pin 502 during one revolution of the rotating gripping assembly 292, followed in the next revolution of the rotating gripping assembly by the actuating arm 394 contacting the trip pin 500 followed by the actuating arm 396 contacting the trip pin 502. The rotation of the cam wheel 386 as a result of these actuating arms contacting these trip pins causes the rotating clamp member 300 to grip the wire 52 during three-fourths or 270 degrees of one complete revolution of the rotating gripping assembly 292 (when rotating clockwise as shown in FIGS. 30 and 28 from pin 502 around to pin 500) and to release the wire 52 during one-fourth or 90 degrees of one complete revolution of the rotating gripping assembly 292 (when rotating clockwise as shown in FIG. 29 from pin 500 to pin 502). The bulge 58 (FIG. 1) is formed during the 270 degree rotation of the rotating gripping assembly. The grip on the wire is released by the rotating gripping assembly 292 and the wire is advanced by the wire feed mechanism 104 during the 90 degrees of rotation. This gripping and rotating action of the rotating gripping assembly 292, to form the bulge 58, is illustrated in FIGS. 28–30.

As shown in FIG. 28, the first actuator arm 390 is extending radially outward beyond the circumferential edge 383 of the carrier disk 382. The first flat surface 404 of the cam member 398 is adjacent and parallel to the inner edge 468 of the lever arm portion 464, and the second flat surface 406 is adjacent and parallel to the inner edge 470 of the lever arm portion 466. The first actuating arm 390 is about to contact the trip pin 500, due to the clockwise (as shown) rotation of the carrier disk 382. The function of the trip pin 500 is to rotate the cam wheel 386 to cause the rotating clamp member 300 to open and release the grip on the wire 52. As the disk carrier 382 rotates the cam wheel 386 past the opening trip pin 500, the cam wheel 386 rotates counterclockwise (as shown) to extend the first actuating arm 390 in a rearward direction (relative to the clockwise rotational direction of the carrier disk 382 as shown) and to extend the second actuating arm 392 radially outward, as shown in FIG. 29.

In the rotational condition shown in FIG. 29, the cam member 398 has been rotated to position the second curved surface 402 in contact with the inner edge 468 of the lever arm portion 464, and the first curved surface 400 has been positioned in contact with the inner edge 470 of the lever arm portion 466. The curved surfaces 400 and 402 force the lever arm portions 464 and 466 apart, thereby increasing the distance between the gripping surfaces 486 and 488 to release the wire. The separation of the gripping surfaces 486 and 488 and the release of the wire is shown in FIGS. 27 and 29. Thus, the opening trip pin 500 causes the rotating clamp member 300 to release the grip on the wire when the carrier disk 382 rotates the cam wheel 386 into adjacency with the opening trip pin 500.

After the wire has been released, which is the condition shown in FIGS. 27 and 29, the wire 52 remains released while the carrier member 382 rotates until the second actuating arm 392 comes in contact with the trip pin 502. The continued rotation of the carrier disk 382 with the second actuating arm 392 in contact with the trip pin 502 causes the cam wheel 386 to rotate one-fourth of a revolution in the counterclockwise direction, as shown in FIG. 30. The second actuating arm 392 pivots rearwardly into a tangential position with respect to the outer circumferential edge 383 and the third actuating arm 394 extends radially outward. With the third actuating arm 394 extending radially outward, the second flat surface 406 is adjacent to the inner edge 468 of the lever arm portion 464, and the first flat surface 404 is adjacent to the inner edge 470 of the lever arm portion 464. In this condition, the lever arm portions 464 and 466 are biased toward one another, causing the gripping surfaces 486 and 488 to again grip the wire 52 as shown in FIG. 26. Thus, the trip pin 502 causes the cam wheel 386 to rotate into a position where the rotating clamp member 300 grips the wire, as shown in FIG. 30.

The rotating gripping assembly 292 rotates 270 degrees or three-fourths of a revolution from the position shown in FIG. 30 to the position shown in FIG. 28, and the sequence of events illustrated in FIGS. 28–30 thereafter repeats itself, except that the sequence starts with the third actuating arm 394 contacting the opening trip pin 500 and the fourth actuating arm 396 contacting the closing trip pin 502. Because of the symmetric configuration of the cam wheel 386, there is a relative reversal of the positions of the curved surfaces 400 and 402 and the flat surfaces 404 and 406 relative to the inner edges 368 and 370 of the lever arm portions 464 and 466 during subsequent revolutions of the carrier disk 382. This reversal of relative positional relationships occurs with every subsequent rotation of the carrier disk 382 because the cam wheel 386 makes one revolution for each two complete revolutions of the carrier disk 382. Nevertheless, because of the symmetric relationship of the cam wheel 386, the same operation occurs with each revolution of the rotating gripping assembly 292.

The closed, gripping condition of the clamp member 300 is maintained during the 270 degrees of rotation of the cam wheel 386 from the closing trip pin 502 (position shown in FIG. 30) to the opening trip pin 500 (position shown in FIG. 28). During this 270 degree rotational interval, the bulge is formed as a result of gripping the wire and rotating the gripped wire in the anti-helical direction due to rotation of the rotating gripping assembly 292. The ability to untwist the strands in the anti-helical direction in a single 270 degree rotational interval is a considerable improvement over prior devices which could only untwist the strands for less than 180 rotational degrees. As a result of the present improvements, the bulge forming mechanism 106 is capable of making one bulge with a single rotation of the rotating gripping assembly 292, compared to the requirements of prior devices to grip, twist and release the wire at the location of the bulge two times in order to fully develop the bulge.

During rotation of the cam wheel 386 from the opening trip pin 500 (the position shown in FIG. 28) to the closing trip pin 502 (the position shown in FIG. 30), the wire 52 is released and the gripping surfaces 486 and 488 of the jaw members 476 and 478 of the rotating clamp member 300 are opened (FIG. 27). During the time occupied in rotating the rotating gripping assembly 292 through the open interval of 90 rotational degrees, the stationary and rotating clamp members 298 and 300 must be opened approximately simultaneously. Opening the stationary clamp member 298 is accomplished by de-energizing the solenoid 330 (FIGS. 14, 15, 17) of the stationary gripping assembly 290, as previously described.

To coordinate the application of electrical energy to the solenoid 330 with the mechanical opening of the rotating clamp member 300, an opening sensor 514 (FIGS. 14,15, 22, 23, 28–30) is attached to the yoke member 508 at a position to sense the presence of the actuating arms 390 or 394 making contact with the opening trip pin 500. Preferably the opening sensor 514 is a photoelectric sensor which delivers a trigger signal on a cable 516 (FIGS. 14 and 15) to the controller (not shown) of the machine 100. The machine controller responds to the trigger signal to control the delivery of electrical energy to the solenoid 330 through an electrical cable 518 (FIG. 14) and to activate the precision feed motor 212 to rotate the spindle 200 (FIGS. 9 and 10) to advance the wire from the wire feed mechanism 104.

With both clamp members 298 and 300 in an open condition, the wire feed mechanism 104 advances the wire to the predetermined extent necessary to position the wire for forming the bulges 58, the leader 68, the tail 72, and the intervals 76 between the bulges. The rotational rate and position of the rotating gripping assembly 292 is precisely controlled by the timed delivery of pulses to the stepper drive motor 294 during this interval to provide enough time for the wire to be advanced. Consequently, the rotational speed of the rotating gripping assembly 292 can be controlled very closely during all portions of each revolution of the rotating gripping assembly 292. By slowing the rotational rate of the rotating gripping assembly 292 during the 90 degree rotational interval when the clamp members 298 and 300 are open, a relatively longer amount of wire can be advanced. Enough wire to form the leader 68 (FIG. 1) of the twist pin 50 may be advanced under these conditions, for example.

Closing the stationary clamp member 298 by the solenoid 330 is also controlled from knowledge of the rotational position of the rotating gripping assembly 292 resulting from the sensor 514 supplying the trigger signal. The number of pulses delivered to the stepper drive motor 294 determines the rotational position that the rotating gripping assembly 292. When the number of pulses supplied to the drive motor 294 positions the rotating gripping assembly 292 so that the actuator arms 392 and 396 are about to contact with the closing pin 502, the controller of the machine 100 delivers current to the solenoid 330, thereby closing the stationary clamp member 298.

Numerous improved features are obtained by the bulge forming mechanism 106. A single bulge 58 (FIG. 1) is completely formed in a single revolution of the rotating gripping assembly 292, thereby avoiding having to act twice on the strands to untwist them sufficiently to form a single bulge, as was typical with prior art devices. The rotating clamp member 300, and the cam wheel 386 add a relatively small amount of rotational inertia to the rotating gripping assembly 292, thereby allowing its rotational rate to be increased and the acceleration of the rotating gripping assembly 292 to be better controlled and changed. Significant improvements in precision occur by avoiding the use of the complicated and massive clamping devices of the prior art. Such massive devices complicate and prevent adequate control over the equipment and the wire when undergoing speed and acceleration changes. The crescent shaped gripping surfaces 486 and 488 of the rotating clamp member 300 create an oval configuration of the gripped wire, thereby allowing rotational torque to be applied to the gripped strands without inducing rotational slippage. Rotational slippage during gripping was also a prevalent aspect of prior art devices. The precise control over the rotational rate and the opening and closing of the clamping members 298 and 300 allows the wire to be advanced precisely and under conditions which allow positioning of the bulges, the leader, the tail and the interval between bulges at predetermined positions in the twist pin.

After the twist pin configuration has been formed in the wire, it is necessary to sever the twist pin configuration from the continuous wire in order to complete the fabrication of the twist pin. Under such conditions, the wire is advanced until the end 70 of the leader 68 or the end 74 of the tail 72 (FIG. 1) is in a position below the bulge forming mechanism 106, as may be understood by reference to FIGS. 6 and 7. The wire 52 is advanced by the wire feed mechanism 104 through the bulge forming mechanism 106 until a point on the wire is aligned with the point where a laser beam will be trained onto the wire. The laser beam device 110 is then activated, and the energy from the laser beam severs the wire by melting it into two pieces, thus forming an end 74 of the in tail 72 on one severed piece and the end 70 of the leader 68 on the other severed piece (FIG. 1). Melting at the ends 70 and 74 fuses the strands 54 and 56 together to simultaneously form the ends 70 and 74. The severed twist pin whose fabrication has just been completed is removed by the inductor mechanism 108.

Pneumatic Inductor Mechanism and Method

Details concerning the inductor mechanism 108 are described below and in the above-referenced and concurrently-filed U.S. patent application, Ser. No. 09/780,981. As shown in FIGS. 6, 7, 31 and 32, the inductor mechanism 108 comprises a venturi assembly 540 connected to a delivery tube assembly 542. Gas, typically air, is delivered from a gas source (not shown) to the venturi assembly 540 through an input fitting 544, and is forced downward through the venturi assembly 540. The gas flow characteristics within the venturi assembly 540 create low pressure within the venturi assembly, and this low pressure creates a downward-directed tension on the wire which has been advanced from the bulge forming mechanism 106 into the venturi assembly 540. Of course, the wire in the venturi mechanism 540 includes the bulges 58 and other characteristics of the twist pin 50 (FIG. 1) which have previously been formed by the bulge forming mechanism 106 and the wire feed mechanism 104. The gas flow-induced downward tension is applied to the wire prior to energizing the laser beam device 110 (FIG. 6 and 7) to sever the wire. The slight downward tension holds the wire in tension which facilitates severing the wire at a desired location where the ends of the twist pins are formed and also facilitates the separation of the severed wire at those ends while achieving the desired cut geometry. Once the fabricated twist pin has been severed from the wire, the low pressure within the venturi assembly 540 propels the severed twist pin from the venturi assembly 540 and into the delivery tube assembly 542 where the gas flow conveys the fabricated twist pin.

The twist pin is delivered from the delivery nozzle 596 of the delivery tube assembly 542 into a receptacle 118 of the cassette 116, as is understood from FIGS. 6, 7, 31 and 33–35. After the twist pin has been received in one of the receptacles 118 of the cassette 116, the position of the cassette 116 is changed by movement of the x-y movement table 120 to position an unoccupied receptacle 118 below the delivery nozzle 596 of the delivery tube assembly 542. The unoccupied receptacle receives the next fabricated twist pin. In this manner, as each twist pin is fabricated, it is delivered to and loaded into an unoccupied receptacle 118 of the cassette 116. When all the receptacles of the cassette have been filled with fabricated twist pins, the twist pin fabricating machine 100 ceases fabricating twist pins until the filled cassette is removed from the x-y movement table and replaced with a new cassette having empty receptacles. The twist pins are later heat treated and removed from the receptacles of the cassette and inserted into the three-dimensional modules to create electrical connections between the printed circuit boards of those modules (FIG. 4).

Figure 32:
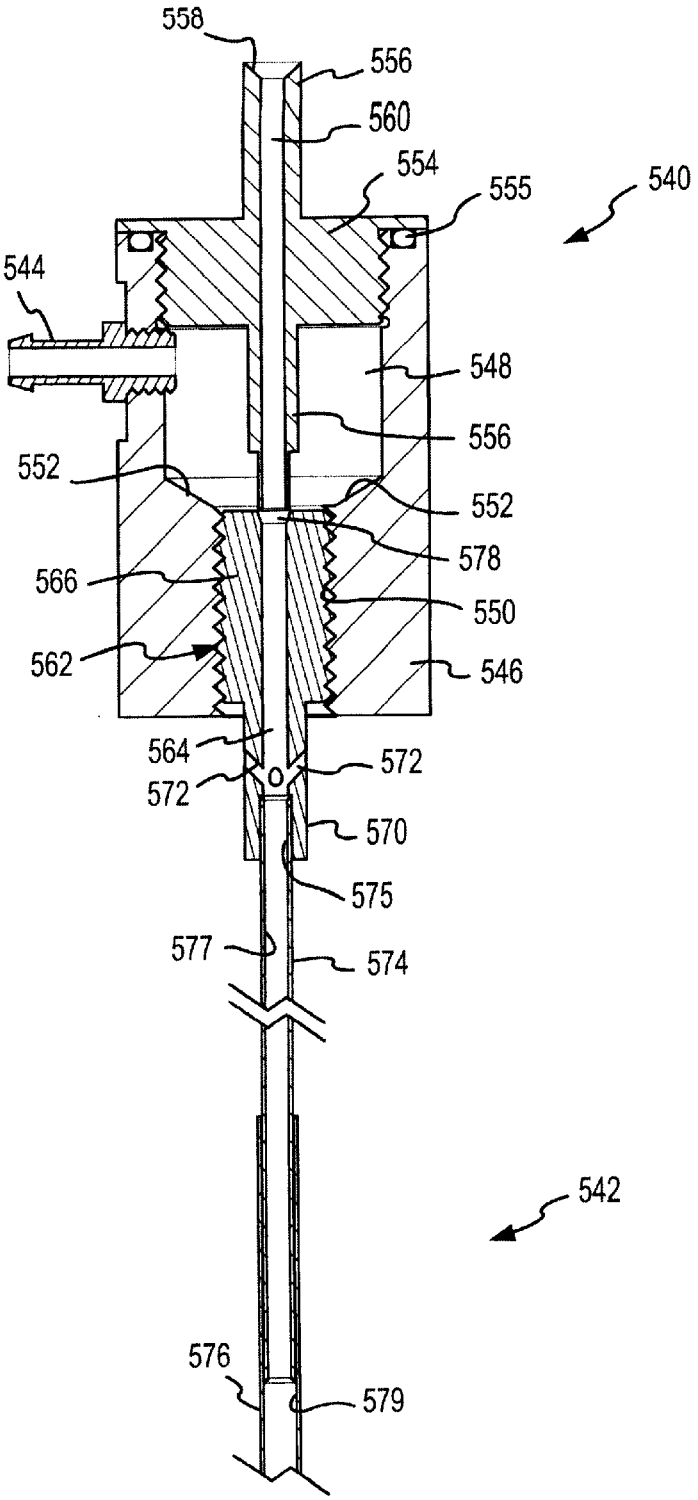
FIG. 32 is an enlarged, axial cross-sectional view of a venturi assembly and a portion of a delivery tube assembly of the inductor mechanism shown in FIG. 31.

The venturi assembly 540 is shown in FIG. 32 as comprising a main body element 546 which is attached below a cutting chamber 520 (FIG. 7) into which the laser beam of the laser beam device 110 is focused and through which the wire passes. The body element 546 has an open interior defined by an upper chamber 548 and a lower passageway 550. A venturi-shaped orifice 552 tapers from the upper chamber 548 to the lower passageway 550, thus reducing the cross-sectional area of the interior of the body element 546 between the upper chamber 548 and the lower passageway 550. The input fitting 544 delivers the pressurized gas into the upper chamber 548.

A cap 554 is attached by threaded engagement to the upper end of the body element 546 to close the upper end of the chamber 548. A resilient O-ring 555 is located between the cap 554 and the body element 546 to seal the cap 554 to the upper end of the chamber 548 in a fluid tight manner. A nozzle tube 556 extends axially through the cap 554 and into the upper chamber 548. The nozzle tube 556 is positioned coaxially relative to the upper chamber 548 and the lower passageway 550. The nozzle tube 556 is sealed to the cap 554 in an airtight or integral manner. An upper end 558 of the nozzle tube 556 converges downwardly and inwardly into a center bore 560 through the nozzle tube 556. The center bore 560 extends downwardly through the upper chamber 548 and terminates at a location approximately where the venturi orifice 552 joins the lower passageway 550.

A delivery tube connector piece 562 is attached by threaded engagement into the passageway 550. The connector piece 562 also includes a center bore 564 which is located in coaxial alignment with the center bore 560 of the nozzle tube 556. A lower portion 570 of the connector piece 562 continues the center bore 564 downward. Holes 572 extend transversely through the lower portion 570 from the center bore 564 to the exterior of the connector piece 562. An upper tube 574 of the delivery tube assembly 542 connects into a counterbore 575 at the bottom of the center bore 564 of the connector piece 562, to smoothly continue the center bore 564 into an interior passageway 577 of the upper tube 574.

The application of gas pressure through the input fitting 544 into the upper chamber 548 causes the gas to flow downward through the venturi orifice 552 into a flared opening 578 at the upper end of the center bore 564. Because the venturi orifice 552 and the flared opening 578 reduce the cross-sectional size of the gas flow path out of the chamber 548 and into the center bore 564, the gas speed increases substantially as it passes into the flared opening 578. The increased speed of the gas reduces the pressure at the bottom end of the nozzle tube 556, relative to ambient pressure. The center bore 560 through the nozzle tube 556 communicates this reduced pressure to the upper end 560 of the nozzle 556. The reduced pressure communicated through the nozzle tube 556 surrounds the twist pin which extends into the center bore 580 of the nozzle tube 556. The reduced pressure surrounding the twist pin causes the downward force on the twist pin and tension on the wire to which the twist pin configuration is connected, as the twist pin is severed from the wire. Once the twist pin is severed from the wire, the reduced pressure accelerates the fabricated twist pin through the center bore 560 of the nozzle tube 556 and into the center bore 564 of the connector piece 562. The momentum induced by the reduced pressure coupled with the gas flow through the center bore 564 carries the fabricated twist pin through the center bore 564 and into an interior passageway 577 of the upper delivery tube 574 of the delivery tube assembly 542.

The holes 572 in the lower portion 570 of the connector piece 562 vent some of the gas flowing in the center bore 564 to the ambient atmosphere to moderate some of the flow rate of the gas moving through the center bore 564 and the upper delivery tube 574. The remaining gas flow moving from the center bore 564 into the interior passageway 577 of the upper delivery tube 574 is the primary force which carries the fabricated twist pin through the delivery tube assembly 542 and into a receptacle 118 of the cassette 116 (FIG. 7), although this downward movement is assisted by gravity.

Figure 31:
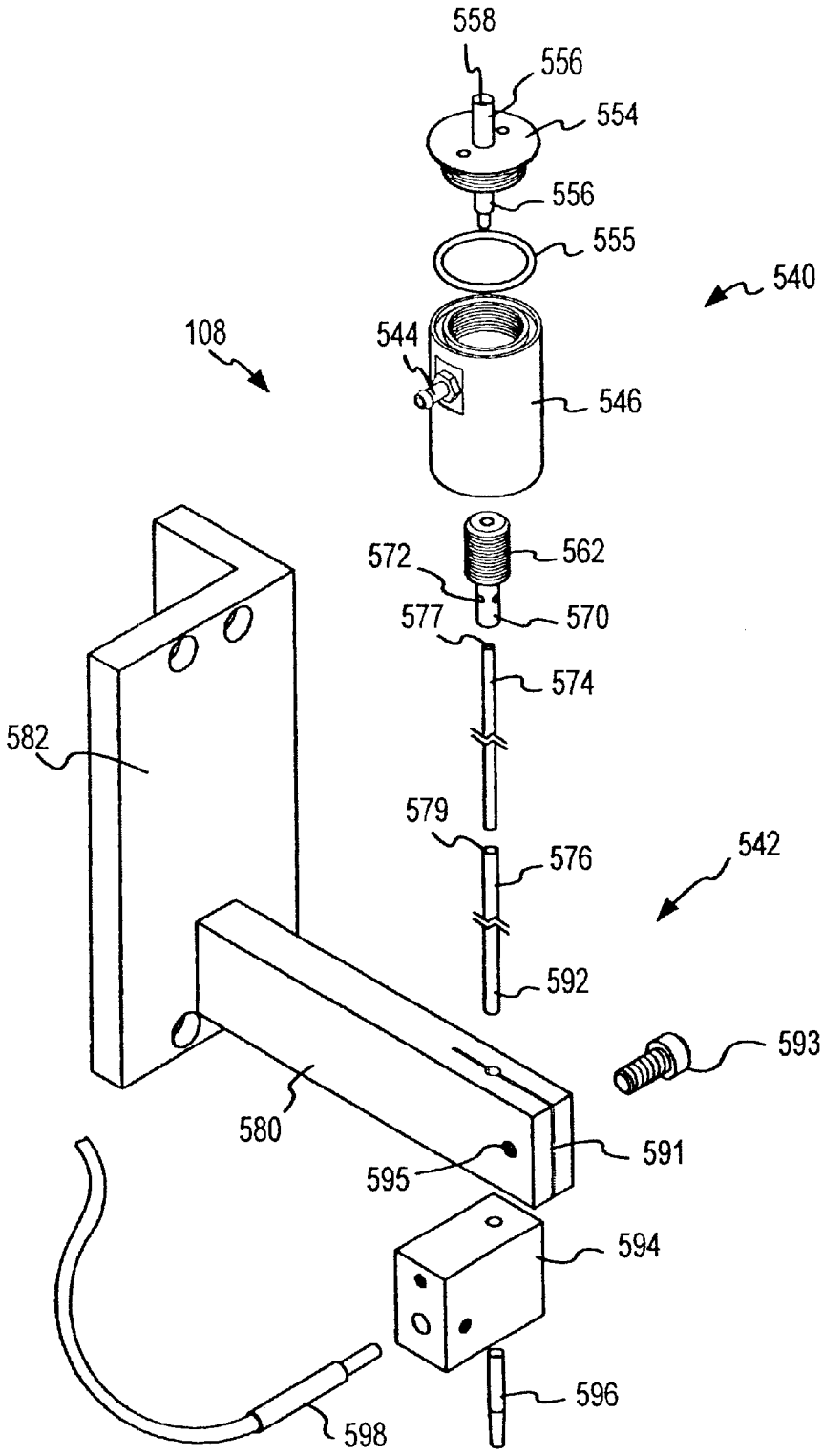
FIG. 31 is an exploded, perspective view of the inductor mechanism shown in FIGS. 6 and 7, with portions broken out for clarity of illustration.

The delivery tube assembly 542 includes the upper delivery tube 574 and a lower delivery tube 576, as shown in FIGS. 7, 31 and 32. The upper delivery tube 574 telescopes into an inside bore 579 of the lower delivery tube 576. The lower delivery tube 576 is connected to a support arm 580. The support arm 580 extends from a carrier plate to 582, as shown in FIGS. 6 and 7. The carrier plate 582 is movably attached to the support plate 124 to move in a generally vertical manner relative to a carrier base 584. The carrier base is stationarily connected to the support plate 124. A toothed rack member 586 (FIG. 7) is attached to the carrier plate 582, and a pinion gear 588 meshes with the teeth of the rack member 586. The pinion gear 588 is rotationally attached to the support plate 124 by a bracket (not shown). A lever 590 is connected to the pinion gear 588, and the pinion gear 588 rotates when the lever 590 is pivoted. Pivoting the lever 590 rotates the pinion gear 588 which moves the meshed rack member 586 and the attached carrier plate 582 upward and downward relative to the carrier base 584 which is stationarily connected to the support plate 124.

The lower delivery tube 576 is adjustably connected to the support arm 580 at a pinch connection formed by a slot 591 which extends into an outer end of the support arm 580 and thereby bifurcates the outer end of the support arm 580. A screw 593 extends through one of the end portions of the support arm 580 and is threaded into a threaded hole 595 in the other end portion. Tightening the screw 593 pinches the end portions of the support arm 580 around the lower delivery tube 576 to hold the lower delivery tube 576 in a fixed position relative to the support arm 580. Consequently, the lower delivery tube 576 moves vertically in conjunction with the vertical movement of the carrier plate 582. The lower delivery tube 576 is free to move relative to the upper delivery tube 574 because of the telescoped receiving relationship of the upper delivery tube 574 within the lower delivery tube 576. Pivoting the lever 590 therefore raises and lowers a lower end 592 of the lower delivery tube 576.

A sensor block 594 is connected to the lower end of the support arm 580. The sensor block 594 continues the center bore 579 (FIG. 32) from the lower delivery tube 576 to a delivery nozzle 596. The delivery nozzle 596 is connected to the sensor block 594 and extends below it. Twist pins moving downward through the lower delivery tube 576 continue through the sensor block 594 and exit from the delivery nozzle 596. A photoelectric sensor 598 is positioned within the sensor block 594 at a location to sense the passage of a twist pin through the bore of the sensor block 594 and out of the delivery nozzle 596. The delivery nozzle 596 is preferably made from a transparent or translucent acrylic or glass material so that a light beam extending through the bore of the sensor block is able to detect the passage of a twist pin.

If a signal from the sensor 598 is not received by the machine controller (not shown) one of two conditions is indicated. One condition is that the fabricated twist pin has become jammed in the delivery tubes 574 or 576. The other condition is that the laser beam device 110 (FIG. 7) has failed to sever the wire and disconnect the fabricated twist pin. Either condition will result in the termination of operation of the machine 100 (FIG. 6).

Because the sensor block 594 is connected to the lower end of the lower delivery tube 576 and the delivery nozzle 596 is connected to the sensor block 594, the position of the delivery nozzle may be adjusted relative to the height of the cassette 116 (FIG. 7) by adjusting the position of the lower delivery tube 576 in the pinch connection at the end of the support arm 580. Adjusting the position of the lower delivery tube 576 in the pinch connection positions the delivery nozzle 596 to accommodate cassettes 116 of different thicknesses. As discussed below, cassettes of different thicknesses accommodate different lengths of twist pins. The vertical adjustment of the delivery nozzle 596 controls the space between the delivery nozzle 596 and an upper surface of the cassette 116 (FIG. 7) to assure a smooth transition of the fabricated twist pin out of the delivery nozzle 596 and into a receptacle 118 of the cassette 116 (FIG. 7).

It is desirable to move the delivery nozzle 596 upward away from the cassette 116 when one filled cassette is replaced with another empty cassette, so that the movement of the cassettes does not inadvertently contact and damage the delivery nozzle 596. Pivoting the lever 590 as described above vertically withdraws the delivery nozzle 596 from the upper surface of the cassette 116 (FIG. 7). Pivoting the lever 590 causes the carrier plate 582 to move vertically, and the connected support arm 580 lifts the lower delivery tube 576 to which the delivery nozzle 596 is connected.

By positioning the upper delivery tube 574 into the center bore 579 of the lower delivery tube 576, a slight expansion of the channel through the tubes 574 and 576 occurs at the point where the two tubes 574 and 576 telescopically connect to one another. Because of the expansion, there is no edge or obstruction which would tend to interfere with the passage of the fabricated twist pins through the delivery tube assembly 542. Moreover, by placing the delivery nozzle 596 immediately above a receptacle in a cassette, and by precisely positioning the cassette, there is little opportunity that an edge of the receptacle 118 will interfere with the passage of the twist pin into the receptacle.

In essence, the delivery tube assembly 542 provides a straight path for conducting the twist pins into the receptacles. Because of the ability of the bulge forming mechanism 106 to fabricate the twist pins with symmetrical bulges and without deflecting the twist pin from a coaxial relationship along its length, the fabricated twist pins are less likely to jam or hang up as they are conducted by the delivery tube assembly 542 into the receptacles 118 of the cassette. The venturi assembly 540 and the delivery tube assembly 542 smoothly convey the fabricated twist pins without obstruction or resistance from the delivery and guiding elements of the delivery tube assembly 542. The fabricated twist pins are moved rapidly into the receptacles of the cassette without manual contact as a result of the acceleration and the airflow resulting from the low-pressure gas flow and pneumatic effects created by the venturi assembly 540.

Twist Pin Receiving Mechanism and Method

Details concerning the twist pin receiving mechanism 114 are described below and also in the above-referenced and concurrently-filed U.S. patent application, Ser. No. 09/780,981. The twist pin receiving mechanism 114 includes the cassette 116 which is shown in greater detail in FIGS. 33–36. The cassette 116 includes a pallet plate 610 from which a handle 612 extends. By grasping the handle 612, the entire cassette 116 is manipulated. For example, the cassette 116 is placed on the machine 100 (FIG. 6) for use or removed from the machine. The cassette 116 may be used to transport the fabricated twist pins or to store the twist pins until they are to be used Moreover, the cassette 116 can be used to confine the twist pins during heat treatment.

The cassette 116 further comprises at least one receptacle plate 614 connected to and supported from the pallet plate 610. Four receptacle plates 614 are shown in FIGS. 33–36 as forming the cassette 116. All of the receptacle plates 614 are basically identical in structure and configuration, except for minor details of difference in the uppermost receptacle plate 614*a* as are discussed below. Each lower receptacle plate 614 includes three registration holes 616 into which a registration pin 618 is inserted. A lower end of the registration pin 618 is press fit into the upper open end of the registration hole 616. An upper end of the registration pin 618 extends above an upper surface 620 of each lower receptacle plate 614. A lower portion of each registration hole 616 below the registration pin 618 is open, to receive the upper end of a registration pin 618 from an immediately below-positioned receptacle plate 614. The upper end of the below-positioned registration pins 618 slip fits into the lower ends of the registration hole 616. As shown in FIGS. 34 and 35, two registration holes 616 and registration pins 618 are located at one side of each of the lower receptacle plates 614, while a single registration hole 616 and registration pin 618 is located at the opposite side of the lower receptacle plates 614.

The pallet plate 610 also has three upwardly projecting registration pins 622 which are located on a peripheral portion 624 of the pallet plate 610 to slip fit into the lower open ends of the registration holes 616 of the lower receptacle plate 614 which rests on an upper surface 627 of the peripheral portion 624 of the pallet plate 610, as shown in FIG. 35. When the desired number of receptacle plates 614*a* and 614 are stacked on top of one another in registered alignment, each single receptacle 118 is formed by a vertically aligned series of receptacle holes 626 (FIG. 35) formed in the receptacle plates 614*a* and 614. The receptacle holes 626 are formed at the same locations within the receptacle plates. With the receptacle plates stacked in registered alignment as shown in FIG. 35, each receptacle hole 626 aligns with and continues the receptacle hole 626 of a preceding and following receptacle plate. In this manner, the individual receptacle holes 626 create a continuous receptacle 118 within which to receive the fabricated twist pin.

An upper the edge 628 (FIG. 35) of each receptacle hole 626 is slightly tapered upwardly and outwardly. The outward taper of the edge 628 forms a funnel-like surface to guide the end 70 or 74 of the fabricated twist pin 50 (FIG. 1) into the receptacle hole 626 at each interface between adjoining, stacked receptacle plates and at the upper surface 620 of the upper receptacle plate 614*a*. In most cases, the ends of the fabricated twist pin will not contact the tapered edges 628 of those receptacle plates 614 below the upper receptacle plate 614*a*. The alignment of the lower receptacle plates 614 by the registration pins 618 and registration holes 616 is sufficient to create generally continuous receptacles 118, and once the fabricated twist pin starts its movement through the first receptacle hole 626 of the upper receptacle plate 614*a*, it will continue through the aligned receptacle holes 626 in the lower receptacle plates without interruption.

In addition to forming all of the registration holes 626 in the same location within a generally rectangular shaped receptacle area 630 of the receptacle plates, each receptacle hole 626 is formed at a predetermined location within the area 630. The position of the axis of each of the receptacle holes 618 within an area 630 is precisely defined. The information defining the position of each individual receptacle hole 626, and hence the receptacle 118 itself, is used by the machine controller (not shown) to increment the position of the x-y movement table 120 to locate an unoccupied receptacle 118 below the delivery nozzle 596 (FIGS. 6 and 7) after the preceding receptacle is filled with a twist pin.

Although the alignment of the delivery nozzle 596 (FIG. 31) above each receptacle 118 is very precisely controlled by the movement of the x-y movement table 120, there is some opportunity for slight misalignment of the delivery nozzle 596 with the receptacle holes 626 formed in the upper receptacle plate 614*a*. It is under these conditions that the tapered upper edges 628 of the upper receptacle plate 614*a* is the most likely to be contacted by the end of the fabricated twist pin. The upper edge 628 of the upper receptacle plate 614*a* is therefore primarily useful in assisting the entry of the fabricated twist pins into the receptacle holes 626 of the upper receptacle plate 614*a* as the twist pins are delivered from the delivery nozzle 596 (FIG. 31).

Because of the relatively large receptacle area 630 and close spacing between the receptacle holes 626, a relatively large number of receptacles 118 may be formed in a single cassette 116. For example, approximately 10,000 receptacles 118 may be formed in a receptacle area 630 of approximately 4 inches by 8 inches, when each of the receptacles is 0.028 inches in diameter. Each of the receptacle plates 614 is preferably formed of an aluminum alloy material having a vertical thickness of approximately 0.25 in. A fabricated twist pin having a length of approximately 0.5 in. will generally be about the shortest length twist pin used. More typically, the length of the fabricated twist pin will be approximately 1.0, 1.5 or 2.0 inches in length. Thus, making each of the receptacle plates 614 with a thickness of 0.25 inches allows two to eight of the receptacle plates to be stacked to accommodate fabricated twist pins of the anticipated most-common lengths. Of course, the twist pin fabricating machine 100 (FIG. 6) and the number of receptacle plates 614 which may be stacked to create receptacles 118 may be adjusted to accommodate differences in lengths of the fabricated twist pins.

It has also been determined that each of the receptacle holes 626 are best formed by drilling. Other types of hole formation techniques, such as laser formation, are generally incapable of penetrating a sufficient depth and the sidewalls left during the formation of a hole are usually not as smooth and continuous as those sidewalls formed by drilling. Limiting the vertical thickness of each receptacle plate 614 to approximately 0.250 in. also facilitates drilling the receptacle holes 626. A shorter drill length offers a lesser risk of the drill deviating from a desired axial position, and also permits the receptacle holes 626 to be more quickly formed. Forming the large number of receptacle holes 626 economically is an important consideration in reducing the costs of the receptacle plates 614.

The pallet plate 610 is also preferably formed from an aluminum alloy material, and is shown in greater detail in FIGS. 34 and 35. A center portion 632 of the pallet plate 610 is recessed below the upper surface of the peripheral portion 624, as shown in FIG. 35. The center portion 632 is located below the receptacle area 630 of the receptacle plate 614 which rests on the upper surface 627 of the peripheral portion 624. A space 634 exists between the upper surface of the center portion 632 and a lower surface of the upward adjacent receptacle plate 614.

The space 634 permits the air flow which carries the fabricated twist pin into each receptacle 118 to vent from the bottom end of the receptacle as the twist pin enters the receptacle. Because of this venting capability, the flow of air is effective in continuing to carry the twist pin until it is completely received in each receptacle. Otherwise, without the venting capability provided by the space 634, the airflow would not continue to carry the fabricated twist pin beyond some point upstream of the receptacle where the airflow had to be vented. The venting provided by the space 634 also allows the delivery nozzle 596 (FIG. 31) to be vertically positioned closely adjacent to the upper surface of the uppermost receptacle plate 614 (usually about 0.050 inches), since a space to vent the air at that location is not required. The space 634 is therefore effective to ensure that the airflow continues to carry the twist pin until it is fully received in a receptacle 118 of the cassette 116. The space 634 also permits in recessing the upper ends of the fabricated twist pins in the receptacle 118 slightly below the upper surface 620 of the upper receptacle plate 614*a*, if the vertical height of the stack of receptacle plates is equal to the length of the fabricated twist pin. Consequently, any slight variation in length of the fabricated twist pins does not result in an end 70 or 74 (FIG. 1) protruding above the upper surface 620 of the upper receptacle plate 614*a*. This permits a cover 636 to be attached to the upper receptacle plate 614*a*, as is understood from FIGS. 33–35.

The cover 636 is attached to the upper receptacle plate 614*a* by thumb screws 638. Holes 640 are formed in the cover 636 through which a threaded shaft 642 of each thumb screw 638 extends. The threaded holes 641 are formed in the upper surface 620 of the upper receptacle plate 614*a*, preferably in a position in alignment with the registration holes 616. The threaded shaft 642 of each thumb screw 638 is threaded into the threaded hole 641 to hold the cover 636 in place on top of the upper surface 620 of the upper receptacle plate 614*a*. Placing the cover 630 on top of the assembled stack of receptacle plates 614 prevents dust and other foreign material from entering into the receptacles 118 and contacting the fabricated twist pins while the twist pins are stored prior to use. When it is desired to unload the twist pins from the cassette 116, the cover 630 is removed by removing the thumb screws 638. The cover 630 is also removed during heat treatment of the twist pins contained in the cassette 116.

Figure 33:
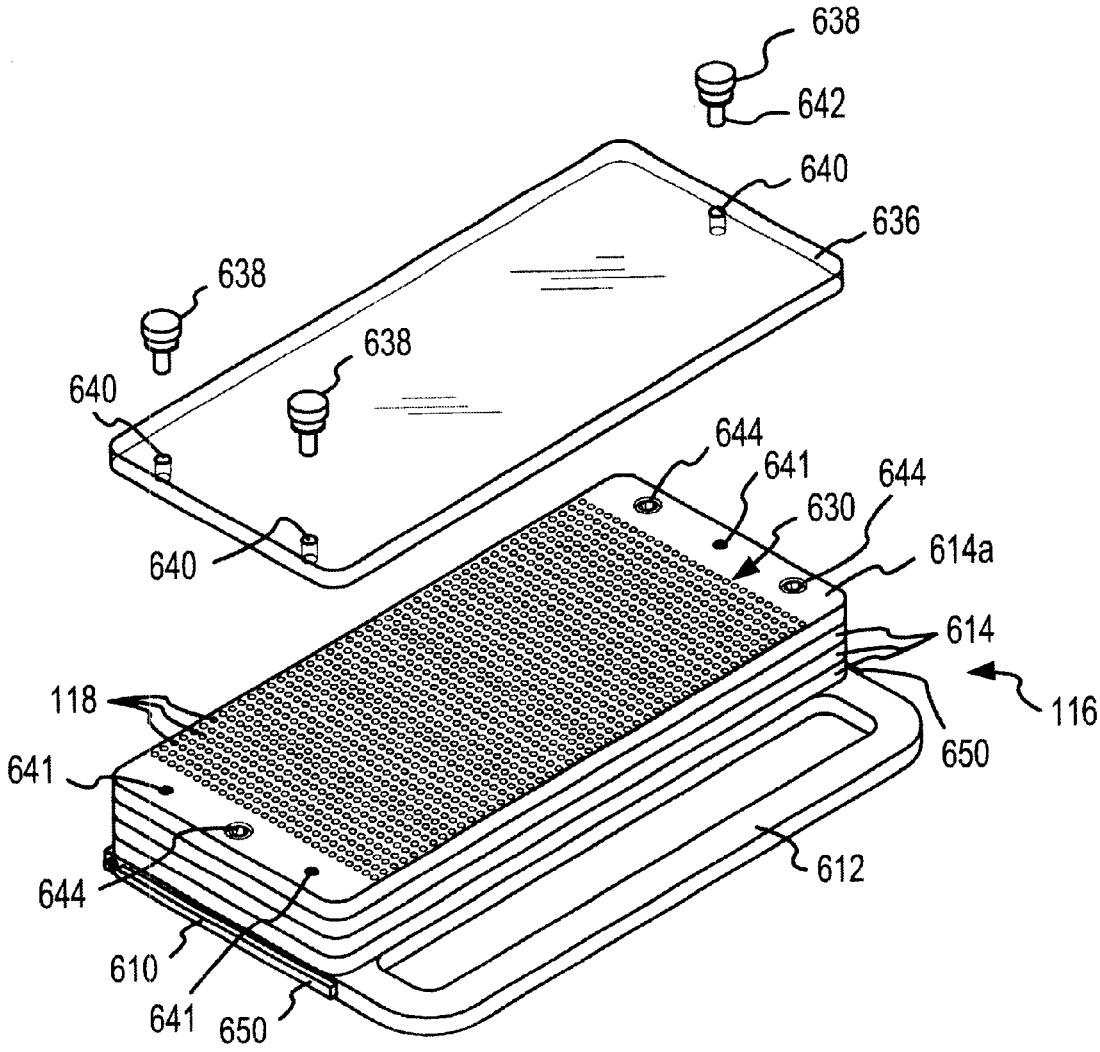
FIG. 33 is an enlarged perspective view of a cassette shown in FIGS. 6 and 7, also including a cover plate shown in exploded relation to the cassette.
Figure 34:
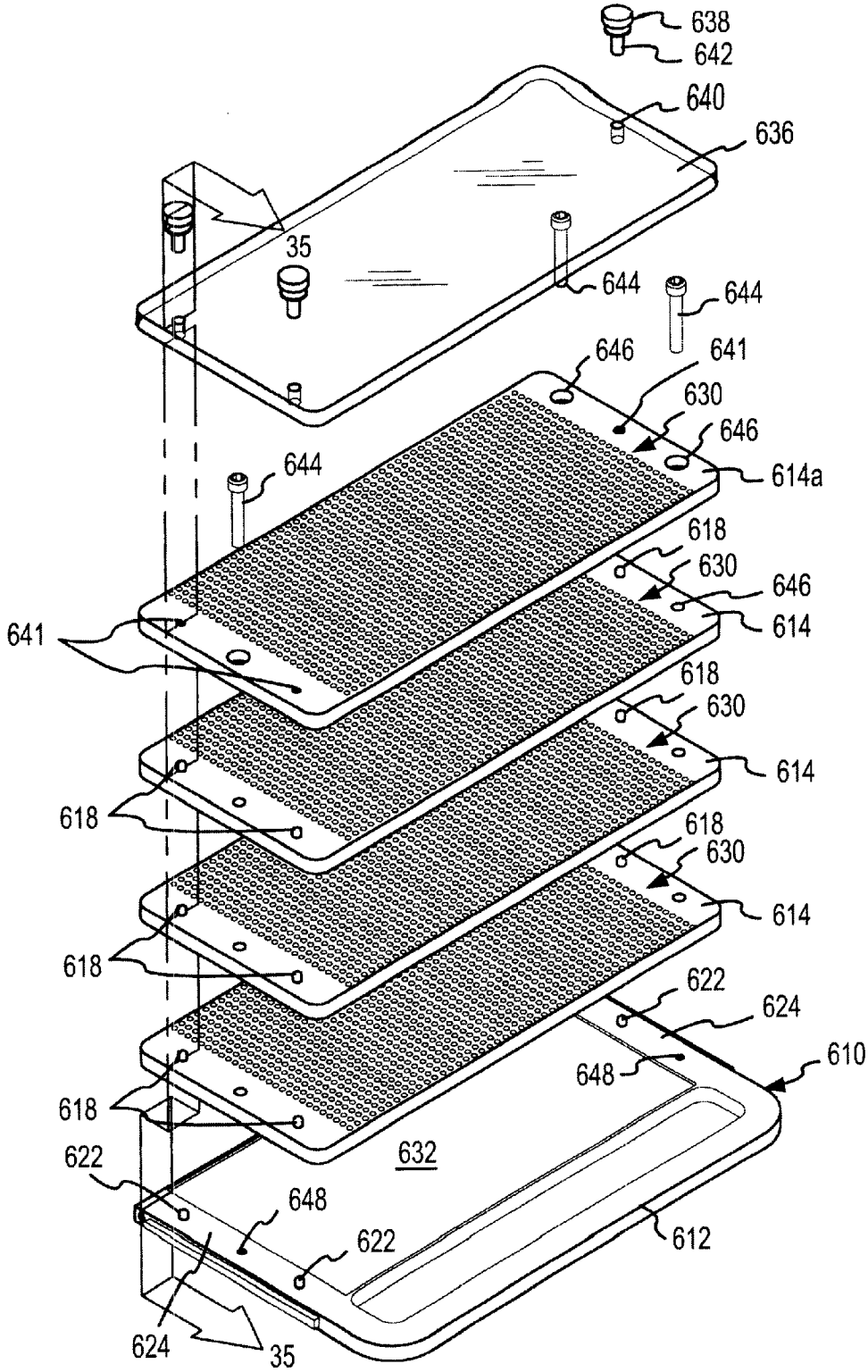
FIG. 34 is an exploded view of the components of the cassette shown in FIG. 33.
Figure 35:
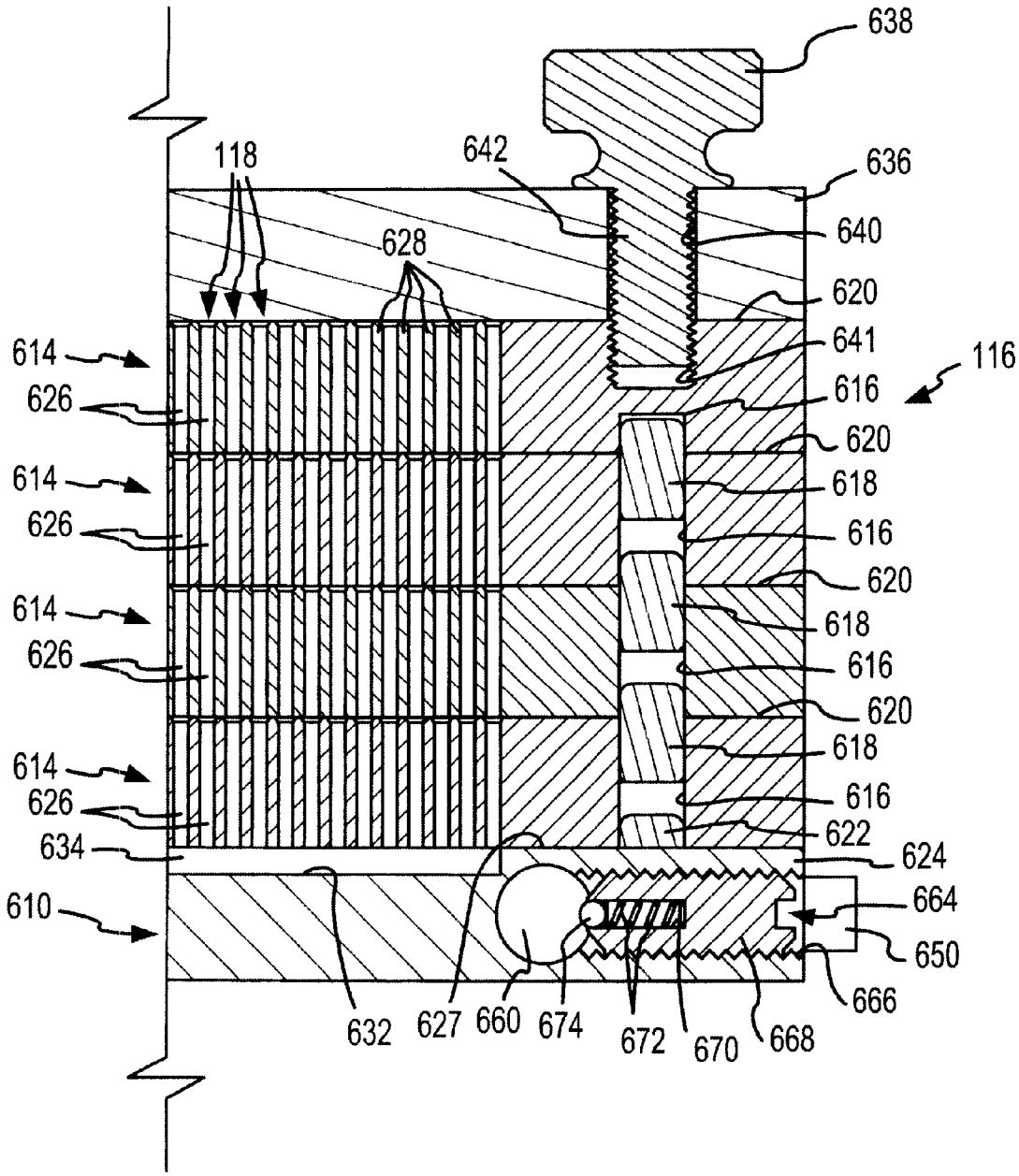
FIG. 35 is an enlarged, partial cross-sectional view of a portion of the cassette shown in FIG. 34, taken substantially in the plane 35—35 of FIG. 34.

The receptacle plates 614*a* and 614 are held in the stacked relationship, and the receptacle plates are retained to the pallet plate 610 by screws 644 which extend through holes 646 formed in the ends of the stacked receptacle plates 614, as shown in FIGS. 33 and 34. The screws 644 are threaded into holes 648 formed in the peripheral portion 624 of the pallet plate 610. The heads of the screws 644 do not protrude above the upper surface 620 of the upper receptacle plate 614*a* because the hole 646 in the upper receptacle plate 614*a* is countersunk. Consequently the heads of the screws 644 do not interfere with the closure of the cover 636 on top of the upper receptacle plate 614*a* to trap the fabricated twist pins in the receptacles 118.

In some circumstances, it might be desirable to heat treat the fabricated twist pins. Heat treating may induce desirable mechanical characteristics in the beryllium copper or other metal from which the twist pins are formed. By fabricating the pallet plates 610 and the receptacle plates 614*a* and 614 from an aluminum metal or ceramic material, the twist pins may be treated while they are retained in the cassette 116. The cassette 116 with loaded twist pins is placed in an oven where the heat treatment occurs.

Figure 36:
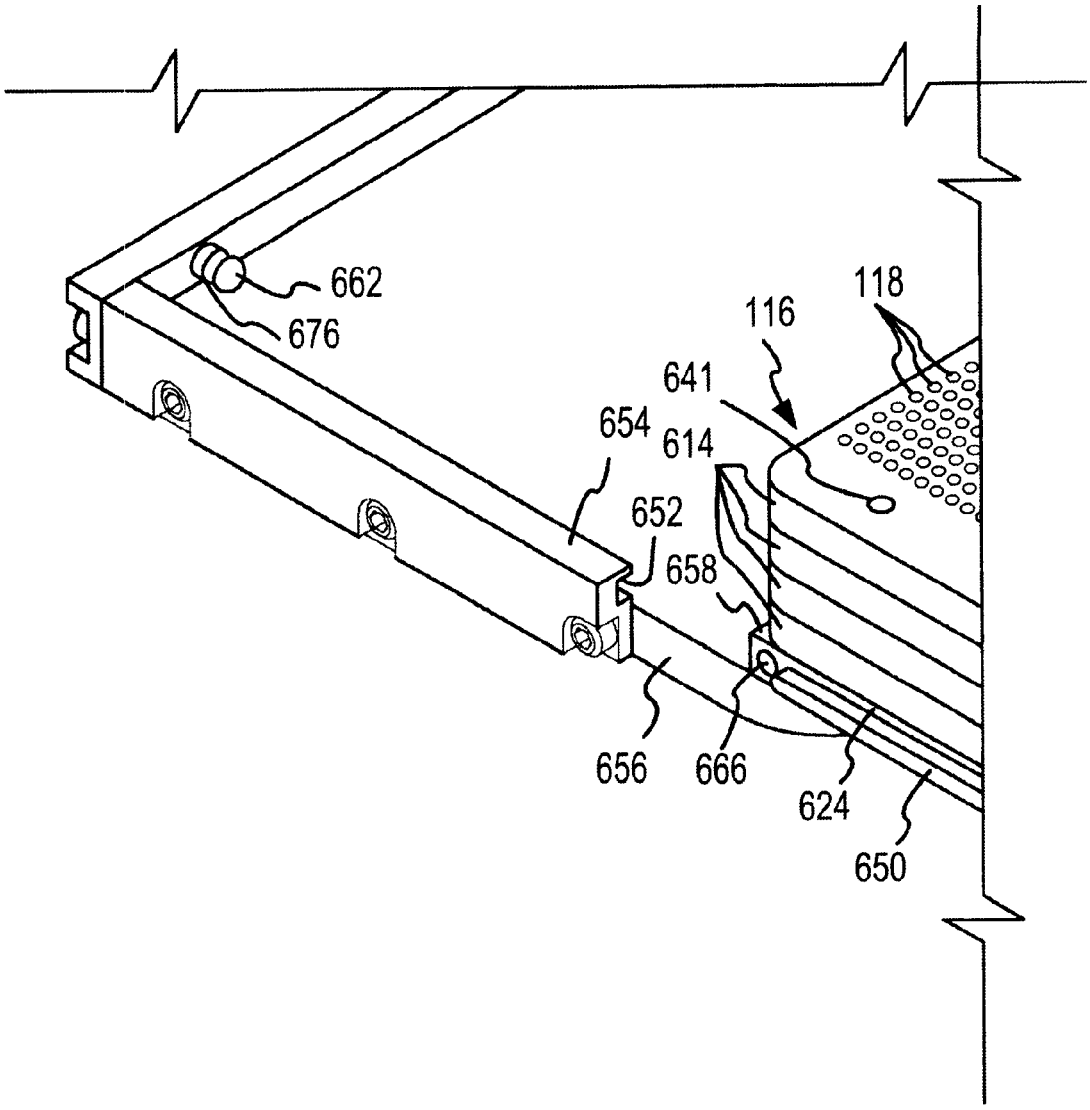
FIG. 36 is a perspective view of a portion of the cassette shown in FIGS. 33–35 and of a portion of an x-y movement table of the twist pin receiving mechanism shown in FIG. 6.

For the x-y movement table 120 to position the receptacles 118 precisely below the delivery nozzle 596 of the delivery tube assembly 542 (FIG. 7), the cassette 116 must be in a fixed and predetermined location on an upper platform 656 of the x-y movement table 120, as shown in FIGS. 6, 35 and 36. To assist in fixing the cassette 116 in position, guide rails 650 are attached to each side of the pallet plate 610. The guide rails 650 extend outwardly from the peripheral portions 624 of the pallet plate 650 and extend generally parallel along an edge of the peripheral portions 624, as shown in FIGS. 35 and 36. The guide rails 650 slide into correspondingly-shaped guide slots 652 which are formed in receivers 654. As shown in FIGS. 6 and 36, the receivers 654 are attached on opposite lateral sides of the upper platform 656 of the x-y movement table 120. The receivers 654 are spaced apart on the platform 656 by a slight tolerance greater than the width of the pallet plate 610 between the opposite outside edges of its peripheral portions 624 (FIGS. 33 and 34).

The location of the receivers 654 and the receipt of the guide rails 650 in the guide slots 652 confine the cassette 116 against lateral movement in the plane of the upper platform 656 in a direction perpendicular to the extension of the guide rails 650 and guide slots 652. The receipt of the guide rails 650 in the guide slots 652 further locates the cassette 116 in a predetermined height relationship relative to the upper platform 656, to confine the cassette against movement in a vertical direction perpendicular to the plane of the upper platform 656. Confining the cassette 116 in a vertical direction relative to the plane of the upper platform 656 assures that the upper surface of the receptacle area 630 (FIG. 33) will be coplanar with the plane of the upper platform 656. Such a coplanar relationship avoids the necessity to continually adjust the vertical height of the delivery nozzle 596 (FIG. 31) as the x-y movement table 120 positions each unoccupied receptacle 118 for the receipt of a fabricated twist pin. A planar relationship of the upper surface of the upper receptacle plate 614*a* is achieved by making the vertical height dimension of each of the receptacle plates 614*a* and 614 uniform across each receptacle plate, and preferably the same for each receptacle plate 614*a* and 614.

To confine the cassette 116 against movement relative to the upper platform 656 in a direction parallel to the guide rails 650, a rear edge 658 (FIG. 36) of the pallet plate 610 includes a registration hole 660 (FIG. 35) into which a registration pin 662 (FIG. 36) is received when the cassette 116 is locked in its final, fixed position on the upper platform 656. A conventional ball plunger device 664 is located in a threaded hole 666 which extends into the pallet plate 610 from a vertical edge adjoining the peripheral portion 624, as shown in FIGS. 35 and 36. The ball plunger device 664 (FIG. 35) comprises a threaded body 668 into which a center hole 670 has been formed. A spring 672 is located in the center hole 670 and biases a ball 674 outward from the center hole 670. A portion of the threaded body 668 adjacent to the opening end of the hole 670 is deformed after the ball 674 has been inserted in the hole 670, to prevent the ball 674 from escaping from the hole 670. The bias of the spring 672 causes the ball 674 to protrude slightly from the end of the threaded body 668, but inward force applied to the ball 674 will cause it to retract into the hole 670 against the bias force from the spring 672.

The ball plunger device 664 extends perpendicularly into the registration hole 660 to locate the ball 674 in position to snap into a groove 676 formed in the end of the registration pin 662, as shown in FIG. 36. With the ball 674 in the groove 676, the pallet plate 610 is firmly and stationarily connected to the upper platform 656, and the cassette 116 will not move along the platform 656 in a direction parallel to the receivers 654. However, the application of manual force on the handle 612 of the pallet plate 610 will cause the ball 674 to retract into the center hole 670 and out of the groove 676 of the registration pin 662 to allow the cassette 116 to be pulled forward in a direction parallel to the guide slots 652 and guide rails 670. In this manner, the cassette 116 can be both confined in a fixed location relative to the upper platform 656 and can be removed from the upper platform 656 when desired.

In addition to the upper platform 656, the x-y movement table 120 includes an actuator mechanism 680 which moves the platform 656 in the front and back directions relative to the machine 100, as shown in FIG. 6. The front and back direction is the direction parallel to the guide rails 650 and the guide slots 652 when the cassette is confined to the x-y movement table 120. The front-back actuator mechanism 680 is conventional, and includes an electric motor 682 which is controlled by the machine controller (not shown) to move the platform 656 in the front and back directions. To achieve movement in the transverse lateral direction, the x-y movement table 120 includes another conventional actuator mechanism 684. The lateral actuator mechanism is attached to and supports front-back actuator mechanism 680, and causes the entire front-back actuator mechanism 680 with its attached upper platform 656 to move in a direction perpendicular to the front-back direction of movement of the actuator mechanisms 680. The lateral actuator mechanism 680 includes an electric motor 686 which causes the movement of the lateral actuator mechanism 680 relative to the stationary frame elements 126.

The electric motors 682 and 686 are preferably stepper motors with a high degree of resolution augmented by the mechanical elements of the actuator mechanism 680 and 684 driven by the motors 682 and 686, respectively. Consequently, a high degree of precision in both horizontal dimensions is available from the x-y movement table 120. This high degree of precision allows each receptacle 118 of the cassette 116 to be placed directly below the delivery nozzle 596 of the delivery tube assembly 542, to transfer a fabricated twist pin into an unoccupied receptacle. As each receptacle is filled with a fabricated twist pin, the machine controller (not shown) energizes the stepper motors 682 and 686 appropriately to position the next unoccupied receptacle 118 below the delivery nozzle 596 to receive the next fabricated twist pin. The controller moves the x-y table 120 at a predetermined time after the sensor 598 (FIG. 31) signals that a fabricated twist pin has passed through the delivery nozzle 596. A predetermined time delay is permitted after the twist pin passes the sensor 598 (FIG. 31) to allow sufficient time for the twist pin to occupy the receptacle 118, before the motors 682 and 686 of the x-y table 120 are activated. The movement of the x-y movement table 120 is completed prior to the time that another twist pin has been severed by the laser beam of the laser beam device 110.

Operation and Method

Figure 37:
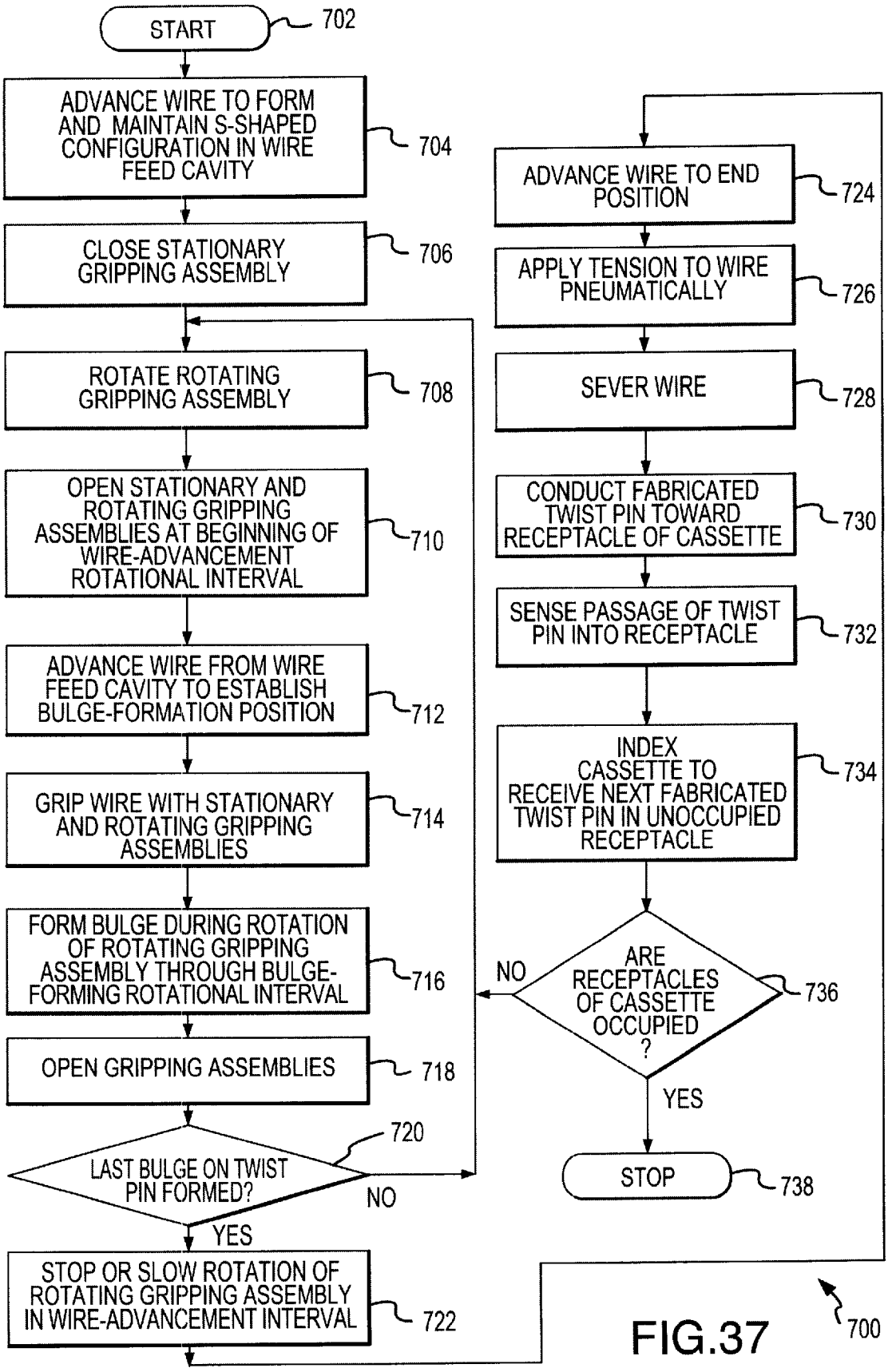
FIG. 37 is a flowchart of the basic methodology of fabricating twist pins according to the present invention and of the functions performed by the twist pin fabricating machine shown in FIG. 6.

The manner in which the above-described wire feed mechanism 104, the bulge forming mechanism 106, the inductor mechanism 108, the laser beam device 110 and the twist pin receiving mechanism 114 cooperatively function in the twist pin fabricating machine 100, and the general method of fabricating twist pins according to the present invention, is illustrated by a process flow shown at 700 in FIG. 37. The separate operations of the machine and the steps of the method in the process flow 700 are referenced by separate reference numbers. The process flow 700 presumes normal functionality without consideration of error or malfunction conditions, and also assumes that twist pins will be fabricated until a cassette is full. Thereafter, the process will continue by replacing the filled cassette with an empty one.

The process flow 700 begins at step 702. At step 704, wire is unwound from the spool 102 and advanced into the cavity 170 of the wire feed mechanism 104 (FIGS. 6, 7). Step 704 also involves forming and maintaining the S-shaped configuration 234 (FIG. 9), by executing the steps previously described in connection with FIG. 12.

At step 706, the stationary gripping assembly 290 is closed (FIG. 20) by energizing the solenoid 330 (FIGS. 17, 20). The rotating gripping assembly 294 (FIGS. 15, 16) is rotated by energizing the stepper drive motor 294 (FIG. 14), as shown at step 708. Next, as shown at step 710, the rotating gripping assembly is rotated until it reaches the position at which the rotating gripping assembly is opened (FIG. 27) by the contact of the actuating arm 390 or 394 with the opening trip pin 500 (FIG. 28). Also as part of step 710, the stationary gripping assembly 290 is opened (FIG. 21) as a result of de-energizing the solenoid 330 (FIG. 17) in response to the trigger signal from the sensor 514.

With both the stationary and the rotating gripping assemblies in the open position as a result of executing step 710, the wire is next advanced at step 712 as a result of energizing the precision feed motor 212 with pulses to cause it to rotate the spindle 200 (FIGS. 8, 9). The rotating spindle 200 advances slack wire from the S-shaped configuration 234 in the cavity 170 into the bulge forming mechanism 106 (FIG. 7). The wire is advanced at step 712 until the desired location for forming the bulge 58 (FIG. 1) is established. The correct position of the wire is established by counting the number of energizing pulses applied to be precision stepper motor 212.

Once the wire has been positioned at the desired location for the formation of a bulge, at step 712, the wire is gripped by closing both the stationary and the rotating gripping assemblies, as shown at step 714. Closing the stationary gripping assembly (FIG. 20) is achieved by energizing the solenoid 300 (FIG. 17) at a time correlated to the number of pulses supplied to the stepper drive motor 294 (FIGS. 7 and 14) so that the stationary gripping assembly closes at approximately the same time or slightly earlier than the rotating gripping assembly closes. Closing the rotating gripping assembly (FIG. 26) is achieved by rotation of the rotating gripping assembly 292 until one of the actuating arms 392 or 396 contacts the closing trip pin 502 (FIG. 30). Upon execution of step 714, the wire 52 is gripped above and below the position where a bulge 58 (FIG. 1) is to be formed.

A bulge 52 (FIG. 1) is thereafter formed during the rotation of the rotating gripping assembly 292 through the bulge-forming rotational interval, as shown at step 716. The bulge forming rotational interval is that part of a complete revolution of the rotating gripping assembly clockwise from the position shown in FIG. 30 to the position shown in FIG. 28. During this rotational interval, the bulge 58 (FIG. 1) is formed in a single continuous, uninterrupted movement by the action of the rotating gripping assembly 292.

At step 718, the stationary gripping assembly and the rotating gripping assembly are both opened (FIGS. 21 and 27). The stationary gripping assembly is opened by de-energizing the solenoid 330 (FIG. 17) in response to the trigger signal supplied by the sensor 514. The rotating gripping assembly is opened by the contact of one of the actuating arms 590 or 594 with the opening trip pin 500 (FIG. 28).

A determination is thereafter made at step 720 as to whether the last bulge of the twist pin has just been formed. If not, the program flow loops back to step 708, and thereafter steps at 708, 710, 712, 714, 716, 718, and 720 are again executed in a loop. The steps of this loop are repeated, until all of the bulges 58 (FIG. 1) of the twist pin have been formed. Once all of the bulges for the twist pin have been formed, the determination at step 720 causes the program flow to advance to step 722.

The rotating gripping mechanism is stopped or slowed at step 722. The rotational position where the rotating gripping mechanism is slowed or stopped is in that part of the rotational interval where the rotating gripping assembly 292 is opened (FIG. 29), after an actuating arm 390 or 394 of the cam wheel 386 has contacted the open trip pin 500 (FIG. 28). Slowing or stopping the rotating gripping mechanism in the part of its rotational interval where the rotating gripping assembly is opened is achieved by controlling the application of energizing pulses to the stepper drive motor 294 (FIG. 14).

Executing steps 718 and 722 allows the wire to be advanced at step 724. The wire advancement at step 724 positions the wire at a location where ends 70 and 74 (FIG. 1) of the twist pin 50 are to be formed. The position of the wire established at step 724 locates the ends 70 and 74 where the laser beam from the laser device 110 (FIGS. 6, 7) will melt the wire to sever the fabricated twist pin and form the ends 70 and 74.

However, before severing the wire, gas is delivered to the venturi assembly 540 (FIG. 32), and the resulting low-pressure surrounding the wire within the center bore 560 (FIG. 32) pneumatically induces tension in the wire, as shown at step 726. The tension induced by the venturi assembly is resisted by the spindle 200 and the pinch roller 220 of the wire feed mechanism 104 (FIG. 7) which are non-rotational at this time. The stationary gripping assembly should also be closed in a step (not shown) executed between steps 724 and 726, to cause the tension applied at step 726 to be resisted by the stationary gripping assembly.

After the tension has been applied pneumatically to the wire at step 726, the laser beam device 110 is actuated and the laser beam melts the wire at the end positions to sever the fabricated twist pin from the wire, as shown at step 728. The air flow from the venturi assembly through the delivery tube assembly 542 (FIG. 31) conducts the severed and fabricated twist pin toward the cassette as shown at step 730.

As shown at step 732, the twist pin is sensed as passing into the delivery nozzle 596 of the delivery tube assembly 542 (FIG. 31). The sensing at step 732 is accomplished by the sensor 598 (FIG. 31). Sensing the passage of the fabricated twist pin from the delivery nozzle 596 ceases the delivery of air flow to the venturi assembly 540. Terminating the air flow to the venturi assembly also terminates the flow of air through the delivery tube assembly 542 (FIG. 31) which carried the fabricated twist pin to the delivery nozzle 596. Sensing the fabricated twist pin at step 732 also causes the x-y movement table 120 to move or index into a position in which an unoccupied receptacle 118 (FIG. 35) is located below the delivery nozzle 596. The step of indexing the cassette is illustrated at 734, and is typically executed after a predetermined time delay after passage of the twist pin has been sensed at step 732.

Next, as shown at step 736, a determination is made as to whether all of the receptacles 118 of the cassette 116 (FIGS. 6, 33, 35) are fully occupied by fabricated twist pins. The determination made at step 736 is accomplished by first knowing the number of available receptacles in the cassette, and then counting the number of fabricated twist pins which are delivered as a result of sensing step at 732.

Until all of the receptacles of the cassette have been fully occupied, twist pins will continue to be fabricated and delivered to the cassette, as a result of the program flow looping from step 736 back to step 708. The execution of the steps between 708 and 736 results in the fabrication of a single additional twist pin. Once all the receptacles of the cassette have been occupied, the program flow 700 stops at step 738. Then, the operator may thereafter remove the full cassette 116, cover it with the cover 636 (FIGS. 33–35) and insert a new cassette with unoccupied receptacles onto the x-y movement table 120 (FIG. 6) to continue the process flow 700 by starting over at step 702.

Although the functions of the wire feed mechanism 104, the bulge forming mechanism 106, the inductor mechanism 108 and the twist pin receiving mechanism 114 have been shown in FIG. 37 as occurring sequentially, the present invention can also be executed with these functions occurring in a parallel multi-tasking fashion. For example, step 704 occurs independently of the execution of steps 706–736. Step 708–720 could be executed as a single task, and the steps 730–736 could be executed as a single task.

SUMMARY OF IMPROVEMENTS

In summary of the more detailed explanations of the improvements described above, the wire feed mechanism 104 unwinds wire from the spool 102 and advances it into the cavity 170 to form the S-shaped configuration 234. The S-shaped configuration 234 constitutes sufficient slack wire to decouple the rotational inertia of the spool 102 from the advancement of the wire into the bulge forming mechanism 106. Consequently, by maintaining the S-shaped configuration of slack wire and then advancing slack wire from the S-shaped configuration 234 into the bulge forming mechanism 106, the wire is more precisely advanced into a desired position in the bulge forming mechanism 106 because it need not be unwound against the resistance and inertia of the wire from the spool 102. The slack wire of the S-shaped configuration 234 does not create sufficient inertia or mass that will result in slippage of the wire as it is advanced by the precision feed motor 212.

The wire is unwound from the spool into the wire feed mechanism 104 directly by the rotational effects of the pre-feed motor 150, and the wire is advanced from the cavity 170 by the direct rotation of the precision feed motor 212. Both motors 150 and 212 are directly controlled to rotate on an as-needed basis to advance the wire. No reciprocating movements are involved in advancing the wire into the cavity 170 or from the cavity 170 into the bulge forming mechanism 106. Therefore, greater efficiency is achieved by the continual and direct wire-advancing action, without lost movement and without the latency involved in the non-productive return strokes of reciprocating wire advancement mechanisms. By avoiding the problems associated with accelerating and decelerating the reciprocating mechanisms or the spool during unwinding of the wire, and by not having to account for the latency and potential slippage induced by such mechanisms, the wire feed mechanism 104 of the present invention offers the ability to feed the wire more rapidly and precisely to achieve a higher production rate of twist pins.

The improvements available from the bulge forming mechanism 106 also achieve a higher production rate of twist pins. The rotating gripping assembly 292 rotates continuously and fully creates a single bulge during a continuous rotational interval of each complete revolution. During the remaining rotational interval of each revolution, the wire is advanced to allow the bulges to be fabricated sequentially and without lost motion and inefficiency. More bulges are therefore created in a shorter amount of time, resulting in fabricating twist pins more efficiently and quickly.

Creating a single bulge as a result of a single revolution achieves improvements over prior techniques requiring more than one separate movement to completely form the bulge. The shape of each bulge formed is also more uniform, consistent and symmetrical as a result of the single bulge-forming movement. The crescent shaped gripping surfaces 486 and 488 grip the wire strands in an oval shape to transfer a greater amount of rotational torque to rotate the wire in the anti-helical direction without slippage when forming the bulge. The shape of the bulges formed is enhanced by avoiding wire slippage. Consistent and more uniformly shaped bulges create better electrical connections between the twist pins and the vias of the printed circuit boards through which the twist pins are inserted. The greater extent of the rotational interval during which the wire is untwisted in the anti-helical direction contributes to the ability to form a single bulge during each revolution of the rotating gripping assembly 292. Forming each bulge as a single movement during a part of each revolution also contributes to forming the bulges concentrically and coaxially along the length of the wire. Maintaining a coaxial relationship of all the portions of the twist pin along the length of the twist pin assures that the twist pin will be more easily inserted through the aligned vias in the printed circuit boards. There is less likelihood that the wire will be deflected from a coaxial relationship when the bulges are formed from a single continuous movement, compared to the prior art technique of requiring more than one movement to form each bulge.

Coordinating the formation of the single bulge during a rotational interval of single revolution of the rotating gripping assembly, coupled with the advancement of the wire during the remaining rotational interval of each single revolution, also contributes to a higher production rate of fabricated twist pins. Little or no latency or delay in operation is required to accommodate the advancement of the wire. The precise advancement of the wire allows the positions of the bulges between the intervals to be precisely controlled. However in those cases where it is necessary to advance a greater amount of wire to form the leader of the twist pin, for example, the rotational rate of the rotating gripping assembly can be slowed during the wire advancing interval of the revolution by the precise control available over the stepper drive motor which rotates the rotating gripping assembly. Thus, the advancement of the wire is efficiently and effectively coordinated with the formation of the bulges to achieve a high fabrication rate.

The formation of the bulges in a continuous, non-reciprocating operation avoids the prior art problems associated with the latency and the acceleration and deceleration forces created by the inertia and the mass of various prior art mechanisms used to form the bulges. Instead, the bulges are formed as a result of continuous, motion-efficient and more rapidly executed movements during which the wire is advanced, gripped, anti-helically rotated and released with each revolution of the rotating gripping assembly. The rotating clamp member presents little rotational mass to slow the rotational acceleration rate or to make the rotational acceleration position of the rotating gripping assembly more difficult to control. Consequently, the precise control over the rotational position of the rotating gripping assembly allows the wire to be advanced more controllably and precisely to position the bulges at desired locations along the length of the fabricated twist pin, without slippage which would cause the bulges and other characteristics of the twist pin to be incorrectly located or positioned.

The more precisely fabricated twist pins are conveniently severed from the wire as a result of the slight tension force induced pneumatically by the venturi assembly as the laser beam severs the wire. The delivery tube assembly readily conveys the fabricated twist pins through the delivery nozzle. The sensor recognizes the passage of twist pin and prevents further machine operation should an inadvertent jam or other problem occur. The precise positional relationships and configurations of the receptacles and the characteristics of the cassette allow the x-y movement table to precisely position unoccupied receptacles to receive the fabricated twist pins. The x-y movement table moves an unoccupied receptacle into position for the receipt of the fabricated twist pin as rapidly as a new twist pin is fabricated. The movement of the fabricated twist pins occurs without manual contact of the pins, which might bend or damage the twist pins. The gas flow through the delivery tube assembly carries the fabricated twist pins completely into the receptacles of the cassette, because the space beneath the receptacles 118 provides relief for the gas flow out of the receptacle as the fabricated twist pin is delivered into the receptacle. The cassettes provide a convenient arrangement for storing the fabricated twist pins, for holding the fabricated twist pins during further processing, such as heat treatment, and making the twist pins conveniently available for removal and insertion when the modules are formed.

A presently preferred embodiment of the invention and many of its improvements have been described with a degree of particularity. This description is of a preferred example of implementing the invention and is not necessarily intended to limit the scope of the invention. The scope of the invention is defined by the following claims.

The invention claimed is:

1. A machine for fabricating twist pins each from a segment of a greater length of stranded wire formed by a plurality of helically coiled strands, each twist pin further having at least one bulge formed at a predetermined location along the segment of the wire from which twist pin is fabricated, comprising:

a wire feed mechanism which is receptive of the length of wire, the wire feed mechanism including:

a roller which frictionally contacts the length of wire, and a feed motor connected to rotate the roller while the roller is in frictional contact with the wire to advance the length of wire during a wire advancement interval;

a bulge forming mechanism into which the wire feed mechanism advances the length of wire to establish each predetermined location at which a bulge is to be formed, the bulge forming mechanism forming the bulge in the length of wire at the predetermined location during a bulge forming interval, the bulge forming mechanism including:

first and second controllable clamp members located at locations to contact the wire above and below the predetermined location at which the bulge is to be formed, the first and second clamp members connected for rotation in an anti-helical direction relative to one another and to the wire, the first and second clamp members selectively gripping and releasing the wire when controlled, a drive motor connected to rotate the first and second clamp members in complete relative revolutions with respect to one another, a first actuator connected to control the first clamp member to grip the wire at the beginning of the bulge-forming interval of the relative revolution, a second actuator connected to control the second clamp member to grip the wire at the beginning of the bulge-forming interval, the first and second clamp members rotating the wire anti-helically between the first and second clamp members during the bulge-forming interval to untwist the helically coiled strands until the strands deflect radially outward to form the bulge, the first and second actuators controlling the first and second clamp members to release the grip on the wire at the end of the bulge-forming interval; and a wire severing device positioned relative to the bulge forming mechanism and controllable after each bulge in the twist pin has been formed to sever the segment from the length of wire and release the twist pin fabricated in the segment of the severed wire.

2. A machine as defined in claim 1 wherein:

the drive motor rotates the first and second clamp members relative to one another during the wire-advancement interval which occurs sequentially with respect to the bulge-forming interval;

the feed motor rotates the roller to advance the wire during the wire-advancement interval; and the feed motor advances a predetermined amount of the length of wire to establish the predetermined location where the next bulge is to be formed during the wire-advancement interval.

3. A machine as defined in claim 2 wherein:

the drive motor continuously rotates the first and second clamp members relative to one another during the bulge-forming rotational interval without interruption of the continuous relative rotational movement.

4. A machine as defined in claim 2 wherein:

the bulge-forming rotational interval is greater than half of a single relative revolution of the first and second clamp members.

5. A machine as defined in claim 1 wherein:

one of the clamp members is stationarily connected;

the other one of the clamp members is connected to a wheel which is connected for rotation relative to the stationary clamp member; and the drive motor is connected to rotate the wheel.

6. A machine as defined in claim 2 wherein:

one of the clamp members is stationarily connected;

the other one of the clamp members is connected to a wheel which is connected for rotation relative to the stationary clamp member;

the drive motor is connected to rotate the wheel; and the drive motor is controllable to temporarily cease rotating the wheel during the wire-advancement interval and while the wire feed mechanism advances the wire to the predetermined location.

7. A machine as defined in claim 2 wherein:

one of the clamp members is stationarily connected;

the other one of the clamp members is connected to a wheel which is connected for rotation relative to the stationary clamp member;

the drive motor is connected to rotate the wheel at a predetermined rotational rate during the bulge-forming interval;

the drive motor is controllable to temporarily reduce the rotational rate of the wheel to a lesser value from the predetermined rotational rate during the wire-advancement interval while the wire feed mechanism advances the wire to the predetermined location.

8. A machine as defined in claim 1 wherein the wire feed mechanism further comprises:

a slack wire supplying assembly contacting the length of wire upstream of the roller and operativiely delivering slack wire to the roller; and wherein:

the roller withdraws the slack wire and advances the length of wire to the bulge forming mechanism.

9. A machine as defined in claim 8 wherein the slack wire supplying assembly further comprises:

a second roller in addition to the roller first aforesaid, the second roller frictionally contacting the wire; and a feed motor connected to rotate the second roller and advance the wire to create the slack wire.

10. A machine as defined in claim 1 wherein:

the wire severing device is positioned downstream of the bulge forming mechanism relative to the advancement of the wire through the bulge forming mechanism; and further comprising:

a pneumatic inductor assembly positioned to receive the severed segment containing the twist pin from the wire severing device, the pneumatic inductor assembly creating a flow of gas sufficient to convey the twist pin after the wire severing device releases the twist pin;

a delivery tube assembly connected to receive the flow of gas and the conveyed twist pin from the pneumatic inductor assembly, the delivery tube assembly including a delivery nozzle through which the flow of gas and the twist pin is conveyed;

a cassette having a plurality of receptacles located therein in predetermined positions; and a movement device supporting the cassette at a position below the delivery nozzle and operative to move the cassette to position an unoccupied receptacle below the delivery nozzle to receive the severed wire segment in which the twist pin is fabricated.

11. A machine as defined in claim 10 wherein:

the movement device moves the cassette to position an unoccupied receptacle below the delivery nozzle after a twist pin has been received into a receptacle.

12. A machine as defined in claim 10 wherein:

each receptacle conducts the flow of gas through the receptacle to carry the twist pin into the receptacle.

13. A method of fabricating a twist pin having bulges from wire formed by a plurality of helically coiled strands, comprising the steps of:

advancing the wire to a predetermined location at which a bulge is to be formed;

rotating the wire anti-helically through a continuous rotational interval relative to positions above and below the predetermined location to untwist the helically coiled strands until the strands at the predetermined location deflect radially outward to form the bulge;

severing a segment of the wire within which the bulge is formed from a remaining length of the wire to form the twist pin; and conveying the severed twist pin within a flow of gas into a receptacle immediately after severing segment containing the twist pin.

14. A method as defined in claim 13 further comprising the step of:

advancing the wire by frictionally contacting a roller with the wire and rotating the roller while in frictional contact with the wire.

15. A method as defined in claim 14 further comprising the step of:

tangentially contacting the roller with the wire.

16. A method as defined in claim 14 further comprising the step of:

rotating the roller in contact with the wire in a singular rotational direction.

17. A method as defined in claim 16 further comprising the step of:

intermittently rotating the roller in the singular rotational direction.

18. A method as defined in claim 13 wherein the step of rotating the wire anti-helically further comprises the steps of:

gripping the wire at the positions above and below the predetermined location;

holding the wire stationarily at one gripped position; and rotating the gripped wire at the other gripped position through a bulge-forming rotational interval to form the bulge.

19. A method as defined in claim 18 further comprising the step of:

continuously rotating the wire through the bulge-forming rotational interval without interruption of the continuous rotational movement.

20. A method as defined in claim 18 further comprising the step of:

establishing the bulge-forming rotational interval as a fractional portion of approximately three-fourths of a complete revolution.

21. A method as defined in claim 18 further comprising the step of:

establishing the bulge-forming rotational interval as a fractional portion greater than half of a single revolution.

22. A method as defined in claim 21 further comprising the steps of:

selectively gripping and releasing the wire at positions above and below the predetermined location with a controllable clamp member at each position;

rotating the clamp members in a complete revolution relative to one another;

controlling the clamp members to grip the wire during the bulge-forming rotational interval which occupies a fractional portion of the complete relative revolution; and controlling at least one of the clamp members to release the grip on the wire during a remaining rotational interval of the complete relative revolution which is not occupied by the bulge-forming rotational interval.

23. A method as defined in claim 22 further comprising the steps of:

controlling both clamp members to release their grips on the wire during the remaining rotational interval; and advancing the wire to another predetermined location at which a bulge is to be formed during the remaining rotational interval while the grip is released.

24. A method as defined in claim 18 further comprising the steps of:

releasing the grips on the wire above and below the predetermined location after forming the bulge; and advancing the wire to another predetermined location at which a bulge is to be formed after the grips are released.

25. A method as defined in claim 13 further comprising the steps of:

creating an amount of relatively slack wire; and advancing the wire from the amount of relatively slack wire.

26. A method as defined in claim 25 further comprising the steps of:

using wire wound on the spool;

unwinding wire from the spool to create the amount of relatively slack wire by frictionally contacting a roller with the wire and rotating the roller while in frictional contact with the wire.

27. A method as defined in claim 13 further comprising the step of:

confining the twist pin in the receptacle until withdrawing the twist pin from the receptacle for insertion in a via of a printed circuit board.

28. A method as defined in claim 13 further comprising the steps of:

forming a plurality of twist pins in the manner aforesaid;

conveying each twist pin into a separate receptacle of a cassette having a plurality of receptacles; and delivering each conveyed twist pin to a different receptacle of the cassette.

29. A method as defined in claim 28 further comprising the steps of:

delivering each conveyed twist pin from a delivery nozzle; and moving the cassette relative to the delivery nozzle to position an unoccupied receptacle below the delivery nozzle for receipt of a twist pin.

30. A method of fabricating twist pins each from a segment of a greater length of stranded wire formed by a plurality of helically coiled strands, each twist pin including at least one bulge formed at a predetermined location along the segment of the wire from which the twist pin is fabricated, comprising the steps of:

gripping the wire at one position with a first controllable clamp member above the predetermined location where the bulge is to be formed;

gripping the wire at another position with a second controllable clamp member below the predetermined location where the bulge is to be formed;

rotating the first and second clamp members anti-helically with respect to one another through a continuous bulge-forming rotational interval to untwist the helically coiled strands to deflect the strands into the bulge at the predetermined location between the positions where the wire is gripped by the first and second controllable clamp members;

controlling the first and second controllable clamp members to release the grip on the wire after rotating the first and second clamp members in the relative rotation through the bulge-forming rotational interval;

continuing the relative rotation of the first and second clamp members through a wire-advancement rotational interval following the bulge-forming rotational interval;

advancing the wire during the wire-advancement rotational interval; and severing from the length of wire the segment in which the bulge has been formed to release the twist pin fabricated in the segment of the severed wire.

31. A method as defined in claim 30 further comprising the step of:

maintaining the relative rotation of the first and second clamp members during the wire-advancement rotational interval.

32. A method as defined in claim 30 further comprising the step of:

temporarily ceasing the relative rotation of the first and second clamp members during the wire-advancement rotational interval while advancing the wire.

33. A method as defined in claim 30 further comprising the steps of:

stationarily positioning one of the clamp members; and rotating the other one of the clamp members relative to the stationary clamp member during the bulge-forming rotational interval.

34. A method as defined in claim 33 further comprising the step of:

rotating the other rotating clamp member in a single rotational direction.

35. A method as defined in claim 30 further comprising the step of:

continuously rotating the clamp members in complete relative revolutions with respect to one another.

36. A method as defined in claim 30 further comprising the step of:

occupying a complete relative revolution of relative rotation of the clamp members by the bulge-forming rotational interval and the wire-advancing rotational interval.

* * * * *